US012736277B2

(12) United States Patent
Choi

(10) Patent No.: US 12,736,277 B2
(45) Date of Patent: Sep. 15, 2026

(54) REFRIGERATOR

(71) Applicant: LG ELECTRONICS INC., Seoul (KR)

(72) Inventor: Seonwoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 165 days.

(21) Appl. No.: 18/886,200

(22) Filed: Sep. 16, 2024

(65) Prior Publication Data

US 2025/0003675 A1 Jan. 2, 2025

Related U.S. Application Data

(63) Continuation of application No. 18/127,318, filed on Mar. 28, 2023, now Pat. No. 12,123,643, which is a (Continued)

(30) Foreign Application Priority Data

Dec. 3, 2018 (KR) ..... 10-2018-0153531

(51) Int. Cl.
*F25D 25/02* (2006.01)
*F25D 11/02* (2006.01)
(Continued)

(52) U.S. Cl.
CPC ..... *F25D 25/025* (2013.01); *F25D 11/02* (2013.01); *F25D 25/00* (2013.01); *F25D 27/00* (2013.01);
(Continued)

(58) Field of Classification Search
CPC ..... F25D 25/025; F25D 11/02; F25D 25/00; F25D 27/00; F25D 2325/021;
(Continued)

(56) References Cited

U.S. PATENT DOCUMENTS 9,377,238 B2 6/2016 Hall et al.
2006/0042305 A1 3/2006 Oh et al.
(Continued)

FOREIGN PATENT DOCUMENTS

CN 1766508 A * 5/2006 ..... F25D 25/025
CN 106595167 A 4/2017
(Continued)

OTHER PUBLICATIONS

Extended European Search Report in European Application No. 19209984.4, dated Apr. 9, 2020, 5 pages.

*Primary Examiner* — Frantz F Jules
(74) *Attorney, Agent, or Firm* — Birch, Stewart, Kolasch & Birch, LLP

(57) ABSTRACT

A refrigerator includes a cabinet that defines a storage chamber, and a drawer door configured to be inserted into and withdrawn out of the storage chamber. The drawer door includes a drawer part that defines a storage space and a door part configured to open and close the storage chamber based on the drawer door being inserted into and withdrawn out of the storage chamber. An electric device is provided in the door part, and a wiring extends from the cabinet to the drawer door. A wiring guider extends from the cabinet to the drawer door and provides a passageway for the wiring. The wiring guider includes a first linear section connected to the drawer door, a second linear section connected to the cabinet, and a bent section between the first linear section and the second linear section.

20 Claims, 34 Drawing Sheets

Related U.S. Application Data continuation of application No. 17/829,660, filed on Jun. 1, 2022, now Pat. No. 11,656,024, which is a continuation of application No. 16/701,015, filed on Dec. 2, 2019, now Pat. No. 11,378,330.

(51) Int. Cl.
*F25D 25/00* (2006.01)
*F25D 27/00* (2006.01)

(52) U.S. Cl.
CPC .... *F25D 2325/021* (2013.01); *F25D 2400/40* (2013.01)

(58) Field of Classification Search
CPC .... F25D 2400/40; F25D 25/04; F25D 23/021; A47B 88/457; A47B 88/90; A47B 2088/901; A47B 2210/175; H02G 11/00
See application file for complete search history.

(56) References Cited

U.S. PATENT DOCUMENTS

| | | | | |
|---|---|---|---|---|
| 2006/0087207 | A1 | 4/2006 | Oh et al. | |
| 2006/0103273 | A1 | 5/2006 | Lee et al. | |
| 2006/0104756 | A1 | 5/2006 | Kim et al. | |
| 2006/0152119 | A1* | 7/2006 | Park | F25D 25/025 312/333 |
| 2011/0006656 | A1* | 1/2011 | Nam | F16H 19/04 312/404 |
| 2011/0050065 | A1 | 3/2011 | Lee et al. | |
| 2011/0146333 | A1 | 6/2011 | Koo et al. | |
| 2014/0117830 | A1* | 5/2014 | Lee | F25D 25/025 312/402 |
| 2014/0265806 | A1 | 9/2014 | Hall et al. | |
| 2016/0178274 | A1* | 6/2016 | Shin | F25D 25/025 312/408 |
| 2017/0059235 | A1* | 3/2017 | Dixon | F25D 25/025 |
| 2018/0128540 | A1 | 5/2018 | Yasaka et al. | |

FOREIGN PATENT DOCUMENTS

| | | | | |
|---|---|---|---|---|
| CN | 109838961 | A | 6/2019 | |
| KR | 20020088283 | A * | 11/2002 | A23B 7/105 |
| KR | 10-2006-0011221 | A | 2/2006 | |
| KR | 10-2006-0025806 | A | 3/2006 | |
| KR | 10-0565695 | B1 | 3/2006 | |
| KR | 10-2006-0113435 | A | 11/2006 | |
| KR | 10-2010-0064551 | A | 6/2010 | |
| KR | 10-2010-0105270 | A1 | 9/2010 | |
| KR | 10-2011-0010409 | A | 2/2011 | |
| KR | 10-2011-0024883 | A | 3/2011 | |
| KR | 10-1362377 | B1 | 2/2014 | |
| KR | 10-2015-0089161 | A | 8/2015 | |
| WO | WO 2018/051963 | A1 | 3/2018 | |

* cited by examiner

REFRIGERATOR

CROSS-REFERENCE TO RELATED APPLICATIONS

This application is a Continuation of U.S. application Ser. No. 18/127,318, filed on Mar. 28, 2023, which is a Continuation of U.S. application Ser. No. 17/829,660, filed on Jun. 1, 2022 (now U.S. Pat. No. 11,656,024, issued on May 23, 2023), which is a Continuation of U.S. application Ser. No. 16/701,015, filed on Dec. 2, 2019 (now U.S. Pat. No. 11,378,330, issued on Jul. 5, 2022), which claims priority under 35 U.S.C. § 119 (a) to Application No. 10-2018-0153531, filed in the Republic of Korea on Dec. 3, 2018, all of which are hereby expressly incorporated by reference into the present application.

BACKGROUND

The present disclosure relates to a refrigerator.

In general, refrigerators are home appliances for storing foods at a low temperature in a storage chamber that is covered by a door. For this, refrigerators cool the inside of the storage chamber by using cool air generated by being heat-exchanged with a refrigerant circulated through a refrigeration cycle to store foods in an optimum state.

Such a refrigerator is becoming larger and multifunctioned as dietary changes and user's preferences become more diverse, and thus, a refrigerator having various structures and convenience devices for user's convenience and freshness of stored foods has been introduced.

The storage chamber of the refrigerator may be opened/closed by the door. Also, refrigerators may be classified into various types according to an arranged configuration of the storage chamber and a structure of the door for opening and closing the storage chamber.

The refrigerator door may be classified into a rotation-type door that opens and closes a storage chamber through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a refrigerator in which a lifting mechanism for elevating a bin provided in a refrigerating compartment is disclosed in U.S. Pat. No. 9,377,238.

However, according to the related art, the lifting mechanism for elevation may be disposed outside the bin and thus exposed. In addition, a wiring for an operation of the lifting mechanism and a wiring connected to electronic components provided in a door may be exposed to the outside.

Thus, serious limitation in safety may occur due to the exposure of the lifting mechanism and the wiring. Also, the exposed wirings may be damaged during the repeated lifting operation or the withdrawal of the drawer to cause failure or malfunction.

SUMMARY

Embodiments provide a refrigerator in which electronic components are provided in a door part defining a front surface of a draw-out drawer door, and a wiring guider that connects a cabinet to the door part to guide wirings connected to the electronic components is provided.

Embodiments also provide a refrigerator in which an electric device for elevation is provided inside a door part, and a mechanical device for elevating is provided in a drawer part, and a wiring guider guiding a wiring from a cabinet to the door part is provided.

Embodiments also provide a refrigerator provided with a wiring guider that prevents a wiring connected to electronic components provided in a draw-out door from being exposed to the outside when the door is inserted and withdrawn.

Embodiments also provide a refrigerator provided with a wiring guider that connects a draw-out door to a main body to guide an arrangement of a wiring.

Embodiments also provide a refrigerator provided with a wiring guider capable of stably maintaining a connected state of a wiring even though a door is repeatedly inserted and withdrawn.

Embodiments also provide a refrigerator in which a wiring is easily connected to electric components within a draw-out door through a wiring guider.

Embodiments also provide a refrigerator which prevents constituents for elevation of a drawer part and a wiring connected to operate the constituents for elevation from being exposed to improve an outer appearance thereof and safety.

In one embodiment, a refrigerator includes: a cabinet that defines a storage chamber; a drawer door that is positioned configured to be inserted into and withdrawn out of the storage chamber; a door part that defines a front surface of the drawer door, the door part being configured to open and close the storage chamber; a drawer part connected to the door part at a rear side of the door part so as to be inserted and withdrawn together with the door part, the drawer part being configured to accommodate foods; a driving device provided in the door part to elevate at least a portion of the drawer part; and a wiring guider configured to connect the cabinet to a rear surface of the door part, the wiring guider being disposed to pass through a lower side of the drawer part and configured to guide a cabinet-side wiring up to the door part.

In another embodiment, a refrigerator includes: a cabinet that defines a storage chamber; a drawer door that is positioned configured to be inserted into and withdrawn out of the storage chamber, the drawer door including a drawer part configured to provide a storage space and a door part configured to, based on the drawer door being inserted into and withdrawn out of the storage chamber, open and close the storage chamber, respectively; an elevation device provided at the drawer part and configured to elevate the storage space; a driving device provided at the door part and configured to provide a driving force to the elevation device; and a wiring guider provided between a top surface of the storage chamber and a bottom surface of the drawer door, the wiring guider being configured to guide a wiring that provides an electrical connection between the cabinet and the driving device, wherein the wiring guider includes: a rotation connection member configured to rotatably couple a first end of the wiring guide to the cabinet; a guide head configured to fixedly couple a second end of the wiring guide to the door part; and a flexible portion configured to connect the rotation connection member to the guide head, wherein the wiring between the cabinet and the driving device sequentially passes through the rotation connection member, the flexible portion, and the guide head.

A door light configured to emit light toward the inside of the drawer part may be provided on a rear surface of the door part, and the electric device may include the door light.

An elevation device that provides a surface configured to support foods and is connected to the driving device so as to be vertically elevated may be provided inside the drawer part, and the electric device may include a driving device configured to power to the elevation device.

An elevation detection device configured to detect positions of the elevation device when the elevation ascends and descends may be provided inside the door part, and the elevation detection device may be electrically connected to the wiring.

A connecting hole coupled to a front end of the wiring guider may be defined in a rear surface of the door, and the connecting hole may be disposed below a bottom surface of the drawer part.

A door-side electrically connector connected to the electric device may be provided inside the connecting hole, a guide-side connector connected to an end of the wiring may be provided at a front end of the wiring guider, and when the wiring guider and the connecting hole are coupled to each other, the door-side connector and the guide-side connector may be connected to each other.

The wiring guider may extend from the inside of the cabinet to the rear surface of the door via the lower side of the drawer part.

A wiring inlet hole through which the wiring is introduced may be defined in a bottom surface of the storage space, a mounting plate configured to cover the wiring inlet hole may be mounted on the bottom surface of the storage space, and the rotation connection member may be rotatably mounted on the mounting plate to communicate with the wiring inlet hole.

A connection member stepped part may be disposed on a circumference of an opened bottom surface of the wiring inlet hole, an opening through which the rotation connection member passes may be defined in the mounting plate, and a stepped part accommodation part configured to accommodate the connection member stepped part may be defined in a circumference of the opening.

The wiring inlet hole may include: a first opening having a size greater than that of the stepped part; and a second opening extending from the first opening in one direction, and a connection member restriction part protruding outward so as to be inserted through the second opening is disposed at one side of the connection member stepped part, wherein the connection member restriction part may be hooked to be restricted to the first opening.

A front surface of the guide head may be opened and have a shape corresponding to that of the connecting hole defined in a rear surface of the door part so that the guide head is inserted into the connecting hole.

A guide slot that is cut from a front end of the guide head may be defined in an outer surface of the guide head, and when the guide head is inserted into the connecting hole, a portion of the door part may be inserted into the guide slot so that the guide slot guides the coupling of the guide head.

A fixing protrusion protruding to contact an inner surface of the connecting hole so as to prevent the guide head from moving may be disposed on the guide head.

The flexible portion may be provided in plurality, which have the same structure and are connected to each other, between the rotation connection member and the guide head, and the plurality of flexible portions connected to each other may be rotatably connected to each other.

Surfaces of the flexible portions, which face each other, may be opened to provide a passage through which the wiring passes, and a front connection part may be provided at a front end of the opened flexible portion, and a rear connection part rotatably connected to the front connection part of the adjacent flexible portion may be disposed at a rear end of the opened flexible portion.

Connection parts may be disposed at opened sides of the rotation connection member and the guide head, respectively, and each of the connection parts may have the same structure as the front connection part or the rear connection part of the flexible portion so that the flexible portion is rotatably connected to the connection part.

A flexible portion fixing part may be disposed on a top surface of at least one or more flexible portions of the plurality of flexible portions, and a flexible portion coupling part coupled to the connecting portion fixing part may be disposed on a bottom surface of the drawer part, which faces the flexible portion fixing part. A cabinet opening may be defined in a bottom surface of the inside of the storage space, a draw-out motor, a pinion rotation shaft rotating by the draw-out motor, and a pair of pinions coupled to both ends of the pinion rotation shaft may be provided inside the cabinet opening, and a draw-out rack extending in a draw-out direction and coupled to the pinions to insert and withdraw the drawer door may be disposed on a bottom surface of the drawer door.

A cover plate configured to cover the cabinet opening may be provided inside the storage space, and the rotation connection member may be rotatably mounted on the cover plate.

The refrigerator may further include a bottom cover configured to cover the cabinet opening from a lower side and provide a space configured to accommodate the draw-out motor, the pinion rotation shaft, and the pair of pinions.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present invention will be described in detail with reference to the accompanying drawings. However, the scope of the present disclosure is not limited to proposed embodiments of the present invention, and other regressive inventions or other embodiments included in the scope of the spirits of the present disclosure may be easily proposed through addition, change, deletion, and the like of other elements.

Figure 1:
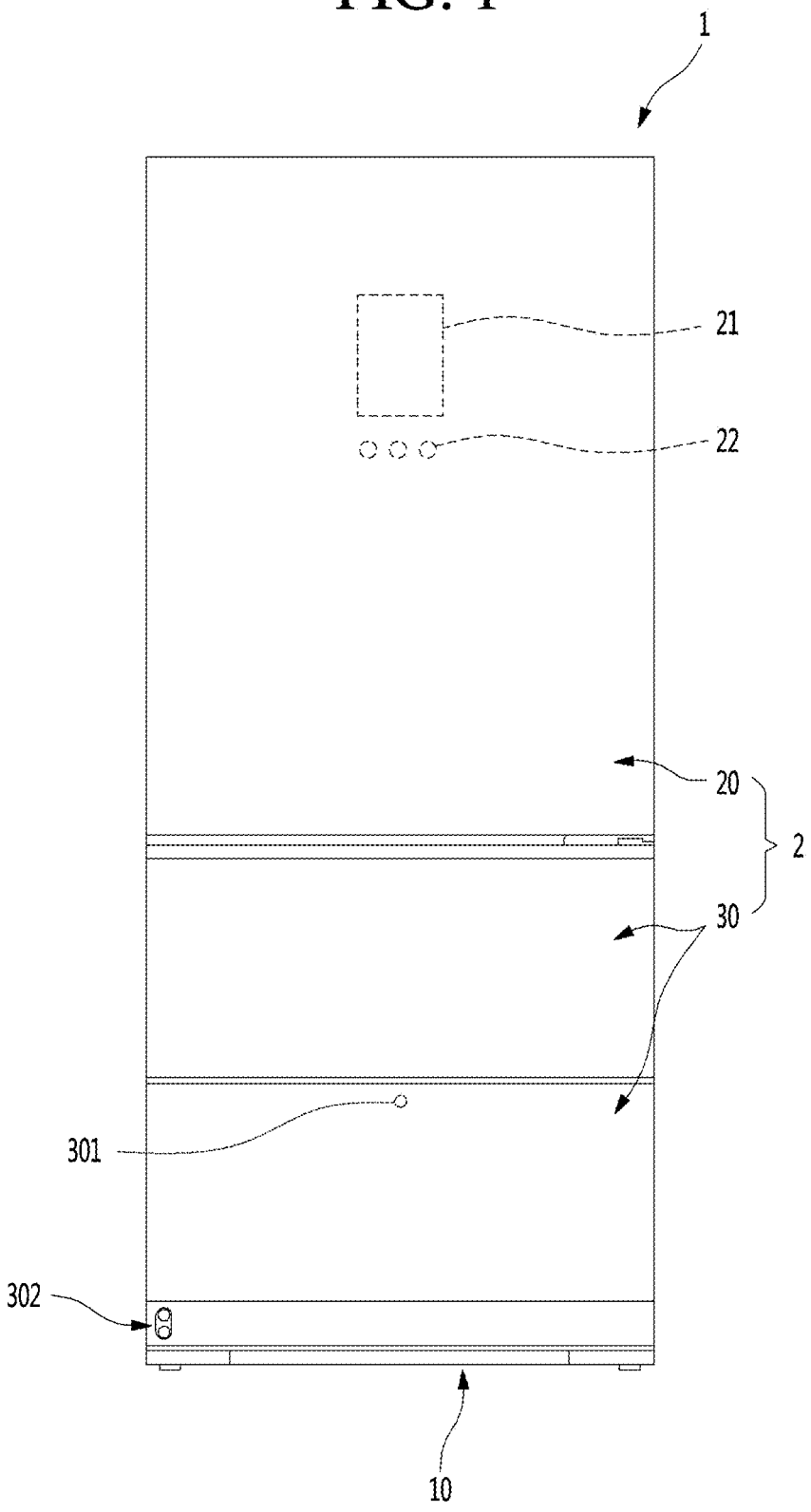
FIG. 1 is a front view of a refrigerator according to an embodiment.
Figure 2:
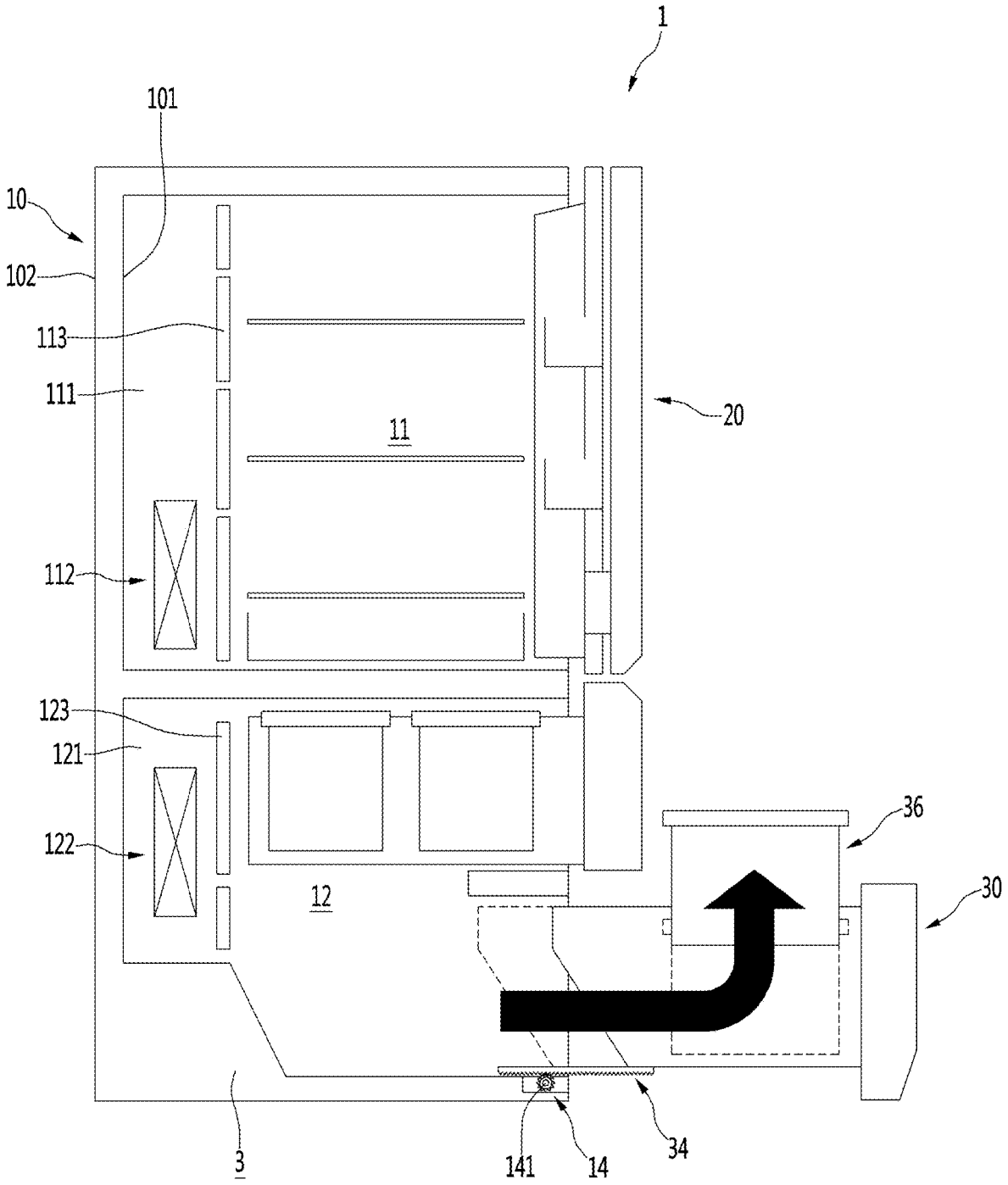
FIG. 2 is a schematic view illustrating a state in which a drawer door of the refrigerator is elevated.

FIG. 1 is a front view of a refrigerator according to an embodiment. Also, FIG. 2 is a schematic view illustrating a state in which a drawer door of the refrigerator is elevated.

As illustrated in the drawing, the refrigerator 1 may have an outer appearance that is defined by a cabinet 10 defining a storage chamber and a door 2 covering an opened front surface of the cabinet 10.

The storage chamber of the cabinet 10 may be divided into a plurality of spaces. For example, an upper storage chamber 11 of the cabinet 10 may be provided as a refrigerating compartment, and a lower storage chamber 12 may be provided as a freezing compartment. Alternatively, the upper storage chamber 11 and the lower storage chamber 12 may be provided as independent spaces that are maintained at temperatures different from each other, but are not the refrigerating compartment or the freezing compartment. Also, the lower storage chamber 12 may be divided into a plurality of spaces. As illustrated in the drawings, one space may be opened and closed by a plurality of doors 20 and 30.

Heat exchange spaces 111 and 121 that are partitioned by grill pan assemblies 113 and 123 may be defined behind the upper storage chamber 11 and the lower storage chamber 12, and an upper evaporator unit 112 and a lower evaporator unit 122 may be respectively disposed in the heat exchange spaces 111 and 121. A fan may be further provided in the heat exchange spaces 111 and 121. Thus, cool air may be supplied to the upper storage chamber 11 and the lower storage chamber 12 by driving of the fan.

The cool air generated in the evaporator units 112 and 122 may be supplied to the upper storage chamber 11 and the lower storage chamber 12 through outlets of the grill pan assemblies 113 and 123 by the operation of the fan and also be collected into inlets of the grill pan assemblies 113 and 123 to circulate.

Alternatively, only one evaporator unit 112 or 122 unit may be provided. Thus, the cool air discharged from one evaporator unit may be branched to be supplied into the upper storage chamber 11 or the lower storage chamber 12.

The present embodiment may relate to a structure for cooling the lower storage chamber 12. Hereinafter, the lower storage chamber 12 may be called a storage chamber, and the lower evaporator unit 122 may be called an evaporator unit.

The door 2 may be constituted by a rotation door 20 opening and closing the upper space through rotation thereof and a drawer door 30 opening and closing the lower space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type. Also, the rotation door 20 may be provided at an upper portion and thus called an upper door, and the drawer door 30 may be provided at a lower portion and thus called a lower door.

A display 21 may be disposed on one side of a front surface of the rotation door 20. Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of the user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

The lower drawer door 30 may be automatically inserted and withdrawn according to the manipulation of the manipulation part 301. Also, a food or container within the lower drawer door 30 may be elevated in a state in which the drawer door 30 is withdrawn by the manipulation of the manipulation part 301.

The lower drawer door 30 may be a storage chamber defined in a lower side of the refrigerator 1 and may withdraw the lower drawer door 30 forward to accommodate a food stored in the lower drawer door 30, and then, the container 36 inside the drawer door 30 may be manipulated to be elevated.

The container 36 may have a predetermined height. Since the container 36 is seated on the elevation device 80, the height of the container 36 may increase by the height of the elevation device 80 when the elevation device 80 is elevated. Thus, when the elevation device 80 ascends, the container 36 may be disposed at a point at which the user is easily accessed to the container 36 and also easily lift the container 36.

Thus, the container 326 may be completely accommodated in the accommodation part 32 when the drawer door 30 is inserted and withdrawn. When the elevation device ascends, the container 36 may be disposed at a higher position than the lower storage chamber 12.

Although the shape of the container 36 is not limited, the container 36 may have a shape corresponding to the size of the front space S1 and may have a predetermined height to prevent the stored food from being separated when the elevation device 80 ascends.

The food or container 36 inside the lower drawer door 30 disposed at the lowest position may be more easily lifted and used through the above-described manipulation.

The lower drawer door 30 may be automatically inserted and withdrawn forward and backward by the draw-out motor 14, the pinion 141 provided in the cabinet 10, and the draw-out rack 34 provided on the bottom surface of the lower drawer door 30.

Also, the container inside the lower drawer door 30 may be elevated by the driving device 40 and the elevation device 80 provided in the lower drawer door 30.

Hereinafter, the lower drawer door 30 and an operation of the lower drawer door 30 will be described in more detail, and also, the lower drawer door 30 will be called a drawer door or a door unless otherwise specified.

The embodiments are not limited to the number and shape of the drawer doors and may be applied to all refrigerators having a door that is inserted and withdrawn in a drawer type into/from the lower storage chamber.

Figure 3:
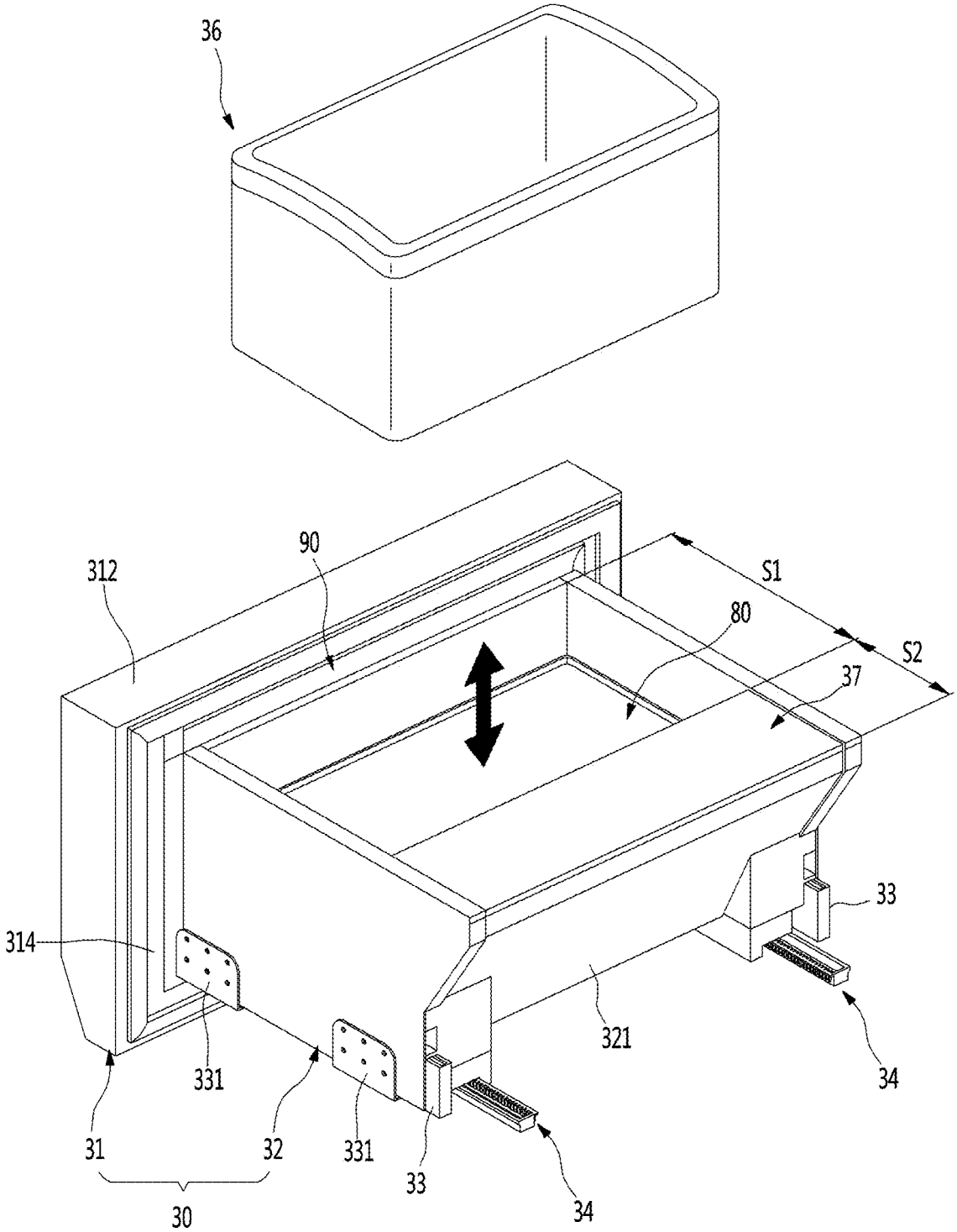
FIG. 3 is a perspective view illustrating a state in which the container of the drawer door is separated.
Figure 4:
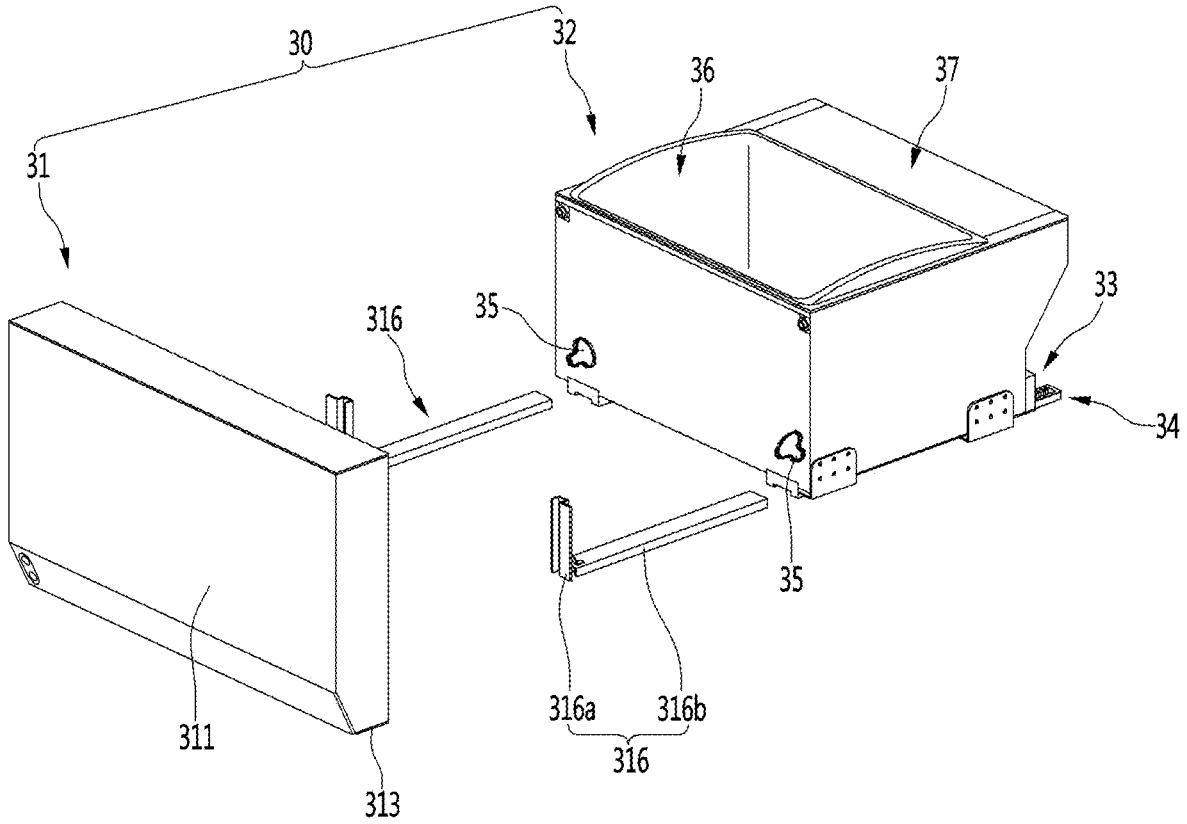
FIG. 4 is an exploded perspective view illustrating a state in which a drawer part of a drawer door and a door part are separated from each other when viewed from a front side.

FIG. 3 is a perspective view illustrating a state in which the container of the drawer door is separated. Also, FIG. 4 is an exploded perspective view illustrating a state in which the drawer part of the drawer door and the door part are separated from each other when viewed from a front side.

As illustrated in the drawings, the drawer door 30 may include a door part 31 opening and closing the storage space and a drawer part 32 coupled to a rear surface of the door part 31 and inserted and withdrawn together with the door part 31.

The door part 31 may be exposed to the outside of the cabinet 10 to define an outer appearance of the refrigerator 1, and the drawer part 32 may be disposed inside the cabinet 10 to define a storage space. Also, the door part 31 and the drawer part 32 may be coupled to each other and inserted and withdrawn forward and backward together with each other.

The drawer part 32 may be disposed on the rear surface of the door part 31 to define a space in which the food or container to be stored is accommodated. The inside of the drawer part 32 may provide an upwardly opened storage chamber, and an outer appearance of the drawer part 32 may be defined by a plurality of plates (see reference numerals 391, 392, and 395 in FIG. 20). Each of the plurality of plates 391, 392, and 395 may be made of a metal material and provided inside and outside the drawer part 32 so that the entire drawer part 32 is made of stainless steel or a material having a texture such as stainless steel.

In the state in which the drawer door 30 is inserted, a machine room 3 in which a compressor and a condenser constituting a refrigeration cycle are provided may be disposed behind the drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the drawer door 30 may be provided on each of both side surfaces of the drawer part 32. The drawer door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

A rail bracket 331 may be provided in the draw-out rail 33, and the rail bracket 331 may extend from one side of the draw-out rail 33 to both sides of the drawer part 32. Also, the rail bracket 331 may be fixedly coupled to a sidewall surface inside the refrigerator. Thus, the drawer part 32, that is, the drawer door 30, may be mounted to the cabinet 10 by the draw-out rails 33.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided at a lower ends of each of both sides of the drawer part 32 and may be called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the drawer door 30. That is, when an operation is inputted into the manipulation parts 22 and 301, the draw-out motor 14 may be driven to insert and withdraw the drawer door 30 according to movement of the draw-out rack 34. Here, the drawer door 30 may be stably inserted and withdrawn by the draw-out rail 33.

The draw-out rack 34 may not be provided on the drawer part 32. Here, the user may hold a side of the door part 31 to push and pull the door part 31 so that the drawer door 30 is directly inserted and withdrawn.

The inside of the drawer part 32 may be divided into a front space S1 and a rear space S2. The elevation device 80 that is vertically elevated and a container seated on the elevation device 80 to be elevated together with the elevation device 80 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the drawer door 30 is withdrawn, the entire drawer part 32 may not be withdrawn to the outside of the storage space due to a limitation in draw-out distance of the drawer door 30. That is, at least the front space S1 is withdrawn to the outside of the storage space, and the whole or a portion of the rear space S2 is disposed inside the storage space within the cabinet 10.

In such a structure, a draw-out distance of the drawer door 30 may be limited by the draw-out rack 34 or the draw-out rail 33. As the draw-out distance becomes longer, the moment applied to the drawer door 30 may become larger in the draw-out state, and thus it is difficult to maintain a stable state, and the deformation or damage of the draw-out rail 33 or the draw-out rack 34 may occur.

The elevation device 80 and the container 36 may be accommodated in the front space S1. While the elevation device is elevated, the food or container 36 seated on the elevation device 80 may be elevated together. Also, the elevation device 80 may be provided below the container 36, and the elevation device 80 may be covered by the container 36 when the container 36 is mounted. Thus, any constituent of the elevation device 80 will not be exposed to the outside.

A separate drawer cover 37 may be provided in the rear space S2. The front space S1 and the rear space S2 may be partitioned by the drawer cover 37. In a state in which the drawer cover 37 is mounted, a space in which front and top surfaces of the rear space S2 are covered and not be used may be not be exposed to the outside.

However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

Also, the elevation device 80 inside the drawer part 32 may be simply separated and mounted to utilize the entire space inside the drawer part 32, and the elevation device 80 and the drawer cover 37 may be separated from each other to utilize the entire space of the drawer part 32.

The outer appearance of each of the inner and outer surfaces of the drawer part 32 may be defined by the separate plates 391, 392 and 395, which cover the components mounted on the drawer part 32, and thus, the outer and inner appearances may be seen to be neat. The plates 391, 392, and 395 may be constituted by a plurality of plates and may be made of stainless steel to provide a more luxurious and clean appearance.

As illustrated in the drawings, the door part 31 and the drawer part 32 constituting the drawer door 30 may be coupled to be separated from each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the elevation device 80 may be provided. The driving device 40 for elevating the elevation device 80 may be disposed on the door part 31, and the door part 31 and the drawer part 32 may be selectively connected to each other. Thus, the elevation device 40 may be called an elevation driving device.

Particularly, the driving part 40 provided in the door part 31 may be configured to receive power from the power source and to transmit the power to the elevation part 80. Thus, it is possible to remove the door part 31 when the service of the driving part 40 is necessary and to take measures simply by replacing only the door part 31.

The door part 31 and the drawer part 32 may be coupled by a pair of door frames 316 provided on both sides. The door frame 316 includes a door coupling part **316*a* extending upward and downward to be coupled to the door part 31 and a drawer coupling part 316*b* extending backward from a lower end of the door coupling portion 316*a*. The door coupling part 316*a* may be coupled to the door part 31 by a separate coupling member and may be coupled to one side of the door part 31 by a simple coupling structure. Also, the drawer coupling part 31*b* may be mounted on each of both sides of the drawer part 32 and be inserted and mounted in a state of being coupled to the draw-out rail 33. The drawer coupling part 316*b* and the draw-out rail 33 may be covered by the plate 391 mounted on the drawer part 32** and thus may not be exposed to the outside.

Also, a connecting assembly 70 may be provided on the rear surface of the drawer door 30 so that the driving part 40 and the elevation are 80 are connected to each other when the door part 31 and the drawer part 32 are coupled. A drawer opening 35 through which a part of the elevation device 80 is exposed may be defined in a position corresponding to the connecting assembly 70 on the front surface of the drawer part 32.

The door part 31 may be configured to substantially open and close the storage chamber of the cabinet 10 and to define the front surface of the refrigerator 1.

The door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, an insulation material 300 may be filled in the inside of the door part 31 between an outer case 311 and a door liner 314.

Hereinafter, a structure of the door part 31 constituting the drawer door 30 will be described in more detail.

Figure 5:
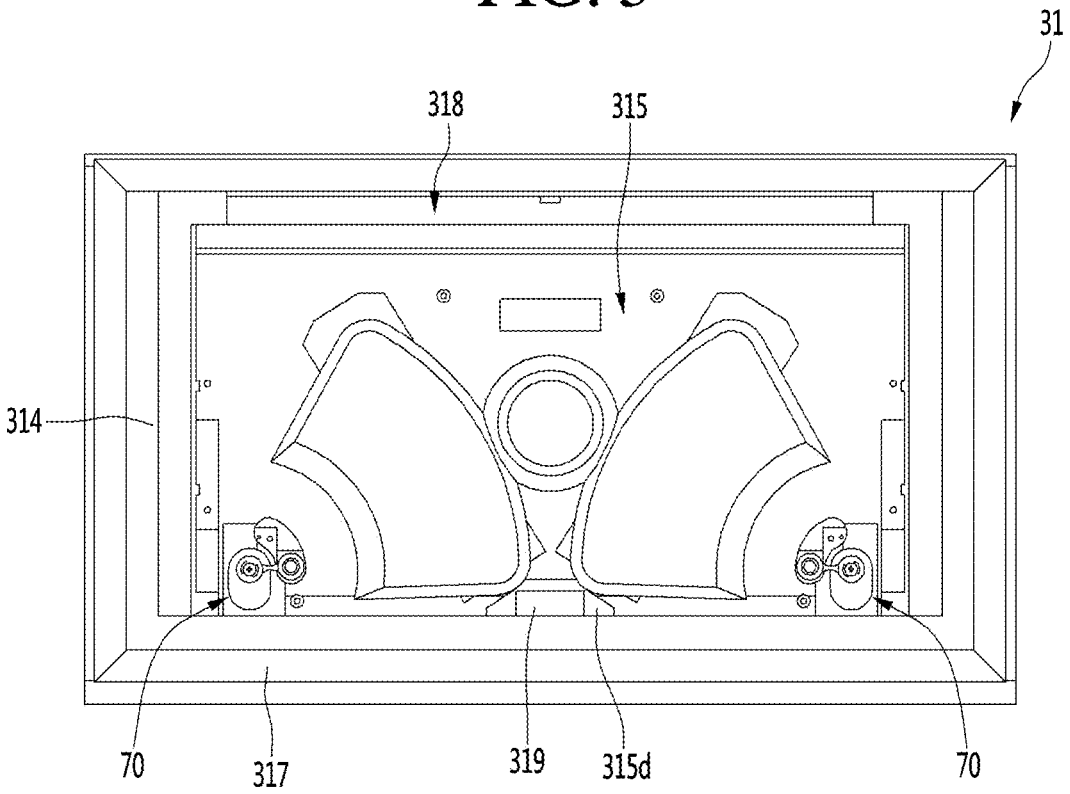
FIG. 5 is a view illustrating a rear surface of the door part.
Figure 6:
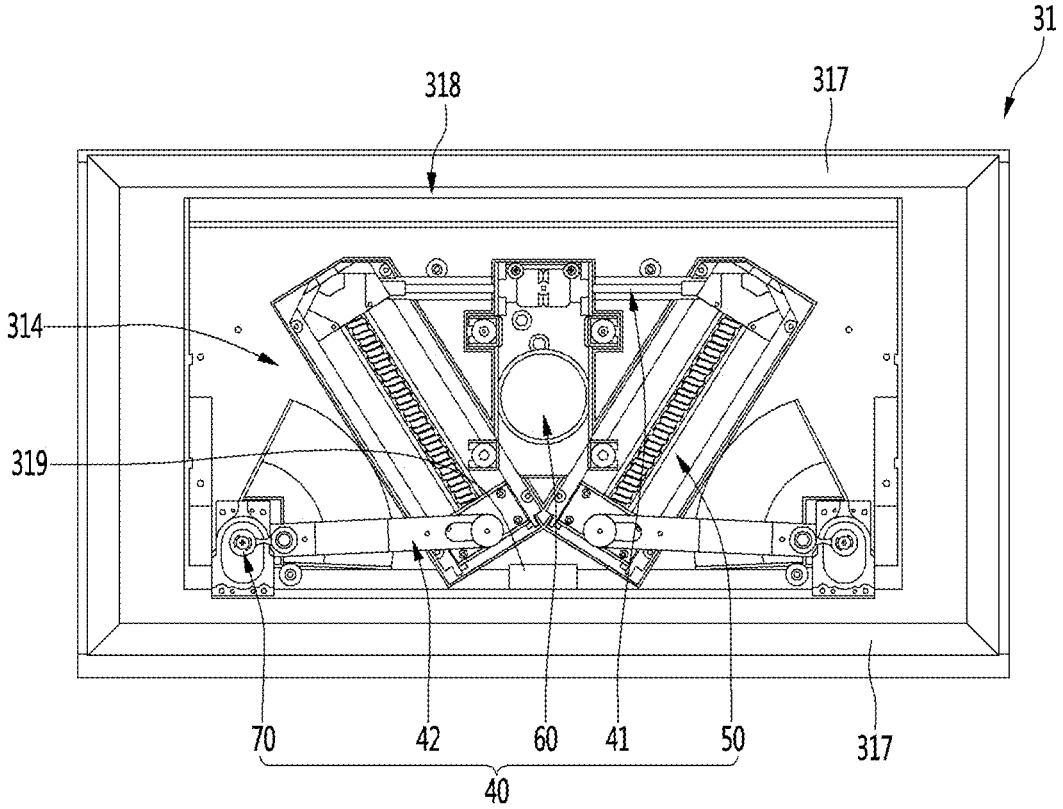
FIG. 6 is a rear view illustrating a state in which a door cover of the door part is removed.
Figure 7:
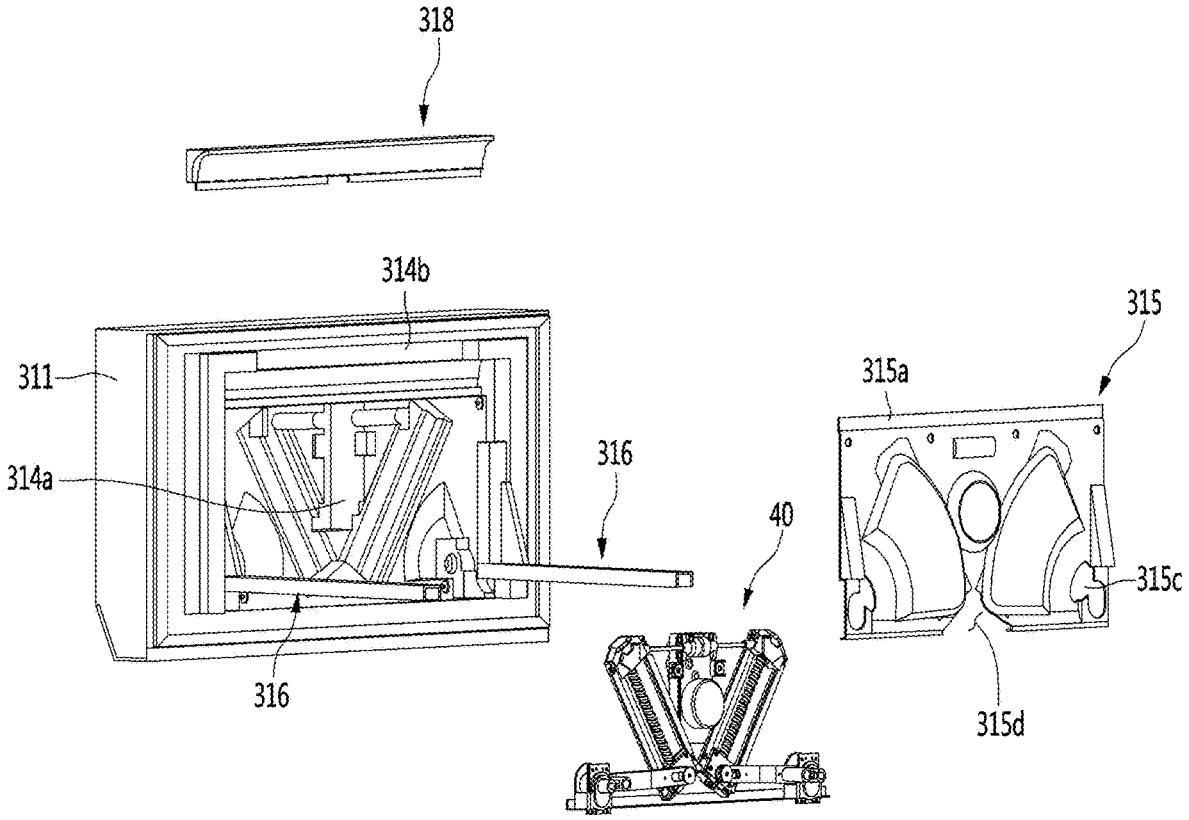
FIG. 7 is an exploded perspective view of the door part.

FIG. 5 is a view illustrating a rear surface of the door part. Also, FIG. 6 is a rear view illustrating a state in which a door cover of the door part is removed. Also, FIG. 7 is an exploded perspective view of the door part.

As illustrated in the drawings, a front surface of the door part 31 may be defined by the outer plate 311, and a rear surface may be defined by the door liner 314. Also, a driving device 40 for operating the elevation device 80 may be provided inside the door part 31. Although the driving device 40 may be disposed inside the door part 31, the driving device 40 but is not embedded in the insulation material 300 but is disposed inside a recessed space of the door liner 314. Then, the driving device 40 may be covered by the door cover 315 and thus may not be exposed to the outside.

In detail, the insulating material 300 may be filled between the outer plate 311 and the door liner 314 to insulate the inside of the storage chamber 12. Also, the door liner 314 may have a door recess part 314*a* that is recessed inward. The door recess part 314*a* may have a shape corresponding to that of the driving device 40. Thus, the door recess part 314 may have a shape corresponding to that of each of the constituents of the elevation device 80 so that the entire driving device 40 is inserted into the internal space of the drawer door 30.

Also, a lighting recess part 314*b* may be disposed in the upper portion of the rear surface of the door part 31, i.e., the upper portion of the door liner 314. The lighting unit 318 may be mounted in the lighting recess part 314*b*. The lighting unit 318 may be disposed above an opened top surface of the drawer part 32 to emit light to the inside of the drawer part 32 at the front side of the drawer part 32, thereby illuminating the inside of the drawer part 32.

In detail, the lighting unit 318 may be defined to be long in the lateral direction from the left side to the right side of the rear surface of the drawer door 30 and may be disposed at the uppermost position of the inner side regions of a gaskets 317 disposed along the rear surface of the drawer door 30.

The driving device 40 may be mounted in the door recess part 314*a* disposed below the lighting unit. The driving device 40 may be covered by the door cover 315 in the state of being mounted in the door recess part 314*a*. Alternatively, the door cover 315 may be omitted. When the door cover 315 is omitted, the front surface of the drawer part 32 may cover the driving device 40.

The driving device 40 may be connected to the elevation device 80 provided in the drawer part 32 by the connecting assembly 70. Thus, power of the driving device 40 may be transmitted to the elevation device through the connecting assembly 70. Here, power having the same intensity may be transmitted to both sides of the elevation device 80 through the connecting assemblies 70 disposed on both sides at the same time. Thus, the elevation device 80 may ascend and descend in the horizontal state at both left and right sides without being tilted or biased to one side under any situation.

The door cover 315 defining a portion of an outer appearance of the rear surface of the door part 31 may be mounted on the rear surface of the door part 31. The door cover 315 may cover the driving device 40 mounted on the door part 31. The door cover 315 may have a plate shape to cover the driving device 40 so that the door cover 315 is not exposed in the driving device 40 is mounted. Here, the door cover 315 may have a shape that protrudes or is recessed at a position corresponding to the driving device 40.

Also, the door cover 315 may be spaced apart from at least a portion of the door liner 314 in the state of being mounted on the rear surface of the door part 31. Thus, the cool air may be supplied therein to cool the driving device.

Also, an upper end 315*a* of the door cover 315 may contact the door liner 314 to cover a portion of the lighting unit 318. Here, a portion of an upper portion of the lighting unit 318 may be exposed. Thus, a space in which light is emitted into the drawer part 32 may be secured.

Also, the upper end 315*a* of the door cover 315 may contact the lighting unit 318. Thus, when the cool air of the lower storage chamber 12 flows to the lighting unit 318, the cool air may flow along the door cover 315 via the lighting unit 318.

The door opening 315*c* may be defined in each of both left and right sides of the lower portion of the door cover 315. The door opening 315*c* may be defined so that a portion of the connecting assembly 70 passes through the door opening 315*c* to protrude from the rear surface of the door part 31. Also, the door opening 315*c* may have a corresponding shape at a position facing the drawer opening 35. Thus, a portion of the connecting assembly 70 exposed through the door opening 315*c* when the door part 31 and the drawer part 32 are coupled may be coupled to the elevation device 80 to transmit the power.

Also, a push part 741 of the connecting assembly 70 may be exposed through the door opening 315*c*. The user may manipulate the push part 741 exposed to the rear surface of the door part 31 to selectively couple or separate the driving device 40 to/from the elevation device 80.

A door gasket 317 may be provided along the rear surface of the door part 31. When the drawer door 30 is closed, the door gasket 317 may airtightly contact the front surface of the cabinet 10 in the state in which the drawer door 30 is closed.

Figure 8:
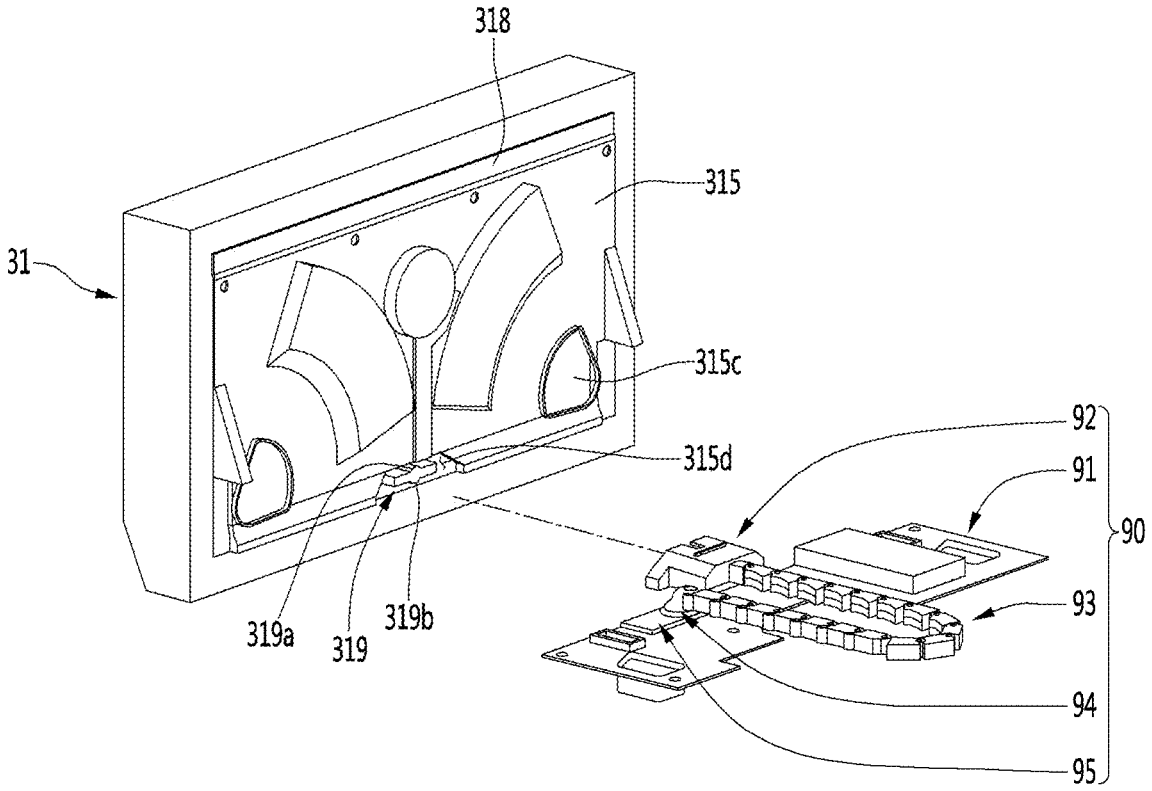
FIG. 8 is an exploded perspective view illustrating a coupling structure between the door part and the wiring guider.

FIG. 8 is an exploded perspective view illustrating a coupling structure between the door part and the wiring guider.

As illustrated in the drawings, the rear surface of the door part 31 may be defined by the door cover 315. Also, a connecting hole 315*d* may be defined in a lower end of the door cover 315. The connecting hole 315*d* may be a portion to which a front end of the wiring guider 90, which will be described below, is connected and may be configured so that a lower end of the door cover 315 is opened.

Also, a door-side connector 319 may be provided inside the connecting hole 315*d*. The door-side connector 319 may be connected to wirings connected to the electronic components provided inside the door part 31. The electronic components connected to the door-side connector 319 may include the driving device 40, the door light 318, an elevation detection device 16 for detecting the elevation of the elevation device 80, a sensor, and the like. Also, the electronic components may further include other constituents provided inside the door part 31 and requiring power connection.

The door-side connector 319 may be connected to the guide-side connector 961 disposed inside the wiring guider 90 when the front end of the wiring guider 90 is inserted into and mounted in the connecting hole 315*d*. Thus, the wiring guider 90 may be electrically connected to the electronic components provided inside the door part 31 by only mounting the wiring guider 90 on the rear surface of the door part 31 without separate wiring connection.

Here, the connecting hole 315*d* may have a shape corresponding to that of the front end of the wiring guider 90. Thus, the wiring guider 90 may be coupled always in a correct direction.

The wiring guider 90 may be fixed and mounted inside the cabinet 10 and be connected to the door part 31. Also, the wiring guider 90 may generally include a cover plate 91, a guide head 92, a plurality of flexible portions 93, a rotation connection member 94, and a mounting plate 95.

Figure 9:
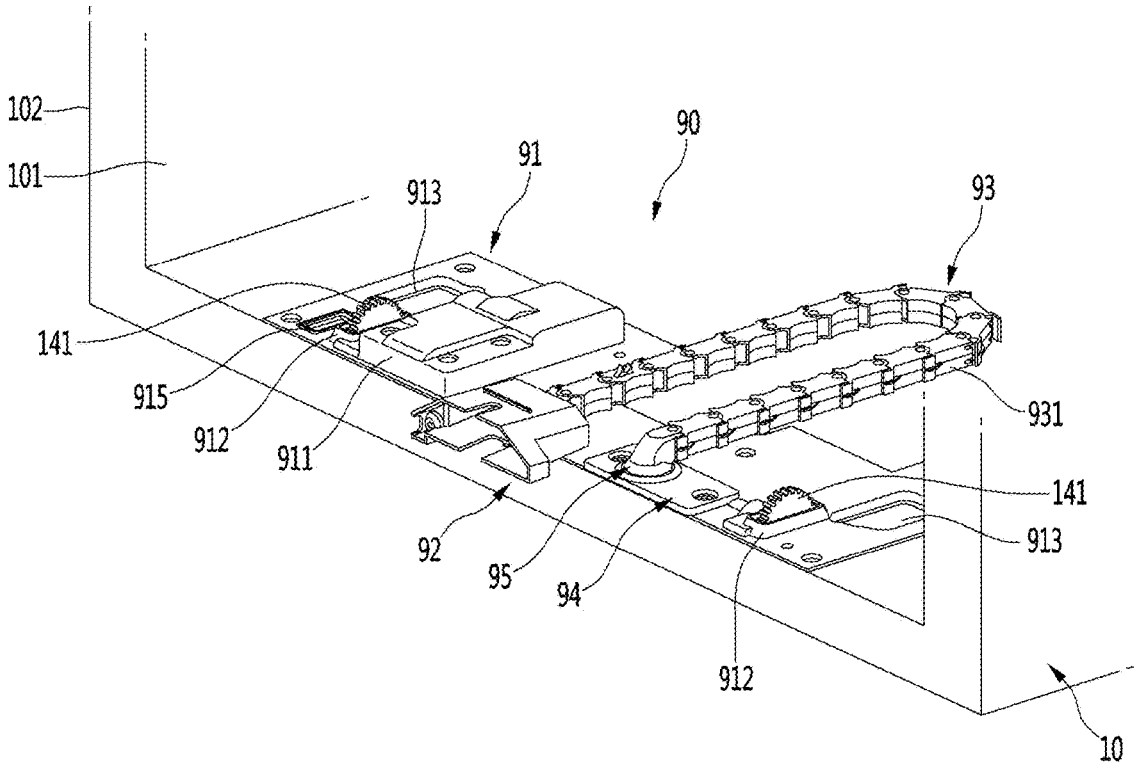
FIG. 9 is a view illustrating a state in which the wiring guider is mounted on a cabinet of the refrigerator.
Figure 10:
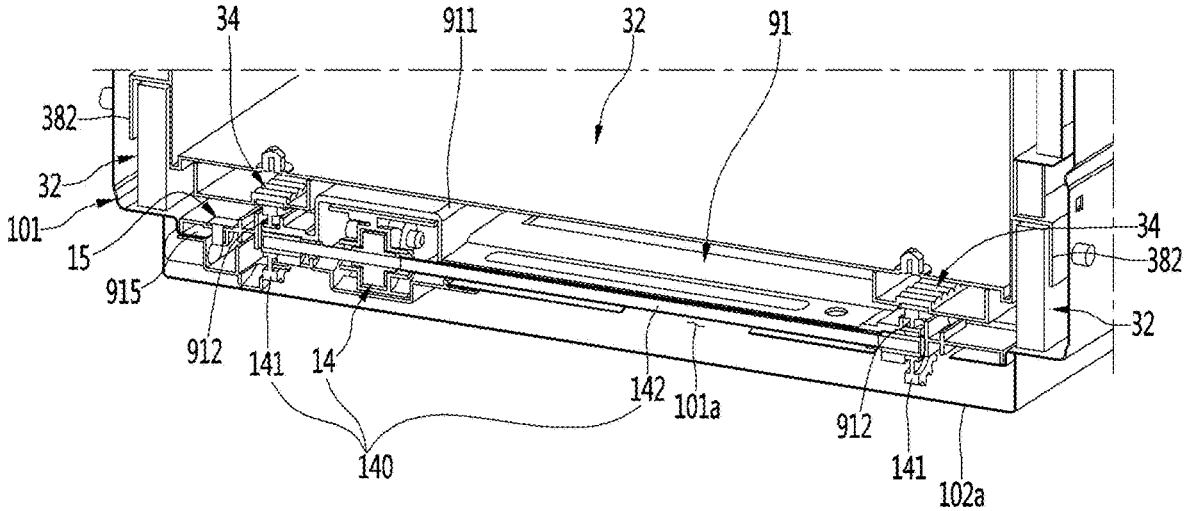
FIG. 10 is a cross-sectional view illustrating an arrangement of a draw-out driving device for inserting and withdrawing the door part.

FIG. 9 is a view illustrating a state in which the wiring guider is mounted on the cabinet of the refrigerator. Also, FIG. 10 is a cross-sectional view illustrating an arrangement of the draw-out driving device for inserting and withdrawing the door part.

The wiring guider 90 may be disposed on a front end of bottom surface of the lower storage chamber 12. Also, the wiring guider 90 may be connected to the rear surface of the door part 31 and be inserted and withdrawn together with the drawer door 30 when the drawer door 30 is inserted and withdrawn. Also, a wiring 962 may be disposed inside the wiring guider 90. The wiring 962 may be guided up to the door part 31 along the wiring guider 90.

Hereinafter, constituents of each of the cover plate 91, the guide head 92, the flexible portions 93, the rotation connection member 94, and the mounting plate 95, which constitute the wiring guider 90, will be described in more detail.

Here, the cover plate 91 may be one component of a draw-out driving device 140 that will be described below. The draw-out driving deice 140 and the wiring guider 90 may be provided as one assembly.

That is, the draw-out driving device 140 may be provided in the wiring guider 90 including the cover plate 91. Alternatively, the wiring guider 90 may be mounted on the draw-out driving device 140 including the cover plate 91.

In addition, the wiring guider 90 and the draw-out driving device 140 may be understood as a concept of one assembly including a plurality of components mounted on the base cover 102*a* and the cover plate 91.

The cover plate 91 may be disposed on the bottom surface of the lower storage chamber 12. That is, a cabinet opening 101*a* into which the draw-out driving device 140 is mounted may be defined in an inner case 101 defining the lower storage chamber 12, and the cover plate 91 may cover the cabinet opening 101*a*.

The draw-out driving device 140 may be mounted inside the cabinet 10 in the form of a module and covered by the cover plate 91. As necessary, the cabinet opening 101*a* may be opened to pass through a bottom surface of the cabinet 10. Also, the cover plate 91 may be disposed inside the lower storage chamber 12 corresponding to the cabinet opening 101*a*. The separate base cover 102*a* may be provided outside the outer case 102 so that the draw-out driving device 140 is disposed in an inner space of the cabinet opening 101*a*.

The cover plate 91 may have a plate shape that covers the cabinet opening 101*a* on a whole. The cover plate 91 may be injection-molded by using a plastic material so that the draw-out driving device 140 is accommodated. Also, the cover plate 91 may have a plurality of protruding or recessed portions so that a plurality of constitutes in addition to the draw-out driving device 140 are disposed.

In detail, a motor accommodation part 911 in which the draw-out motor 14 is disposed may be defined in one side of the cover plate 91. The motor accommodation part 911 may protrude upward and have a shape corresponding to that of the draw-out motor 14 to provide a space in which the draw-out motor 14 is accommodated therein.

Also, a pinion opening 912 through which a pinion 141 rotating by the draw-out motor 14 may be defined in each of both left and right sides of the cover plate 91. A portion of the pinion 141 may be exposed to the lower storage chamber 12 through the pinion opening 912.

Also, although not shown in detail, a rack restriction device 913*a* for selectively restricting a draw-out rack 34 disposed on each of both side surfaces of the bottom surface of the drawer part 32 may be mounted at a rear side of the pinion opening 912. The rack restriction device 913*a* selectively restrict a portion of the draw-out rack so that the draw-out racks 34 arranged in two stages are sequentially inserted and withdrawn.

A restriction device mounting part 913 on which the rack restriction device 913*a* is mounted may be recessed at a rear side of the pinion opening 912. The rack restriction device 913*a* may be defined in a position corresponding to a lower side of the draw-out rack 34 and protrude upward to be coupled to a portion of the draw-out rack 34.

A detection device mounting part 915 on which the draw-out detection device 15 is mounted may be disposed at one side of both left and right sides of the pinion opening 912. The detection device mounting part 915 may be configured to detect the inserted and withdrawn state of the drawer part 32 and be disposed at one side of the cover plate 91 corresponding to the bottom surface of the drawer part 32.

The draw-out detection device 15 may be provided as a hall sensor detecting a magnet. The draw-out detection device 15 may detect magnets 389 disposed at front and rear portions of the bottom surface of the drawer part 32 to determine whether the drawer door 30 is inserted or withdrawn. Alternatively, the draw-out detection device 15 may be provided as a detection sensor or a switching structure, which is different from the hall sensor. For example, the draw-out detection device 15 may be provided as various electric devices that are capable of detecting the position of the drawer part 32.

The detection device mounting part 915 may have a groove shape that is opened or recessed. At least a portion of the draw-out detection device 15 may be exposed upward to detect an operation of the drawer part 32.

A rotation shaft guide 916 may be disposed between the pinion openings 912. The rotation shaft guide 916 may protrude downward to guide the pinion rotation shaft 142 connecting the motor accommodation part 911 to the pinion 141.

The pinion rotation shaft 142 may pass through the draw-out motor 14 or be connected to a rotation shaft of the draw-out motor 14. The pinion rotation shaft 142 may be respectively connected to central portions of the pinions disposed at both sides thereof. Thus, both the pinions 141 may rotate together with each other by the rotation of the draw-out motor 14. In the state of being coupled to the draw-out rack 34, both sides of the drawer 32 may move forward and backward at the same time.

Figure 12:
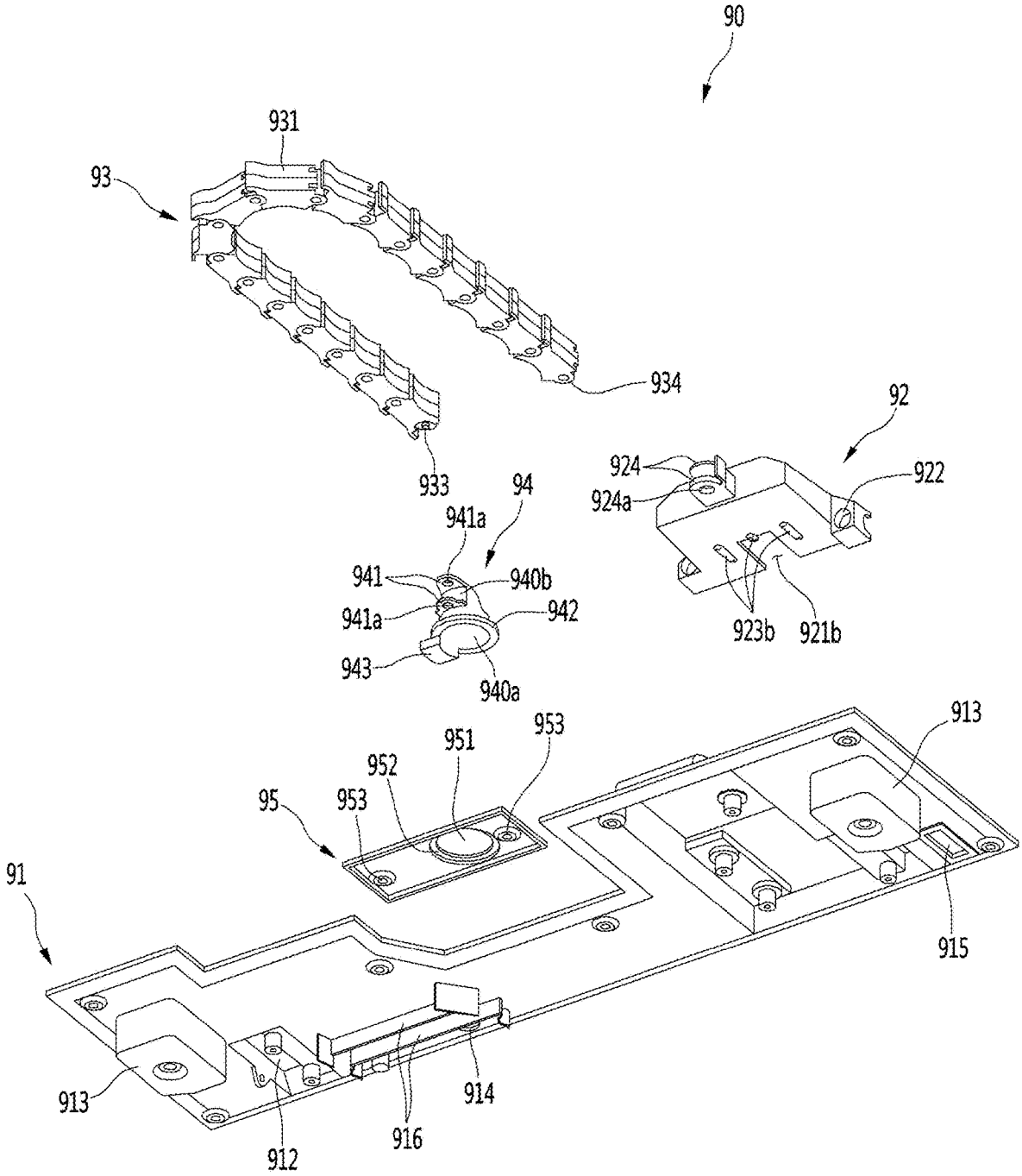
FIG. 12 is an exploded perspective view of the wiring guider when viewed from a lower side.

As illustrated in FIG. 12, the pair of rotation shaft guides 916 may horizontally extend to be spaced apart from each other. Also, the pinion rotation shaft 142 may be disposed to pass between the pair of rotation shaft guides 916. That is, each of the rotation shaft guides 916 may extend downward from the front and rear direction of the pinion rotation shaft 142 to prevent the pinion rotation shaft 142 from moving or being separated from a fixed position. Also, a rotation connection member 94 that will be described below may partition a space so as not to interfere with the pinion 141.

A mounting plate 95 may be mounted on one side of the cover plate 91. The rotation connection member 94 may be rotatably mounted on the mounting plate 95. The mounting plate 95 may be disposed at a position that is leaned from a center of the cover plate 91 to one side of the cover plate 91.

Thus, the guide head 92 may be disposed at a center of the rear surface of the door part 31. The mounting plate 95 and the rotation connection member 94 may be disposed at a side of the guide head 92, and the guide head 92 and the rotation connection member 94 may be connected to each other by the flexible portion 93.

A structure that is capable of accommodating the draw-out driving device 140 by the cabinet opening 101*a*, the base cover 102*a*, and the cover plate 91 may be provided in the bottom surface of the cabinet 10. That is, the draw-out motor 14, the pinion rotation shaft 142, and the pinion 141 may be disposed inside a space defined by the cover plate 91 and the base cover 102*a* and be accommodated in an accommodation space between an outer surface and an inner surface of the cabinet 10. As described above, the draw-out driving device 140 may be disposed on an inner area of the bottom surface of the cabinet to minimize a volume loss of the lower storage chamber 12.

Also, an electric device in addition to the draw-out detection device 15 may be further disposed inside the accommodation space. Also, a wiring 962 supplying power to the drawer door 30 may also be disposed in the accommodation space. The wiring 962 may be guided to the drawer door 30 through the wiring guider 90.

Hereinafter, the constituents of the wiring guider 90 will now be described in more detail with reference to the accompanying drawings.

Figure 11:
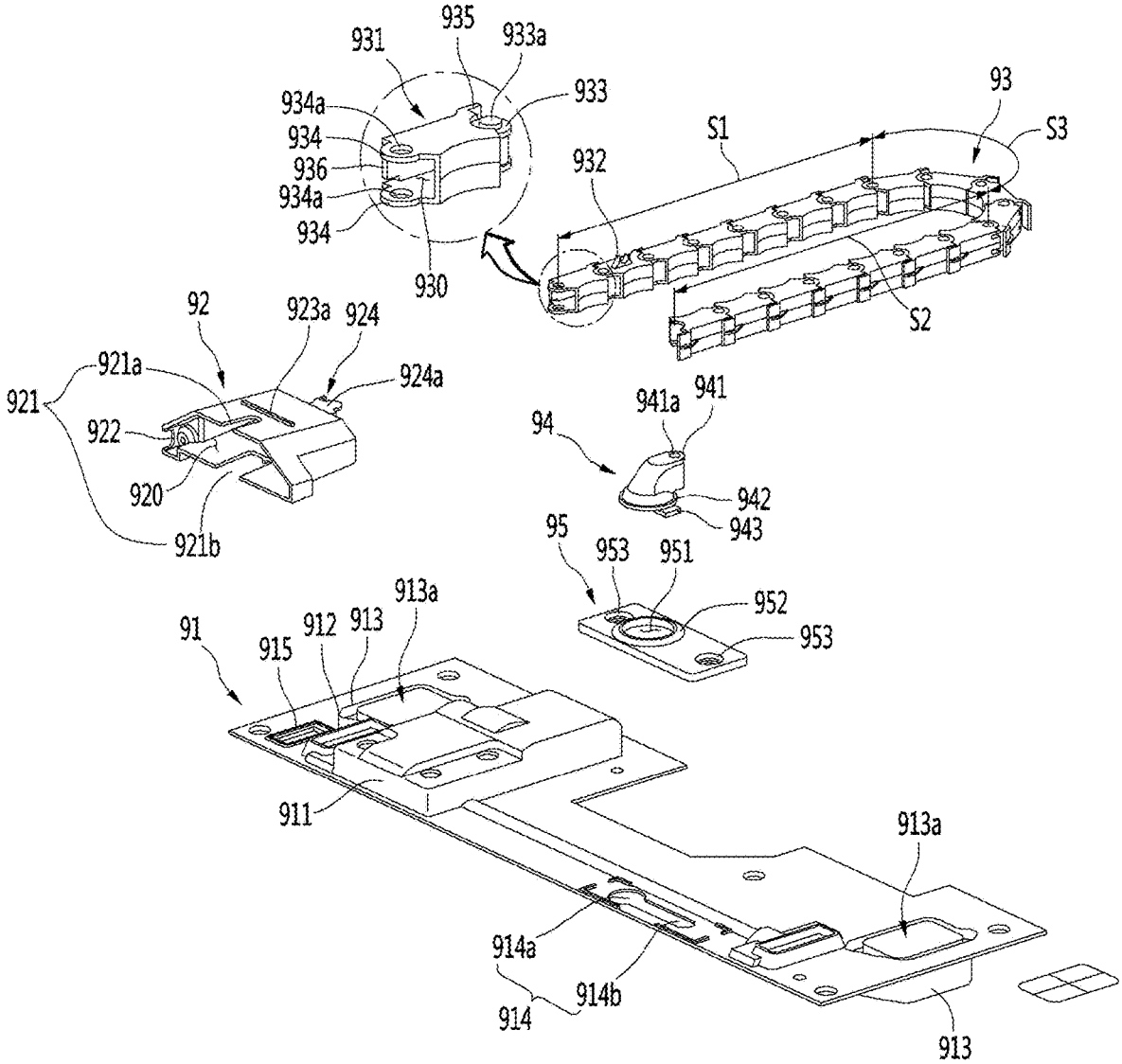
FIG. 11 is an exploded perspective view of the wiring guider when viewed from an upper side.

FIG. 11 is an exploded perspective view of the wiring guider when viewed from an upper side. Also, FIG. 12 is an exploded perspective view of the wiring guider when viewed from a lower side.

As illustrated in the drawings, the wiring guider 90 includes a cover plate 91, a mounting plate 95 fixed to the cover plate 91, a rotation connection member rotatably mounted on the mounting plate 95, a guide head 92 fixed to the rear surface of the door part 31, and a plurality of flexible portions 93 connecting the rotation connection member 94 to the guide head 92.

In more detail, the mounting plate 95 may be mounted on a top surface of the cover plate 91. The mounting plate 95 may have a plate shape to cover a wiring inlet hole 914 of the cover plate 91.

The wiring inlet hole 914 may pass through the cover plate 91 so that the wiring 962 guided to the inside of the wiring guider 90 is accessible. Also, the wiring inlet hole 914 may include a first opening 914*a* and a second opening 914*b*.

The first opening 914*a* may have a size greater than that of the second opening 914*b* and have a circular shape corresponding to a diameter of the rotation connection member 94. Here, the size of the first opening 914*a* may correspond to that of the connection member stepped part 942. Thus, the connection member restriction part 943 protruding from the connection member stepped part 942 may be hooked and restricted to an outer end of the first opening 914*a*.

Also, the second opening 914*b* may communicate with the first opening 914*a*. The second opening 914*b* may extend from one side of the first opening 914*a*. Here, the second opening 914*b* may have a width corresponding to that of the connection member restriction part 943.

Thus, the rotation connection member 94 may be inserted into the wiring inlet hole 914. Here, the connection member restriction part 943 may pass through the second opening 914*b*, and the connection member stepped part 942 may pass through the first opening 914*a*. Also, in the state in which the rotation connection member 94 is mounted, when the rotation connection member 94 rotates, the connection member restriction member 943 may interfere with a circumference of the first opening 914*a* to prevent the rotation connection member 94 from being separated.

The mounting plate 95 may have a size that is enough to cover all the first opening 914*a* and the second opening 914*b*. Also, a screw hole 953 to which a screw is coupled may be defined in each of both left and right sides of the mounting plate 95. The screw passing through the screw hole 953 may be coupled to the cover plate to fix the mounting plate 95 and the rotation connection member 94 mounted on the mounting plate 95.

A mounting opening 951 may be defined in a center of the mounting plate 95. Also, the rotation connection member 94 may be mounted on the mounting opening 951. A stepped portion accommodation part 952 protruding upward is provided around the mounting opening 951. A bottom surface of the stepped portion accommodation part 952 may be stepped to accommodate a circumference of the rotation connection member 94, more particularly, the connection member stepped part 942.

The rotation connection member 94 may be rotatably mounted on the mounting plate 95 and have a hollow inner side. Thus, the wiring 962 may be guided toward the flexible portion 93 along the inside of the rotation connection member 94.

The rotation connection member 94 may have an opened bottom surface. The connection member stepped part 942 may be disposed around the opened bottom surface of the rotation connection member 94. The connection member stepped part 942 may have a diameter greater than an inner diameter of the mounting opening 951. Also, the connection member stepped part 942 may be accommodated into the stepped portion of the stepped portion accommodation part 952. Thus, in the state in which the rotation connection member 94 is mounted on the mounting plate 95, the rotation connection member 94 may be freely rotatable without being separated.

Also, the connection member restriction part 943 extending outward may be disposed on one end of the connection member stepped part 942. The connection member restriction part 943 may protrude downward from the top surface of the connection member stepped part 942 and also extend in one side direction.

Here, the connection member restriction part 943 may extend to be restricted with the bottom surfaces of the mounting plate 95 and the cover plate 91. That is, the connection member restriction part 943 may extend up to the outside of the first opening 914*a*. Thus, the rotation connection member 94 may not be easily separated in the state of being restricted with the cover plate 91 and the mounting plate 95 even though strong force is applied to the rotation connection member 94.

To mount and separate the rotation connection member 94, the connection member restriction part 943 may be aligned with the second opening 914*b* to insert or withdraw the rotation connection member 94 into/from the cover plate 91. Also, in the state in which the rotation connection member 94 is inserted into the wiring inlet hole 914, the mounting plate 95 may be coupled to allow the rotation connection member 94 to be mounted.

An opening 940*b* that is opened backward may be defined in an upper end of the rotation connection member 94. Thus, the wiring 962 introduced through the opening 940*a* of the bottom surface of the rotation connection member 94 may be guided to the inside of the flexible portion 93 through the opening 940*a* defined in the upper portion of the rotation connection member 94. A connection member connection part 941 may extend backward from each of upper and lower ends of the opening 940*b* defined in the upper portion of the rotation connection member 94. The connection member connection parts 941 may be vertically spaced apart from each other and also horizontally extend to be coupled to one end of the flexible portion 93.

Also, connection protrusions 941*a* respectively protruding upward and downward may be respectively disposed on the connection member connection parts 941 that are vertically disposed. Each of the connection protrusions may be axially coupled to one end of the flexible portion 93. Thus, the flexible portion 93 may rotate by using the connection protrusion 941*a* of the connection member connection part 941 as an axis.

The plurality of flexible portions 93 may be continuously connected to each other. Also, each of the flexible portions 93 may be connected from the rotation connection member 94 to the guide head 92. The plurality of flexible portions 93 connected to each other may have the same shape and be continuously connected to be rotatable. Thus, the structure in which the flexible portions 93 are coupled to each other may have a structure such as a chain. Also, the wiring 962 may sequentially pass through the insides of the flexible portions 93 so as to be guided from the rotation connection member 94 to the guide head 92.

In details of the flexible portion 93, a plurality of guiding parts 931 may have a box shape of which the inside is hollowed forward and backward. Also, a front surface (a left surface in FIG. 11) and a rear surface of the guiding part 931 may be opened so that the wiring 962 passes through an opening space 930 in the guiding part 931.

A front connection part 934 may extend forward from each of upper and lower ends of the opened front surface of the flexible portion 93. The front connection part 934 may have a shape that further extends from each of the top and bottom surfaces of the flexible portion 93 and have a rounded end. Also, a connection hole 934*a* may be opened in the front connection part 934.

Also, a front extension part 936 may be further disposed between the front connection parts 934, i.e., at one end of the opened front surface of the flexible portion 93. The front extension part 936 may extend to further protrude from the other facing side surface. Thus, the front extension part 936 may restrict the rotation of the flexible portion 93 in one direction so that the flexible portion 93 rotates with directivity.

The front connection part 934 of the flexible portion 93 connected to an end of the rotation connection member 94 among the plurality of flexible portions 93 may be coupled to the connection member connection part 941. Also, the connection protrusion 941*a* may be inserted into the connection hole 934*a* so that the flexible portion 93 and the rotation connection member 94 rotate together with each other. The connection member connection part 941 of the rotation connection member 94 may have the same structure as a rear connection part 933.

Also, the rear connection part 933 may extend backward from each of the upper and lower ends of the opened front surface of the flexible portion 93. The rear connection part 933 may have a shape that further extends from each of the top and bottom surfaces of the flexible portion 93. Also, a rear protrusion 933*a* that protrudes may be disposed on each of top and bottom surfaces of the pair of rear connection parts 933. The rear protrusion 933*a* may be inserted into the connection hole 934*a* of the flexible portion 93 that is adjacent thereto.

Here, each of the top and bottom surfaces of the rear connection part 933 may be stepped to correspond to the front connection part 934. Thus, the front connection part 934 may be mounted to overlap the top surface of the rear connection part 933. Also, the stepped portion of the rear connection part 933 may be rounded like the end of the front connection part 934 so that the flexible portions 93 connected to each other are ratable together.

Also, a rear extension part 935 may be further disposed between the rear connection parts 933, i.e., at one end of the opened rear surface of the flexible portion 93. The rear extension part 935 may further protrude from the other facing side surface. Thus, the rear extension part 935 may restrict the rotation of the flexible portion 93 in one direction so that the flexible portion 93 rotates with directivity. Also, the rear extension part 935 may be disposed on the same plane as the front extension part 936 so that the flexible portions 93 connected to each other are disposed with directivity to rotate.

The plurality of flexible portions 93 may have a structure in which the flexible portions 93 are continuously connected to each other. The plurality of flexible portions 93 may be continuously connected to each other backward to extend. Thereafter, the plurality of flexible portions 93 may extend by a predetermined distance and then be continuously connected to each other forward. That is, in the state in which the plurality of flexible portions 93 are connected to each other, the plurality of flexible portions 93 may have a "U" shape on a whole, and the rotation connection member 94 and the guide head 92 may be connected to an extending end of each of the plurality of flexible portions 93. In the state in which the plurality of flexible portions 93 are connected to each other, the portion extending in the straight lines on both sides may be referred to linear sections S1 and S2, and the portions connecting the straight sections S1 and S2 on both the sides to each other may be referred to bent sections S3.

Here, the linear section S1 connected to the guide head 92 may be maintained in length even though the drawer door 30 is inserted and withdrawn, i.e., may be maintained in the shape of FIGS. 11 and 12. On the other hand, the linear section S2 connected to the rotation connection member 94 and the bent section S3 may vary in length when the drawer door 30 is inserted and withdrawn.

Also, the total length of the plurality of flexible portions 93 may be greater than the draw-out distance of the drawer part 30. Thus, the wiring 962 may be stably guided to the drawer door 30.

The guide head 92 may be connected to one end of the flexible portion 93. The guide head 92 may be disposed at a center of the door part 31 in the horizontal direction and be inserted into a connecting hole 315*d* defined in the door part 31.

The guide head 92 may have an opened front surface. A connector accommodation space 920 in which the guide-side connector 961 is accommodated may be defined in the guide head 92. The opened front surface of the guide head 92 may have a shape corresponding to the flexible portion 93.

Also, a fixing slot 921 that is cut backward may be defined in each of upper and lower ends of the opened front surface of the guide head 92. The fixing protrusions 319*a* and 319*b* disposed on the door-side connector 319 may be inserted into the fixing slots 921, respectively. The fixing protrusions 319*a* and 319*b* may be disposed inside the connecting hole 315*d* or disposed on the door-side connector 319. Thus, while the guide head 92 is inserted into the connecting hole 315*d*, the fixing protrusions 319*a* and 319*b* and the fixing slots 921 may be coupled to each other.

The fixing slots 921 may include an upper slot 921*a* defined in a top surface of the guide head 92 and a lower slot 921*b* defined in a bottom surface of the guide head 92. Also, the upper slot 921*a* and the lower slot 921*b* may be defined in the center of the guide head 92. Also, the upper slot 921*a* and the lower slot 921*b* may have widths different from each other to prevent the guide head 92 from being incorrectly coupled to each other.

A head coupling hole 922 may be defined in one side of a front surface of the guide head 92. A screw may be coupled to the head coupling hole 922. The screw may pass through the head coupling hole 922 and then be coupled to the rear surface of the door part 31. The guide head 92 may be more firmly fixed to the rear surface of the door part 31 by the coupling of the screw.

Also, head support parts 923*a* and 923*b* may be disposed on the top and bottom surfaces of the guide head 92, respectively. The head support parts 923*a* and 923*b* may contact the inside of the connecting hole 315*d* to support the guide head 92 in the state of being inserted into the guide head 92. Thus, even though the drawer door 30 is repeatedly inserted and withdrawn, the stably mounted state of the guide head 92 may be maintained.

The head support parts 923*a* and 923*b* may include an upper support part 923*a* on the top surface of the guide head 92 and a lower support 923*b* on the bottom surface of the guide head 92. The upper support part 923*a* may be disposed on the top surface of the guide head 92. The upper support part 923*a* may extend in the horizontal direction crossing the draw-out direction of the drawer door 30 and protrude by a predetermined height. Here, the upper support part 923*a* may be disposed at a position corresponding to the upper end of the connecting hole 315*d* in the state in which the guide head 92 is inserted.

The lower support part 923*b* may be disposed on the bottom surface of the guide head 92. Also, the lower support part 923*b* may be provided in plurality, which extend in the draw-out direction of the drawer door 30. The lower support parts 923*b* may be disposed to be spaced a predetermined distance from each other. When the guide head 92 is inserted, the lower support part 923*b* may contact the lower end of the connecting hole 315*d* to stably support the guide head 92.

A head connection part 924 may be disposed on a rear end of the guide head 92. The head connection part 924 may extend from a rear surface of the guide head 92, and the inside of the head connection part 924 may communicate with the connector accommodation space 920. Thus, the wiring 962 guided through the rotation connection member 94 may be guided to the inside of the guide head 92 through the head connection part 924. Also, the guide-side connector 961 may be connected to an end of the wiring 962 introduced into the connector accommodation space 920.

The head connection part 924 may extend backward from each of the opened upper and lower end of the rear end of the guide head 92. Also, a head protrusion 924*a* may be disposed on each of the top and bottom surfaces of the head connection part 924. The head connection part 924 may have the same shape as the rear connection part 933 of the flexible portion. Thus, the head connection part 924 may have a structure that is rotatably connected to the front connection part 934.

Figure 13:
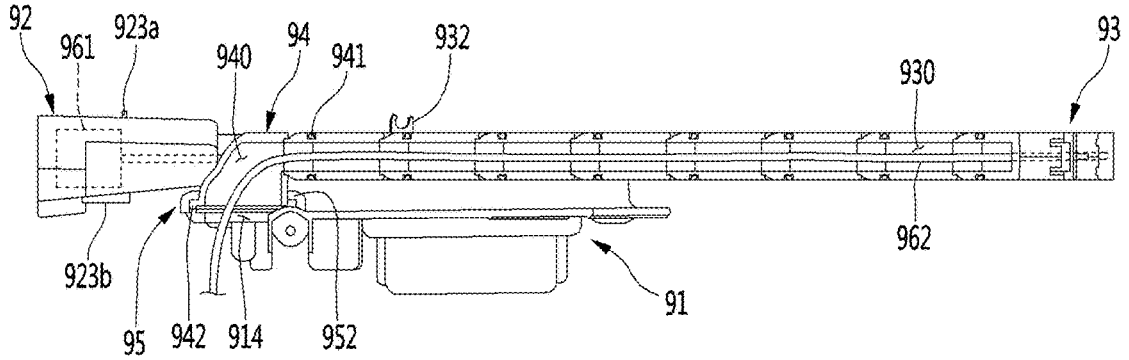
FIG. 13 is a cross-sectional view of the wiring guider.

FIG. 13 is a cross-sectional view of the wiring guider.

As illustrated in the drawings, in the state in which the wiring guider 90 is assembled, the wiring 962 guided to the bottom surface of the cabinet 10 may be guided to the rotation connection member 94 via the cover plate 91 through the wiring inlet hole 914.

The wiring 962 introduced into the rotation connection member 94 may be guided along the plurality of flexible portions 93 connected to each other. That is, the wiring 962 may be disposed in a U shape like the arranged shape of the flexible portions 93. Also, when the flexible portion 93 is changed in position by the insertion and withdrawal of the drawer door 30, the wiring 962 may move together with the flexible portion 93 in the state of being disposed in the flexible portion 93.

The wiring 962 passing through the flexible portion 93 may be guided to the inside of the guide head 92 and be connected to the guide-side connector 961 inside the guide head 92. When the guide head 92 is mounted on the rear surface of the door part 31, the door-side connector 319 and the guide-side connector 961 may be coupled and connected to each other. That is, the wiring 962 within the cabinet 10 may be electrically connected to the electronic components within the door part 31 through the wiring guider 90 via the bottom of the cabinet 10.

Figure 14:
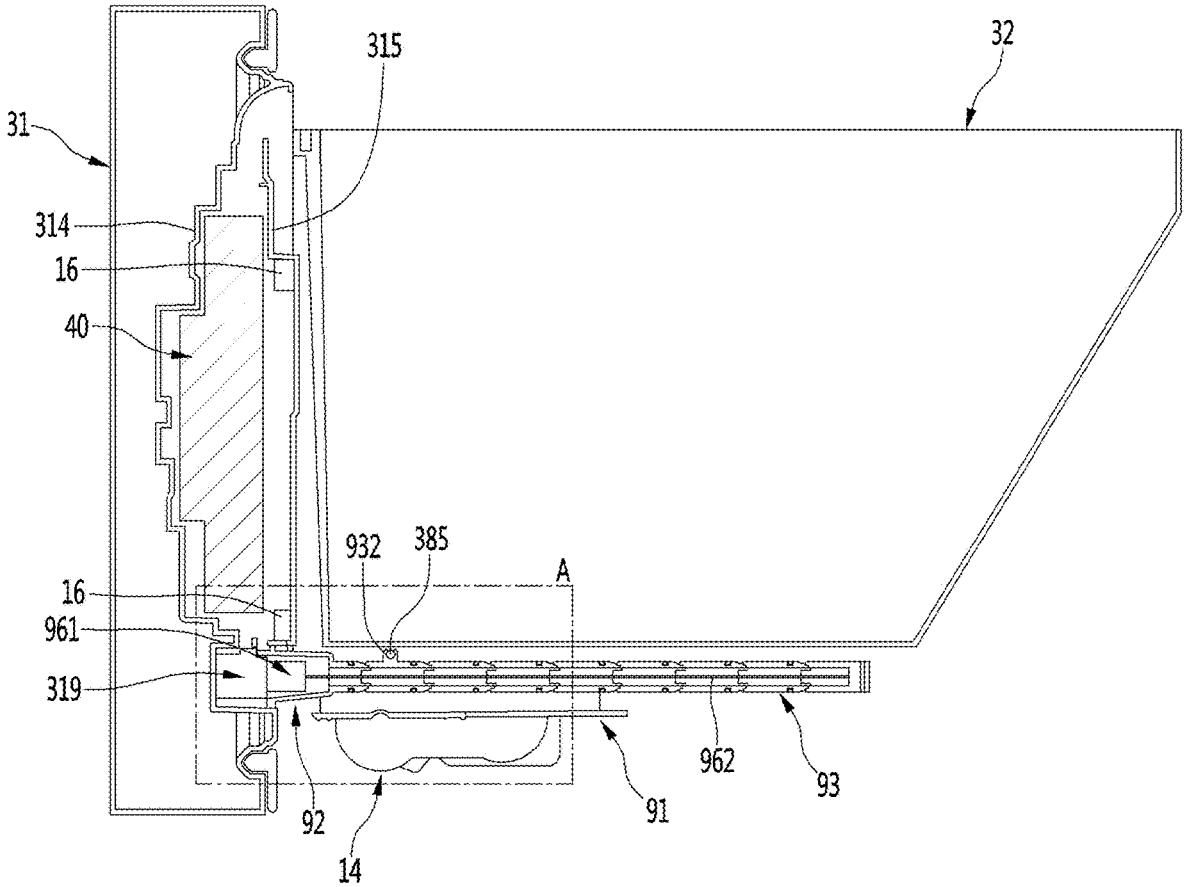
FIG. 14 is a cross-sectional view illustrating an arrangement of the driving device and the wiring guider of the drawer door.
Figure 15:
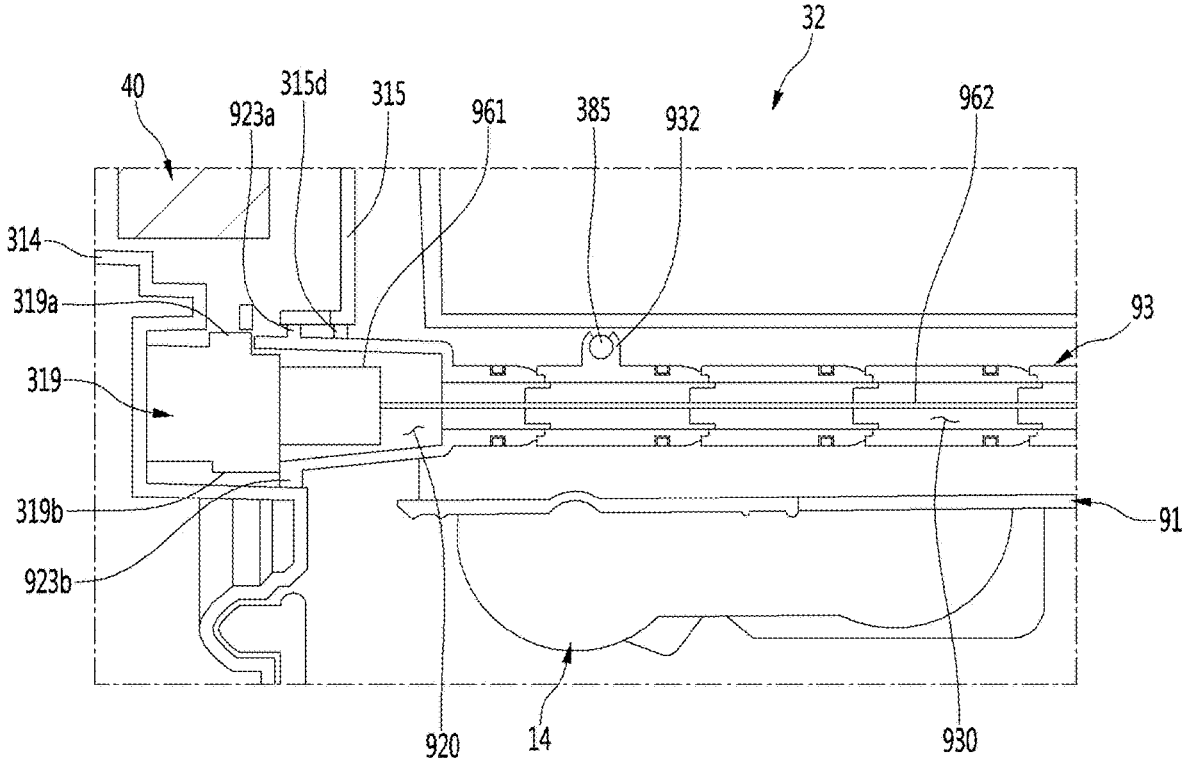
FIG. 15 is an enlarged view illustrating a portion A of FIG. 14.
Figure 16:
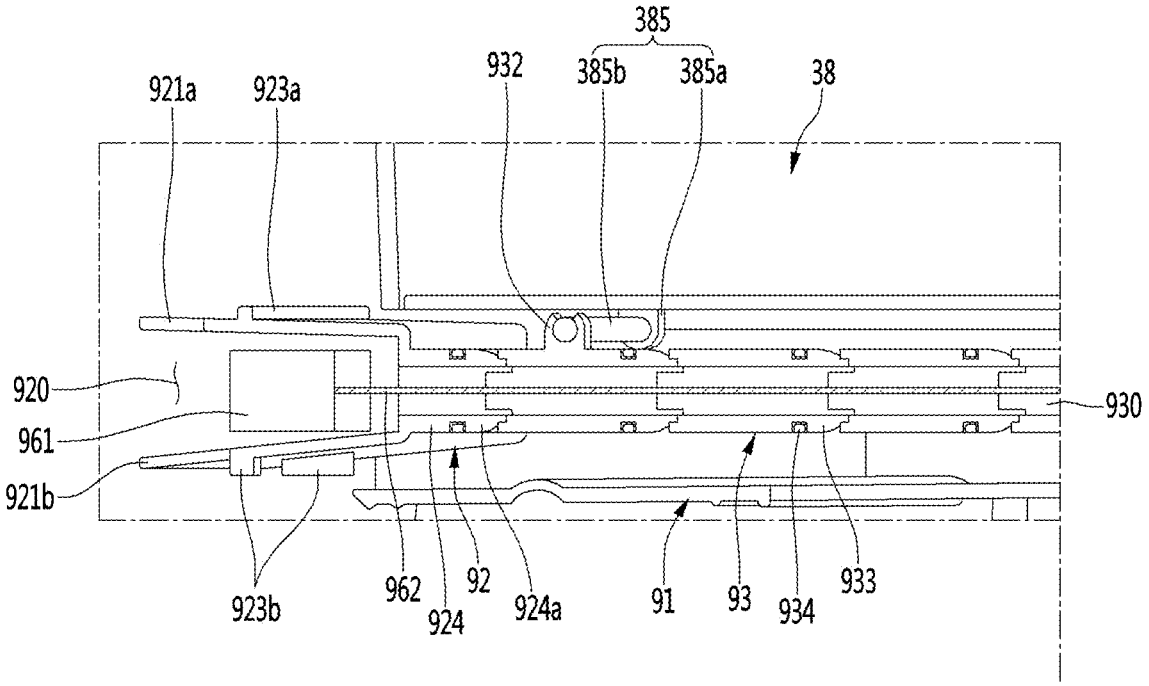
FIG. 16 is a cutaway perspective view illustrating an arrangement of wirings within the wiring guider.

FIG. 14 is a cross-sectional view illustrating an arrangement of the driving device and the wiring guider of the drawer door. Also, FIG. 15 is an enlarged view illustrating a portion A of FIG. 14. Also, FIG. 16 is a cutaway perspective view illustrating an arrangement of the wirings within the wiring guider.

As illustrated in the drawing, the wiring guider 90 may be coupled to the rear surface of the door part 31. The guide head 92 may be inserted into the connecting hole 315*d* and fixed to the door part 31.

The connecting hole 315*d* may be disposed below the bottom surface of the drawer part 32. That is, the connecting hole 315*d* may be disposed below the drawer part 32 to fix the guide head 92 to the door part 31.

Also, the wiring guider 90 may be disposed below the drawer part 32. Thus, even though the drawer door 30 is inserted or withdrawn, the wiring guider 90 may be maintained in the state of being connected to the door part 31 by passing through the lower side of the drawer part 32. Thus, while the drawer door 30 is inserted and withdrawn, the wiring guider 90 may be covered by the drawer part 32 and thus may not be exposed to the user.

The door-side connector 319 may be connected to the electronic components provided inside the door part 31 such as the driving device 40, the door light 318, and the elevation detection device 16. Thus, the wiring 962 guided through the wiring guider 90 may be electrically connected to the electronic components within the door part 31.

Also, in the even state in which the drawer door 30 is completely withdrawn, the plurality of flexible portions 93 connected to each other may have a relatively long length so that the wiring 962 is connected to the door part 31. Thus, in the state in which the plurality of flexible portions 93 are connected to each other, if only both ends of the flexible portions 93 are respectively connected to the rotation connection member 94 and the guide head 92, the flexible portions may droop in the connected state.

To prevent this limitation from occurring, the flexible portion fixing part 932 may be disposed on the flexible portion 93, which is disposed on the linear section S1 from the portion connected to the guide head 92, among the plurality of flexible portions 93. Alternatively, the flexible portion fixing part 932 may be further disposed on the plurality of flexible portions 93 disposed on the linear section S1 or may be further disposed on the flexible portions 93 disposed on the linear section S1 that is not changed in position even though the drawer door is inserted and withdrawn.

Since the linear section S1 corresponds to a length from an end of the guide head 92 to the bent section S2 at which each of the flexible portions 93 is bent in the state in which the drawer door 30 is inserted and withdrawn, the linear section S1 may be substantially maintained in the linear shape while the drawer door 30 is withdrawn. Thus, even though the flexible portion 93 is fixed to the bottom surface of the drawer part 32 by the flexible portion fixing part 932, the insertion and withdrawal of the drawer door 30 or the guidance of the wiring 962 may not interfere.

The flexible portion fixing part 932 may have a structure in which a groove opened upward is defined. Thus, the flexible portion fixing part 932 may be coupled to a flexible portion coupling part 385 so that the flexible portion 93 and the bottom surface of the drawer part 32 are maintained to be spaced a predetermined distance from each other.

The flexible portion coupling part 385 may be disposed on the bottom surface of the drawer part 32 corresponding to the flexible portion fixing part 932. The flexible portion coupling part 385 may include a connection rod 385*b* that is press-fitted into a groove defined in the flexible portion fixing part 932 and rod supporter 385*a* supporting both ends of the connection rod 385*b*. The connection rod 385*b* may have a predetermined length so that the flexible portion 93 is movable within a region of the connection rod 385*b*.

When the flexible portion fixing parts 932 is provided in plurality, the flexible portion coupling part 385 may also be provided in plurality at corresponding positions. Thus, when the drawer door 30 is repeatedly inserted or withdrawn, or the refrigerator 1 is used for a long time, the flexible portions 93 may be maintained at initial positions. Thus, the drawer door 30 may be prevented from interfering due to the looping or deformation of the flexible portions 93 when the drawer door 30 is inserted and withdrawn or may be smoothly inserted and withdrawn.

The driving device 40 may be driven by the wiring 962 guided by the wiring guider 90, and the elevation device 80 within the drawer part 32 may be elevated by the operation of the driving device 40.

Hereinafter, the constituents of the driving device 40 will now be described in more detail with reference to the accompanying drawings.

Figure 17:
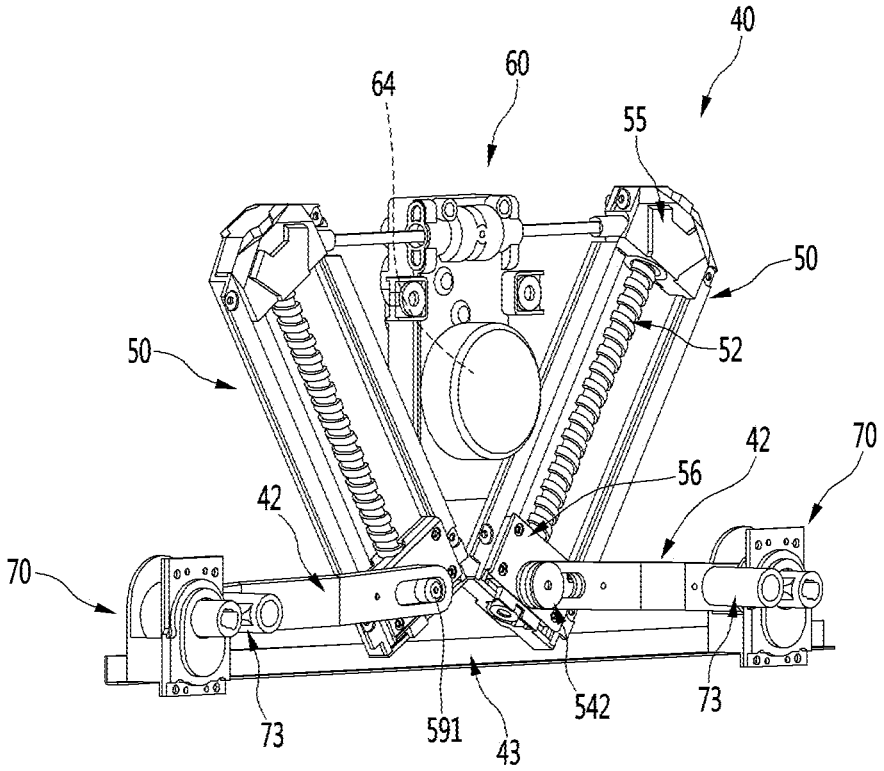
FIG. 17 is a perspective view of the driving device according to an embodiment.
Figure 18:
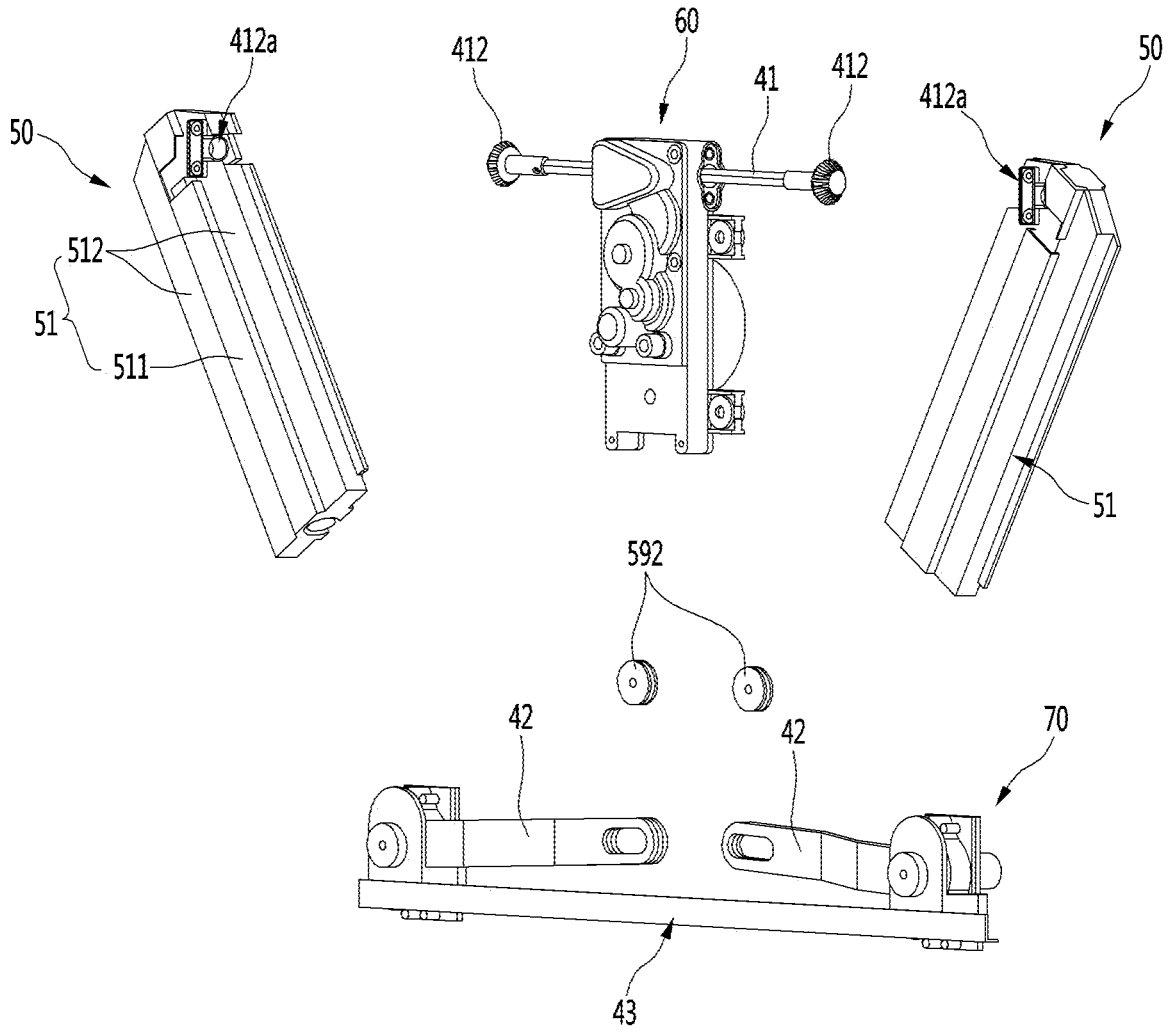
FIG. 18 is an exploded perspective view of the driving device.

FIG. 17 is a perspective view of the driving device according to an embodiment. Also, FIG. 18 is an exploded perspective view of the driving device.

As illustrated in the drawings, the driving device 40 may include a motor assembly 60, a screw assembly 50 disposed on each of both sides of the motor assembly 60 and connected by a shaft 41, a lever 42 connected to the screw assembly 50, and the connecting assembly 70.

In detail, the motor assembly 60 may be disposed at a center of each of the left and right sides of the door part 31. Also, the driving device 40 may provide the power for elevating the elevation device 80. The driving device 40 may allow both the screw assemblies 50 and the lever 42 to operate by the motor assembly including one driving motor 64.

Particularly, the motor assembly 60 may adjust magnitude of the decelerated and transmitted force through a combination of the plurality of gears. Also, a shaft 41 passing through the motor assembly 60 from the left to the right, i.e., in a horizontal direction may be disposed on an upper end of the motor assembly 60, and the plurality of gears may be combined in the motor assembly 60 for rotation of the shaft 41.

Also, the motor assembly 60 may have a structure in which the driving motor 64 and the gears are arranged vertically to minimize a space recessed when the motor assembly 60 is mounted on the door part 31, in particular, a width in the left and right direction is widened, and a thickness in the front and rear direction is minimized. Also, the driving motor 64 constituting the motor assembly 60 may protrude toward the drawer part 32 to minimize a depth of the door part 31 to secure insulation performance.

The shaft 41 may pass through the motor assembly 60 in the transverse direction and be coupled to the screw assembly 50 disposed at both sides of the motor assembly 60 so that the power of the motor assembly 60 is simultaneously to the screw assembly (50). Thus, the shaft 41 may be called a power transmission member.

For this, the shaft 41 may have a length such that both ends of the shaft 41 pass through the motor assembly 60 and are inserted into the screw assembly 50. Also, a shaft driving gear 411 may be provided at a center of the shaft 41. The shaft driving gear 411 may be coupled to the gears in the motor assembly 60 to rotate. Also, a shaft gear 412 may be disposed on each of both ends of the shaft 41. The shaft gear 412 may have a structure that is coupled to the screw assembly 50. The shaft gears 412 may have the same structure so that the same rotation force is applied to the shaft gears 412. The screw assembly 50 may be transferred to the screw assembly 50 so that the screw assembly 50 operates simultaneously.

The screw assemblies 50 may be disposed on both sides of the motor assembly 60. The upper end of the screw assembly 50 may be connected to the shaft 41 and also be gear-coupled to the shaft gear 412 to transmit the power so that the screw 52 rotates. A screw gear having a bevel gear shape gear-coupled to the shaft gear 412 may be further disposed on the screw 52.

When the screw 52 rotates, a screw holder 56 may move along the screw 52. Also, the lever 42 may be coupled to the screw holder 56 to allow the lever 42 to rotate according to the movement of the screw holder 56.

For this, the upper end of the screw assembly 50 may be oriented outward, and the lower end of the screw assembly 50 may be inclined inward. Here, the screw assemblies 50 on both sides may be symmetrical to each other with respect to the motor assembly 60. Thus, the motor assembly 60 may be disposed between the screw assemblies 50 located on both sides of the screw assembly 50. The screw assembly 50 disposed on both sides of the motor assembly 60 may be provided so that a distance between the screw assemblies 50 gradually increases from the upper end to the lower end.

The screws 52 provided in the screw assembly 50 may be arranged in the same direction as the screw assembly 50, and extension lines of the screws 52 on both the left and right sides may cross each other. Also, the screw holder 56 may move along the screw 52 according to the rotation of the screw 52, and the lever 42 connected to the screw holder 56 may rotate along the connecting assembly 70. The screw assembly 50, the lever 42, and the connecting assembly 70 may be symmetrical to each other so that the lever 42 simultaneously rotates at the same angle as the screw assembly 50 is driven.

The lever 42 may connect the screw holder 56 to the connecting assembly 70. Thus, both ends of the lever 42 may be rotatably coupled to the screw holder 56 and the connecting assembly 70, respectively. Thus, when the screw holder 56 linearly moves, the lever 42 may be rotatable about the connecting assembly 70.

The connection assemblies 70 disposed on both the left and right sides may be connected to each other by a connector bracket 43, and the connecting assembly 70 may be firmly supported on the door part 31 to effectively transmit the rotation force to the elevation device 80.

Figure 19:
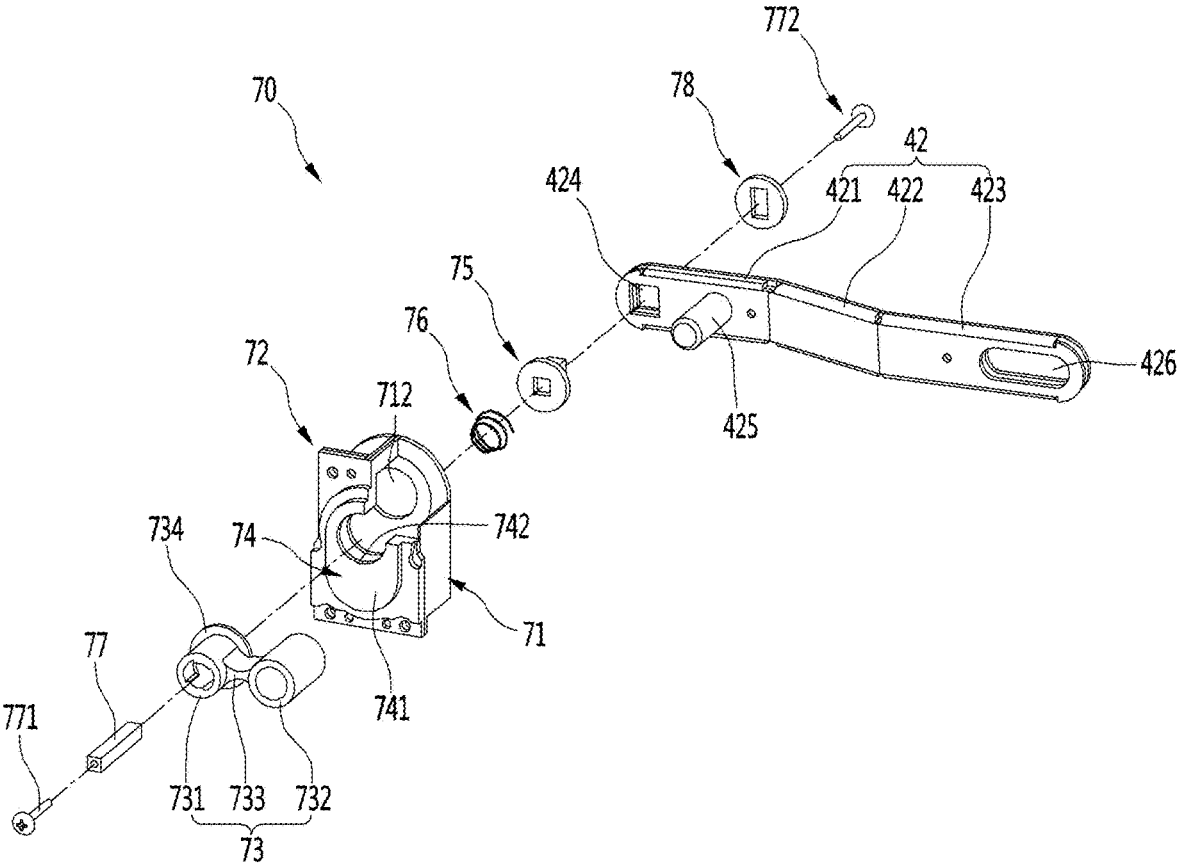
FIG. 19 is an exploded perspective illustrating a coupling structure of a connecting assembly, which is one component of the driving device, and a lever.

FIG. 19 is an exploded perspective illustrating a coupling structure of a connecting assembly, which is one component of the driving device, and a lever.

As illustrated in the drawing, the lever 42 may be configured to connect the screw assembly 50 to the connecting assembly 70.

In details of the structure of the lever 42, the lever 42 may be provided in a rod or bar shape having a predetermined width and may extend from the rotation axis of the connecting assembly 70 to the holder protrusion 591 of the screw assembly 50.

In detail, the lever 42 may include a first extension part 421 connected to the connecting assembly, a second extension part 423 connected to the screw holder 56, and an intermediate portion 422 connecting the first extension part 421 to the second extension part 423.

The first extension part 421 and the second extension part 423 may be disposed parallel to each other, and the intermediate portion 422 may have an inclination. Also, the first extension part 421 may be further backward than the second extension part 423 by the inclination of the intermediate part 422.

The lever 42 may not be deformed or damaged even if a large amount of force is applied to the lever 42 due to the structure and shape of the bent lever 42. Also, the lever 42 may be made of a metal material to realize the stable power transmission even when the elevation device 80 on which a heavy food is seated is elevated.

Also, the inclination of the intermediate portion 422 may allow the lever 42 to be connected between the connecting assembly 70 disposed relatively backward and the screw holder 56 disposed relatively forward.

A first lever hole 424 may be defined in the first extension part 421 to be connected to the lever fixing member 75 of the connecting assembly 70. The first lever hole 424 may be formed in a polygonal shape corresponding to one side of the lever fixing member 75 and may be opened in a rectangular shape as illustrated in the drawing. The lever fixing member 75 may also rotate together when the lever 42 rotates.

Also, the lever protrusion 425 may be disposed on the first extension part 421. The lever protrusion 425 may be spaced apart from the first lever hole 424 and disposed toward the intermediate part 422. The lever protrusion 425 may be configured to be coupled to the connection member 73 of the connecting assembly 70. That is, the rotation force of the lever 42 may be transmitted to the connecting assembly 70 by the lever protrusion 425 together with the first lever hole 424. Furthermore, the rotation force may be transmitted to the elevation device 80 to elevate the elevation device 80.

Also, a second lever hole 426 through which the holder protrusion 591 of the screw holder 56 is inserted may be defined in the second extension part 423. The second lever hole 426 may have a size corresponding to the holder protrusion 591 and also may have a long hole shape in the extension direction of the second extension part 423 so that the holder protrusion 591 move as the screw holder 56 move vertically. Thus, the holder protrusion 591 may be disposed on the left end of the second lever hole 426 in a state in which the screw holder 56 is disposed at the lowest position, and as the screw holder 56 move upward, the protrusion 591 moves to the right side of the second lever hole 426 so that the lever 42 rotates.

The connecting assembly 70 may be provided at one end of the lever 42, i.e., at a position corresponding to the first extension part 421. A connection member 73 for connecting the lever 42 to the elevation device 80 may be rotatably mounted on the inside of the connecting assembly 70.

The connection member 73 may be coupled to the lever fixing member 75 by the fixing shaft 77 and thus may rotate together with the rotation of the lever 42. Also, the connection member 73 may be connected to the lever protrusion 425 and the scissors protrusion 841*b* to transmit greater force to the elevation device 80, and thus, the elevation device 80 may be more effectively lifted. Thus, the elevation device 80 in the state in which the food is seated sufficiently while using only one of the drive motors 64 may be elevated, and a compact configuration may be realized.

The connecting assembly 70 may have an outer appearance defined by the connection case 71 and the connection cover 72, and the lever fixing member 75 and the connection member 73 may be mounted on the connection case 71.

The connecting assembly 70 may include the connection case 71, the connection cover 72, and the connection member 73, the push member 74, the lever fixing member 75, and the elastic member 76.

In detail, the connection case 71 may be opened on one side and includes a space for accommodating the lever fixing member 75, the connection member 73, the push member 74, and a portion of the lever 42. Also, a through-hole 712 may be defined in the space. An external fixing member 78 may be provided on the outer surface of the connection case 71 corresponding to the through-hole 712.

Also, the lever fixing member 75 may be accommodated in the space inside the connection case 71 and define a surface capable of supporting one end of the elastic member 76. Also, A first lever hole 424 of the lever 42 and the through-hole 712 may extend to be sequentially penetrated through a center of the lever fixing member 75 to allow the external fixing member 78 to be inserted therein.

The fixing shaft 77 may pass through the first connection part 731 of the connection member 73 and then be inserted into the lever fixing member 75. Also, coupling members 771 and 772 may be coupled to both ends of the fixing shaft 77, respectively. The lever fixing member 75, the external fixing member 78, and the connection member 73 may be coupled to the fixing shaft 77 through the coupling of the coupling members 771 and 772. Thus, when the lever fixing member 75 rotates by the rotation of the lever 42, the connection member 73 connected by the fixing shaft 77 may also rotate together.

The elastic member 76 may be provided between the connection member 73 and the lever fixing member 75. The elastic member 76 may be compressed when the connection member 73 moves. In detail, the elastic member 76 may have a coil spring structure and have one end supported by the lever fixing member 75 and the other end supported by the connection support part 734 of the connection member 73.

The connection member 73 may move in the front-rear direction within the space of the connection case 71. Here, the connection member 73 may have a structure that is inserted into or protrudes to the space by the guide of the fixing shaft 77.

In details of the structure of the connection member 73, the connection member 73 may include a first connection part 731 which passes through the fixing shaft 77 and is concentric with the rotation axis of the lever 42, a second connection part 731 which is spaced from the first connection part 731 and into which the lever protrusion 425 is inserted, and a connection part 733 connecting the first connection part 731 to the second connection part 732.

The first connection part 731 may have a hollow cylindrical shape. Also, the rotation shaft 841*a* of the elevation device 80 may be inserted into the first connection part to rotate together with the rotation shaft 841*a* of the elevation device 80.

Also, a connection support part 734 protruding outward by a predetermined width may be disposed on one side of the first connection portion 731. The end of the elastic member 76 may contact the connection support part 734, and the end of the first connection part 731 may contact the connection support part 734. The connection support part 734 may protrude outward to support one end of the elastic member 76, and one end of the first connection part 731 may be inserted into the elastic member 76 to prevent the clastic member 76 from being separated.

The connection support part 734 may be larger than the size of the through-hole 742 defined in the push member 74 to maintain the state in which the connection support part 734 is in close contact with the rear surface of the push member 74. Thus, the connection support part 734 and the push member 74 may move together when the push member 74 is pressed or when the clastic member 76 returns to the initial position.

The second connection part 732 may be disposed at a position spaced apart from the first connection part 731 by the connection member 73. The second connection part 732 may have a cylindrical shape that is penetrated in the front and rear direction. The lever protrusion 425 may be inserted into one side of the second connection part 732, and the scissors protrusion 841*b* of the elevation device 80 may be inserted into the other side of the second connection part 732. Thus, the second connection part 732 may rotate together with the scissors protrusion 841*b* and the lever protrusion 425 when the elevation device 80 operates.

The connection part 733 may be disposed so that the rotating shaft 841*a* and the scissors protrusion 841*b* of the elevation device 80 are respectively inserted into the first connection part 731 and the second connection part 732. As the second connection part 732 move farther away from the first connection part 731, the elevation device 80 may be easily elevated. However, when the first connection part 731 and the second connection part 732 are spaced a set distance or more from each other, the moving trajectory of the lever protrusion 425 and the scissors protrusion 841*b*, which are inserted into the second connection part 732, may extend up to a high height on the rear surface of the door part 31 and the front surface of the drawer part. Thus, the opened trajectory may be exposed to deteriorate the outer appearance. Thus, the position of the second connection part 732 may be determined by the length of the connection part 733. Also, the second connection part 732 may be disposed at a height at which the rotation trajectory is not exposed, i.e., a position higher than the upper end of the elevation device 80.

The push member 74 may be provided inside the connection device case 71 and may be exposed through the opening 721 of the connecting cover 72 so that the push member 68 is pressed by the user. The push member 74 may include a push part 741 that is exposed through the opening 721 of the connecting cover 72.

A through-hole 742 through which the first connection part 731 passes may be defined in the push part 741. The through-hole 742 may be larger than the outer diameter of the first connection part 731 and slightly smaller than the outer diameter of the connection support part 734. Thus, when the push member 741 may be pushed to move the push member 74, the first connection member 73 contacting the push member 74 may also move together to selectively connect the connection member 73 to the elevation device 80.

The connecting cover 72 may be mounted on the opened front side of the connecting case 71, and an opening 721 may be defined to expose the push part 741. The connecting cover 72 may be firmly fixed to the connecting case 71 by the coupling member. Thus, the configuration of the connecting case 71 may be maintained in the mounted state.

The connecting case 71, the push member 74, and a portion of the connecting cover 72 may be opened by cutting the connection member 73 by a rotational trajectory. Thus, the connection member 73 may be prevented from interfering with the connecting case 71, the push member 74, and the connecting cover 72 when the connection member 73 rotates.

In this structure, the user may manipulate the push member 74 of the connecting assembly 70 to selectively couple and separate the connecting assembly 70 to and from the elevation device 80.

Figure 20:
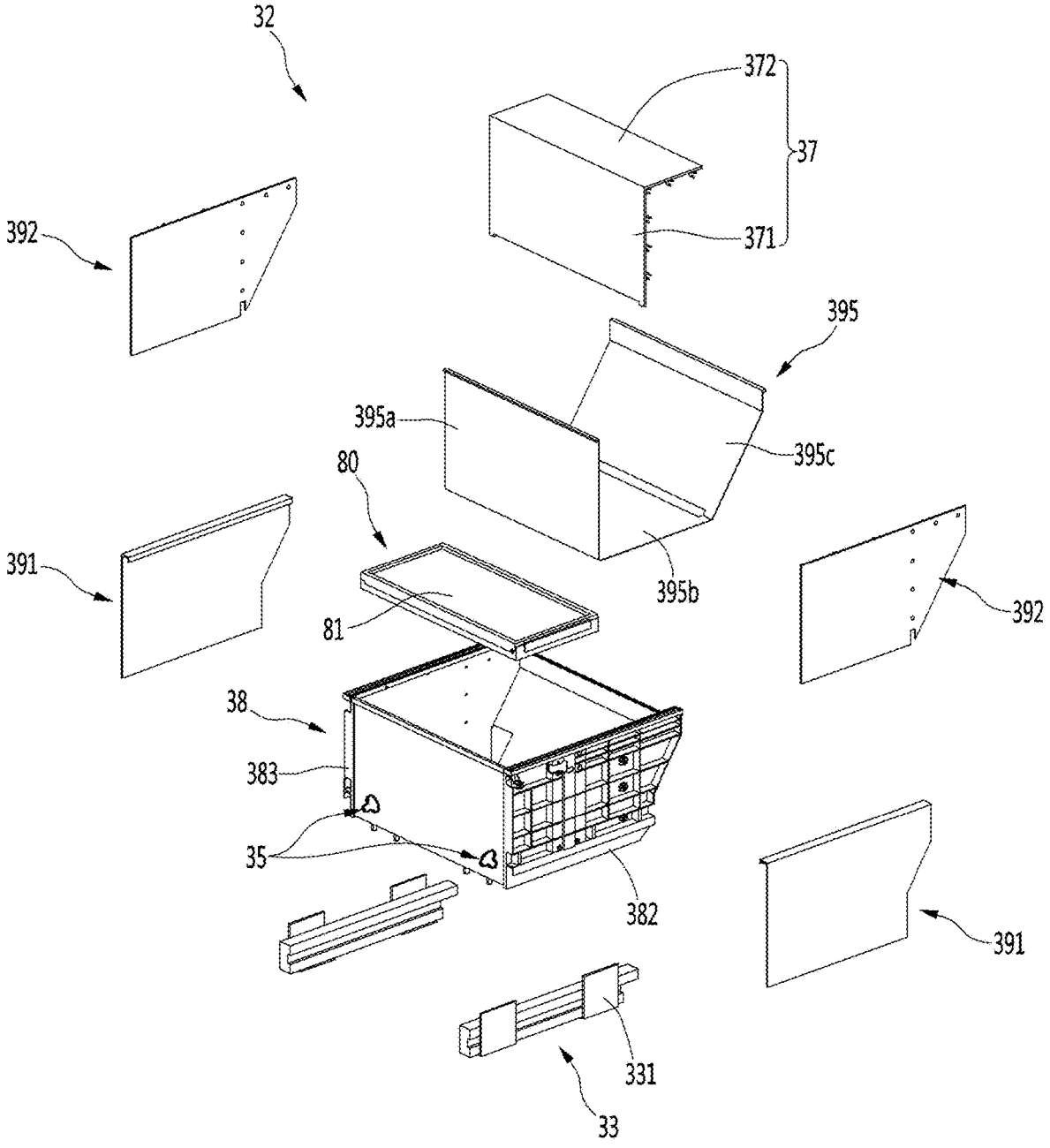
FIG. 20 is an exploded perspective view of the drawer part.

Hereinafter, a structure of the drawer part 32 coupled to the door part 31 will now be described in more detail with reference to the accompanying drawings. FIG. 20 is an exploded perspective view of the drawer part.

As illustrated in the drawings, the drawer part 32 may include a drawer body 38 defining an entire shape of the drawer part 32, an elevation device 80 provided in the drawer body 38 to elevate the container and food, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage chamber therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to the lower frame of each of both sides of the bottom surface or both left and right surfaces of the drawer part 32. In the state in which the door frame 316 and the drawer part 32 are coupled to each other, the drawer part 32 and the door part 31 may be integrally coupled to be inserted and withdrawn.

The door frame 316 may be separated from the drawer part 32, and then the connecting assembly 70 may operate to separate the door part 31 from the drawer part 32 in order to separate the door part 31 from the drawer part 32. The door frame 316 and the drawer part 32 may be coupled to each other by a separate coupling member or a coupling structure between the door frame 316 and the drawer unit 32.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage chamber. Also, the draw-out rack 34 may be coupled to a pinion gear 141 disposed on the bottom surface of the storage chamber. Thus, when the draw-out motor 14 is driven, the pinion gear 141 may rotate to allow the draw-out rack 34 to move, and the drawer door 30 may be inserted and withdrawn.

The drawer door 30 may not be automatically inserted and withdrawn. That is, the user may push or pull the drawer door 30 to be inserted and withdrawn. Here, the draw-out rack 34 may be omitted, and thus, the insertion and withdrawal may be performed through only the draw-out rail 33.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the drawer door 30.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the door frame 316 and the draw-out rail 33, which are mounted on both the sides of the drawer body 38 may not be exposed to the outside.

A plurality of reinforcement ribs 384 may cross each other in vertical and horizontal directions on both outer surfaces of the drawer body 38. The reinforcement ribs 384 may reinforce the strength of the drawer body 38 itself so that the drawer body 38 is more rigidly shaped relative to the weight of the door, which increases by providing the driving device and the elevation. Also, the reinforcement ribs 384 may support the outer side plates 391 mounted on both side surfaces, and thus the outer appearance of the drawer part 32 may be firmly maintained.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage chamber within the drawer part 32 may have a metal texture on the whole, and the foods accommodated in the drawer part 32 may be more uniformly cooled and thus stored at a low temperature in the more uniform region. In addition, visually excellent cooling performance and storage performance may be provided to the user.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the elevation device 80 is disposed, may be exposed in the drawer body 38, and the rear space S2 may be covered by the drawer cover 37.

The elevation 80 may be disposed in the drawer body 38. The elevation device 80 may be connected to the connecting assembly 70 and may be vertically movable. The left and right sides of the elevation device 80 may be elevated uniformly.

A drawer opening 35 may be defined in the lower part of the front surface of the drawer part 32 for coupling the elevation device 80 to the connecting assembly 70. The drawer opening 35 may provide a passage through which the connection member 73 is inserted to be coupled to the elevation device. Also, the drawer opening 35 may have an opening shape along the rotation path of the connection member 73 when the connection member 73 rotates to allow the connection member 73 to rotate, and thus, the stable rotation may be achieved without the interference.

The elevation device 80 may be provided as a scissors type so that the elevation device is folded in a descending state and unfolded in an ascending state. Thus, the container or food seated on the upper surface may be elevated.

The elevation device 80 may be provided with a support plate 81, and the support plate 81 may provide a seating surface on which the container 36 or food is seated.

Figure 21:
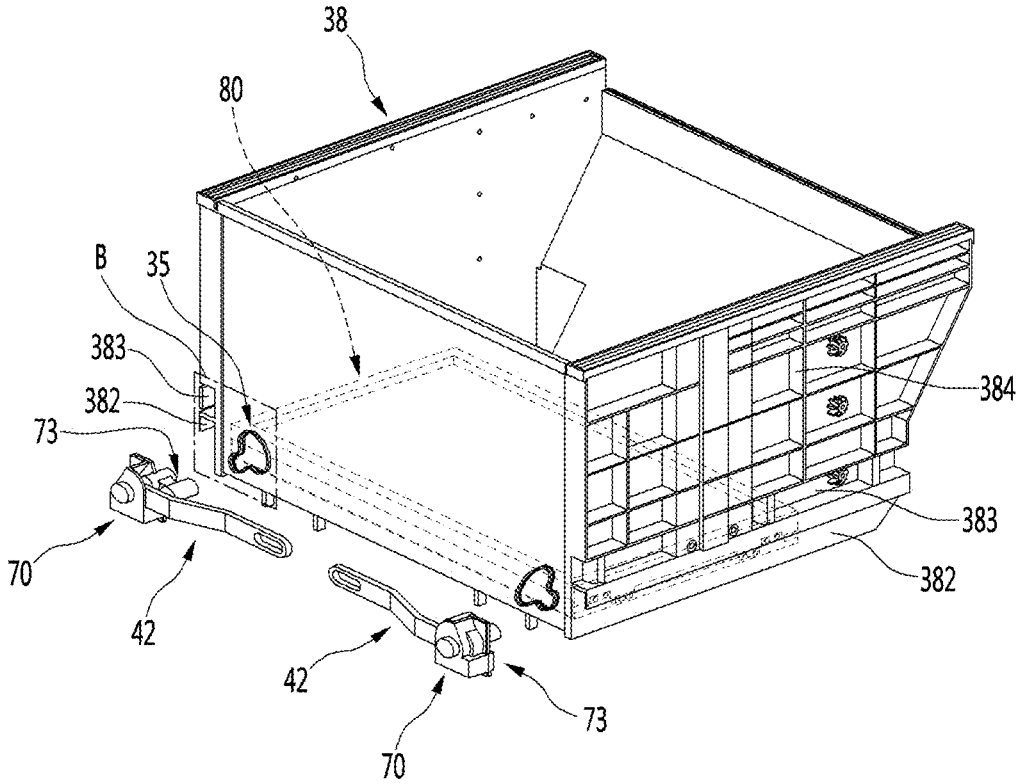
FIG. 21 is an exploded perspective view illustrating a coupling relationship between the drawer part and the connecting assembly.
Figure 22:
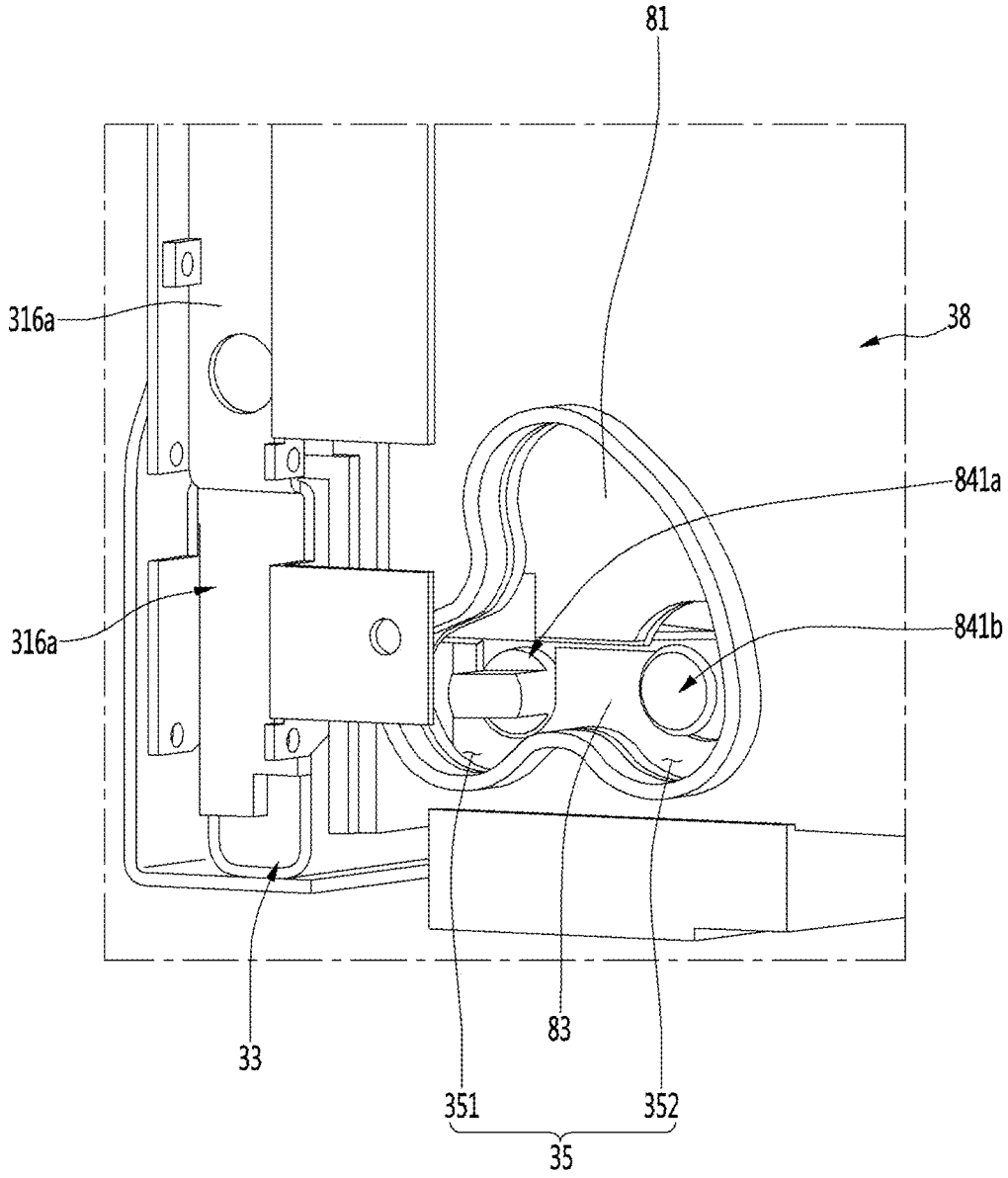
FIG. 22 is an enlarged view illustrating a portion B of FIG. 21.

FIG. 21 is an exploded perspective view illustrating a coupling relationship between the drawer part and the connecting assembly. Also, FIG. 22 is an enlarged view illustrating a portion B of FIG. 21.

As illustrated in the drawings, the drawer opening 35 may be defined in the right and left sides of the lower front of the drawer part 32. The shape of the drawer opening 35 on each of both sides of the right and left sides may be symmetrical to each other, and the rotation shaft 841*a* of the elevation device 80 and the scissors protrusion 841*b* may be exposed through the drawer opening 35. That is, the drawer opening 35 may be opened at a position corresponding to the rotation shaft 841*a* of the elevation device 80 and the scissors protrusion 841*b*.

The drawer opening 35 may include a central portion 351 and a trajectory portion 352. The center portion 351 may be disposed at a position corresponding to the rotation shaft 841*a* of the elevation device 80 and may have a size such that the first connection part 731 of the connection member 73 is inserted. Also, the trajectory portion 352 may be connected to the center portion 351 and may be opened in a shape corresponding to the trajectory in which the second connection part 732 of the connection member 73 move to rotate. Thus, the rotation shaft 841*a* of the elevation device 80 may rotate on the central portion 351 while the scissors protrusion 841*b* of the elevation device 80 rotates along the trajectory portion 352. That is, the scissors protrusion 841*b* and the second connection part 732 may be disposed inside the center portion 351 and the trajectory portion 352 when the elevation device 80 moves vertically.

The height of the drawer opening 35 may be lower than the upper end of the elevation device 80, i.e., the top surface of the support plate 81. Thus, the drawer opening 35 may be prevented from being seen from the inside of the drawer part 32 in any state in the state in which the elevation device 80 is mounted.

The rotation shaft 841*a* and the scissors protrusion 841*b* of the elevation device 80 may be exposed through the drawer opening 35 while the elevation device 80 is mounted inside the drawer part 32. Also, in the state in which the drawer door 30 is coupled, the connection member 73 of the connecting assembly 70 may be inserted through the inside of the drawer opening 35 so as to be coupled to the rotation shaft 841*a* of the elevation device 80 and the scissors protrusion 841*b*.

The connecting assembly 70 may be provided on each of both right and left sides of the drawer part 32 and may have a shape symmetrical to each other. The selective separation of the elevation device 80 and the connecting assembly 70 may be enabled through the manipulation of the push member 74.

The circumference of the support plate 81 may protrude upward so that the container 36 or food is stably mounted. Also, the circumference of the support plate 81 may extend downward. Thus, the remaining constituents of the elevation device 80 may be accommodated below the support plate 81, and the covered and clean outer appearance may be realized by the circumference of the support plate 81.

In addition, the support plate 81 may have a size and a shape corresponding to the front space to prevent foreign matters from being introduced into the elevation device 80 provided below the front space S1, and also, to fundamentally prevent safety accidents from occurring by blocking the access to the elevation device 80.

Hereinafter, constituents of the elevation device 80 will be described in more detail.

Figure 23:
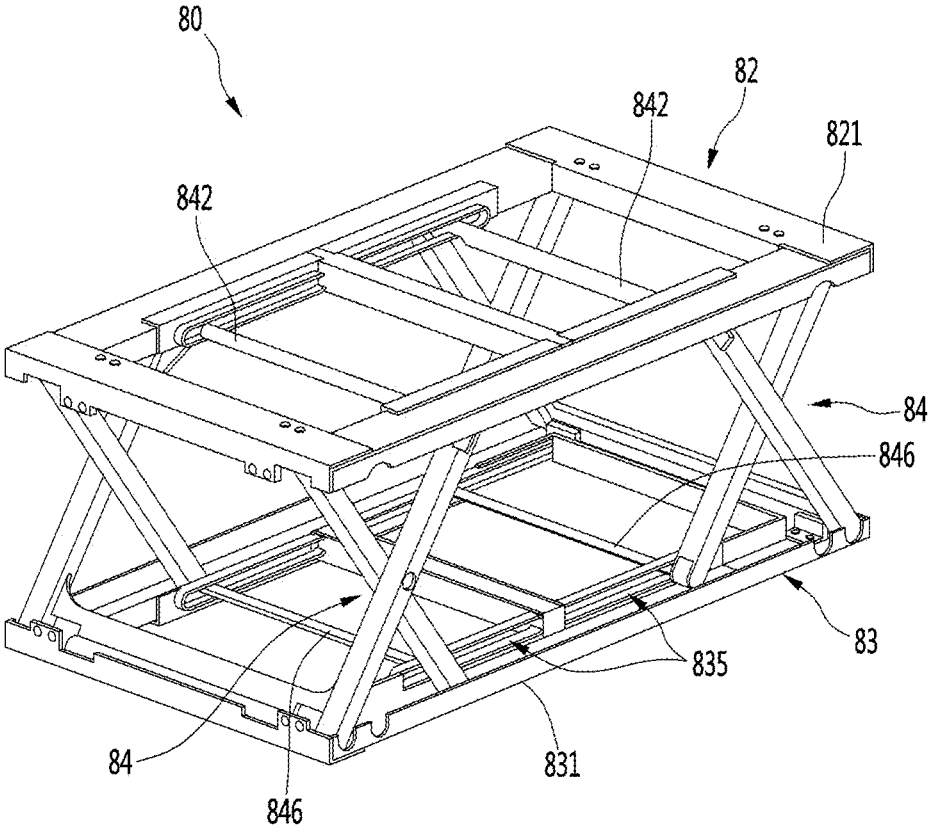
FIG. 23 is a perspective view of an elevation device according to an embodiment.
Figure 24:
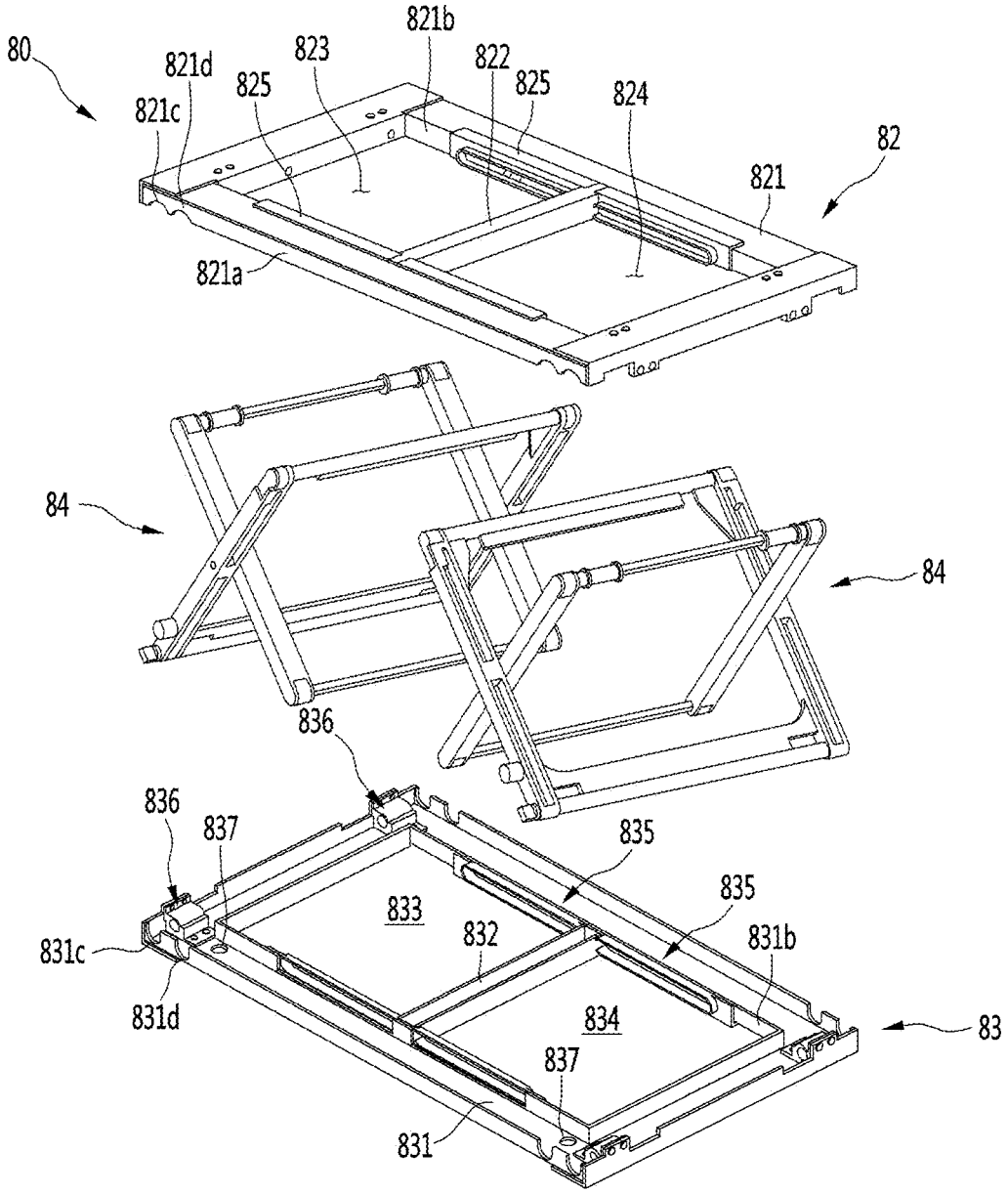
FIG. 24 is an exploded perspective view of the elevation device.
Figure 25:
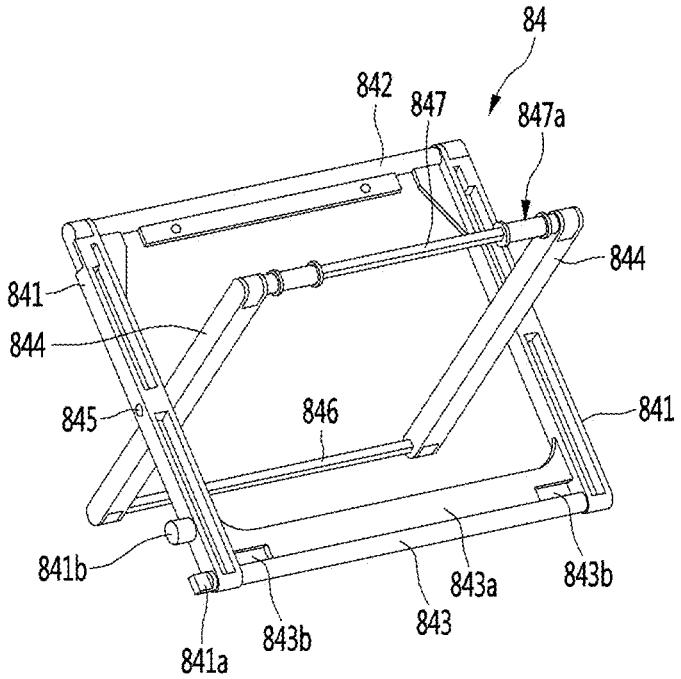
FIG. 25 is a perspective view of a scissors assembly that is one component of the elevation device.

FIG. 23 is a perspective view of an elevation device according to an embodiment. Also, FIG. 24 is an exploded perspective view of the elevation device. Also, FIG. 25 is a perspective view of the scissors assembly that is one component of the elevation device.

As illustrated in the drawings, the elevation device 80 may be provided on the bottom surface of the inner side of the drawer part 32 and may be detachably installed on the inside of the drawer part 32. Also, the elevation device 80 may include an upper frame 82 and a lower frame 83 as a whole and a scissors lift assembly 84 disposed between the upper frame 82 and the lower frame 83.

In detail, the upper frame 82 may have a square frame shape corresponding to the size of the inner front space S1 of the drawer part 32 and may be configured to mount the support plate 81 on the top surface thereof.

The upper frame 82 of the elevation device 80 may move upward and downward and substantially supports the food or the container 36 together with the support plate 81. Also, the upper frame 82 may generally defines a frame part 821 which defines a circumferential shape of the upper frame 82 and a partition part 822 for partitioning the space inside the frame portion 821 into left and right sides.

Since the frame part 821 and the partition part 822 define an outer frame and support the support plate 81, high strength may be required, and thus, the frame part 821 and the partition part 822 may be made of a metal and may have shape in which both ends are bent to increase the strength and prevent deformation.

Also, a slide guide 825 may be disposed on each of both sides of the inner side of the frame part 821 to accommodate the end of the scissors lift assembly 84 and guide the movement of the scissors lift assembly 84. The slide guides 825 may be disposed on both sides of the partition part 822. Also, the scissors assemblies 84 may be disposed in the spaces 823 and 824 on both sides partitioned by the partition part 822, respectively.

The slide guide 825 may be separately molded by using a plastic material having excellent abrasion resistance and lubrication performance and mounted on the upper frame 82. Also, a long hole 825*a* through which the sliding shaft 842 of the scissors lift assembly passes may be defined in the slide guide 825, and the sliding shaft 842 may move along the slide guide 825. Also, a sliding surface 825*b* having a predetermined width may be further disposed along the circumference of the lone hole 825*a*, and the sliding shaft 842 may be supported by the sliding surface 825*b* so that the scissors lift assembly 84 is more smoothly folded or unfolded.

The frame part 821 may include vertically curved edges 821*a* and 821*b* along the circumference thereof. The edges 821*a* and 821*b* may be disposed on the inner side and the outer side of the frame part 821, respectively. Also, the slide guide 825 may be disposed on the edge 821*b* inside the frame part 821. Also, edge grooves 821*c* and 821*d* may be defined in the outer edge 821*a* of the frame part 821.

The edge grooves 821*c* and 821*d* may be defined in the edge 821*a* by the grooves into which the rotation shaft 841*a* of the elevation device 80 and the scissors protrusion 841*b* are accommodated while the elevation device 80 completely descends and may include a first edge groove 821*c* and a second edge groove 821*d* corresponding to the rotation shaft 841*a* and the scissors protrusion 841*b* at the end of the first edge groove 821*c*. When the upper frame 82 completely descends to contact the lower frame 83, the upper frame 82 may contact the edge grooves 821*c* and 821*d* defined in the lower frame 83 to provide a complete hole shape so that the rotation shaft 841*a* and the scissors protrude 841*b* pass therethrough.

The edge grooves 821*c* and 821*d* may be defined in a number corresponding to the rotation shaft 841*a* when the scissors protrusion 841*b* is not provided but only the rotation shaft 841*a* is provided. The edge grooves 821*c* and 821*d* and the rotation shaft 841*a* and the scissors protrusion 841*b* may be disposed adjacent to the left and right ends of the elevation device 80 and may be exposed through the drawer opening 35.

The frame part 821 may define a space of which a bottom surface is opened by the edges 821*a* and 821*b* on both sides. Also, scissors fixing members (not shown, the same reference numeral 836) may be provided at both ends of the inner space of the frame part 821. The scissors fixing member (not shown, the same reference numeral 836) may fix the rotation shaft 847 of the scissors lift assembly 84, and a pair of scissors fixing members 826 may be provided at both ends. The scissors fixing member (not shown, the same reference numeral 836) may also be made of an engineering plastic material having abrasion resistance due to continuous friction with the rotating shaft 847. Also, the scissors fixing member (not shown, the same reference numeral 836) may have a through-hole through which the rotation shaft 847 passes.

A plurality of scissors fixing members 826 may be provided on both ends of the frame part 821 to fix both ends of the rotation shaft 847. The scissors fixing member 826 may stably fix the rotation shaft 847 to allow the scissors lift assembly 84 to be smoothly folded and unfolded.

The lower frame 83 may have the same structure as that of the upper frame 85 but only in the direction. The lower frame 83 may include a frame part 831 and a partition part 832 and define spaces 833 and 834 in which the scissors assemblies 84 are respectively installed.

Also, the slide guide 825 may be provided on the inner frame 821*b* of the frame part 821, and the first frame groove 831*c* and the second frame groove 831*d* may be defined in the outer frame 821*a*. Also, the scissors fixing member 826 may be provided in the inner space of the frame portion 821.

The outer frame 821*a* of the upper frame 82 and the outer frame 821*a* of the lower frame 83 may contact each other when the upper frame 82 completely move downward. Thus, the frame part 821 of the upper frame 82 and the frame part 821 of the lower frame 83 may contact each other to define a closed space therein, and the scissors lift assembly 84 may be accommodated in the closed space in the completely folded state. That is, the constituents of the scissors lift assembly 84 may be disposed inside the frame part 821 of the lower frame 82 and the upper frame 82 in the state in which the elevation device 80 descends to the lowest state.

Thus, the additional space for accommodating the scissors lift assembly 84 in addition to the upper frame 82 and the lower frame 83 may not be required so that the loss of storage chamber inside the drawer unit 32 is minimized.

Furthermore, since the support plate 81 also has a structure capable of accommodating the upper frame 82 and/or the lower frame 83, a space for arranging the upper frame 82 and the lower frame 83 may not be additionally required to minimize the space loss.

That is, even if the elevation device 80 having the complicated scissors type is disposed, a space loss equivalent to the thickness of the support plate 81 may be generated to very effectively utilize the interior of the drawer unit 32.

An elevation device fixing part 837 may be disposed on the bottom surface of the frame part 821 of the lower frame 83. The elevation device fixing part 837 may have an opened hole shape and have a protruding shape protruding from the bottom surface of the drawer part 32 when the elevation device 80 is mounted inside the drawer part 32 and may be combined in shape with an elevation device coupling part (not shown). That is, the elevation device 80 may be fixed to match the inside of the drawer part 32 by a simple operation that is seated inside the drawer part 32 and be maintained in the stable state even though the elevation device 80 operates. Also, the elevation device 80 may be easily lifted and separated from the drawer part 32 without any additional tool even if the elevation device 80 is not disposed in the drawer part 32.

The scissors lift assemblies 84 may be provided on both left and right sides of the scissors lift assembly 84. The scissors lift assemblies 84 may be connected to the connecting assembly 70 and may be independently driven by the power transmitted through the shaft 41 and the lever 42 to lift the upper frame 82. Here, the scissors lift assemblies 84 on both sides may not cause any misalignment or deviation in one of the driving motors 64 and the structure of the driving device 40 including the shaft 41 and the screw assembly 50 so as to provide a structure capable of being elevated by the same height.

Thus, the scissors lift assembly 84 may be effectively elevated by the pair of the scissors lift assemblies 84 which independently apply the forces to both sides even when the heavy load is supported by the scissors lift assembly 84. Here, the upper frame 82, i.e., the support plate 81 may be elevated in a horizontal state through the scissors lift assembly 84.

The scissors lift assembly 84 may include a pair of first rods 841 arranged in parallel to each other, a first sliding shaft 842 connecting both ends of the first rod 841, and a first rotation shaft 847.

Each of the first rod 841, the first sliding shaft 842, and the first rotation shaft 847 may have a width that is enough to be accommodated inside the frame part 821. Also, the first rod 841 may be disposed at a position corresponding to the region of the frame part 821, and the first rotation shaft 847 may also be disposed at a region corresponding to the frame part 821.

Also, the rotation shaft 841*a* and the scissors protrusion 841*b* may be disposed on one end of the first rod 841. Here, the rotation shaft 841*a* may be disposed on the same extension line as the first rotation shaft 847, and the first rotation shaft 847 may rotate when the rotation shaft 841*a* rotates.

The first rotation shaft 843 may further include a rotation enhancing part 843*a*. The rotation enhancing part 843*a* may be configured to connect a portion of the first rod 841 to the entire first rotation shaft 847. Thus, when the first rod 841 rotates, the first rotation shaft 847 may rotate together and also be enhanced to withstand the generated moment.

Also, a mounting hole 342*b* may be defined in each of both ends of the rotation enhancing part 843*a*, and the scissors fixing member 826 may be mounted to pass through the mounting hole 842*b*. Thus, the first rotation shaft 847 may be rotatably mounted on the scissors fixing member 826 of the lower frame 83.

Also, the first sliding shaft 842 may connect the other end of the first rod 841 and may be disposed to pass through the slide guide 825. Thus, the first sliding shaft 842 may move along the slide guide 825 of the upper frame 82 when the first rod 841 rotates.

Also, a pair of second rods 844 may be provided to cross the first rod 841. The first rod 841 and the second rod 844 may be connected to each other by the scissors shaft 845 so that the first rod 841 and the second rod 844 rotate in the state of crossing each other. A second sliding shaft 842 and a second rotating shaft 847 connecting both ends of the second rod 844 may be further provided.

The second rod 844, the second sliding shaft 842, and the second rotation shaft 847 may also have shapes and arrangements that are enough to be accommodated in the frame part 821. In this state, both the second rotation shafts 847 connecting the upper ends of the second rods 844 may be provided.

The second rotation shaft 847 may be rotatably mounted on the scissors fixing member 826 of the upper frame 82. Here, the second rotation shaft 847 passing through the scissors fixing member 826 may further include a rotation bush 847*a*. The rotation bush 847*a* may contact the inner surface of the scissors fixing member 826 and may be made of a plastic material having excellent lubrication performance and abrasion resistance. Thus, the operation of the scissors lift assembly 84 may be smoothly performed.

The lower ends of the second rods 844 disposed on both sides may be connected by the second sliding shaft 842. The second sliding shaft 846 may be mounted to pass through the slide guide 835 provided in the lower frame 83 and may move along the slide guide 835 as the elevation device 80 is elevated.

Hereinafter, the selective coupling and power connection of the elevation device 80 and the connecting assembly 70 will be described in more detail with reference to the drawings.

Figure 26:
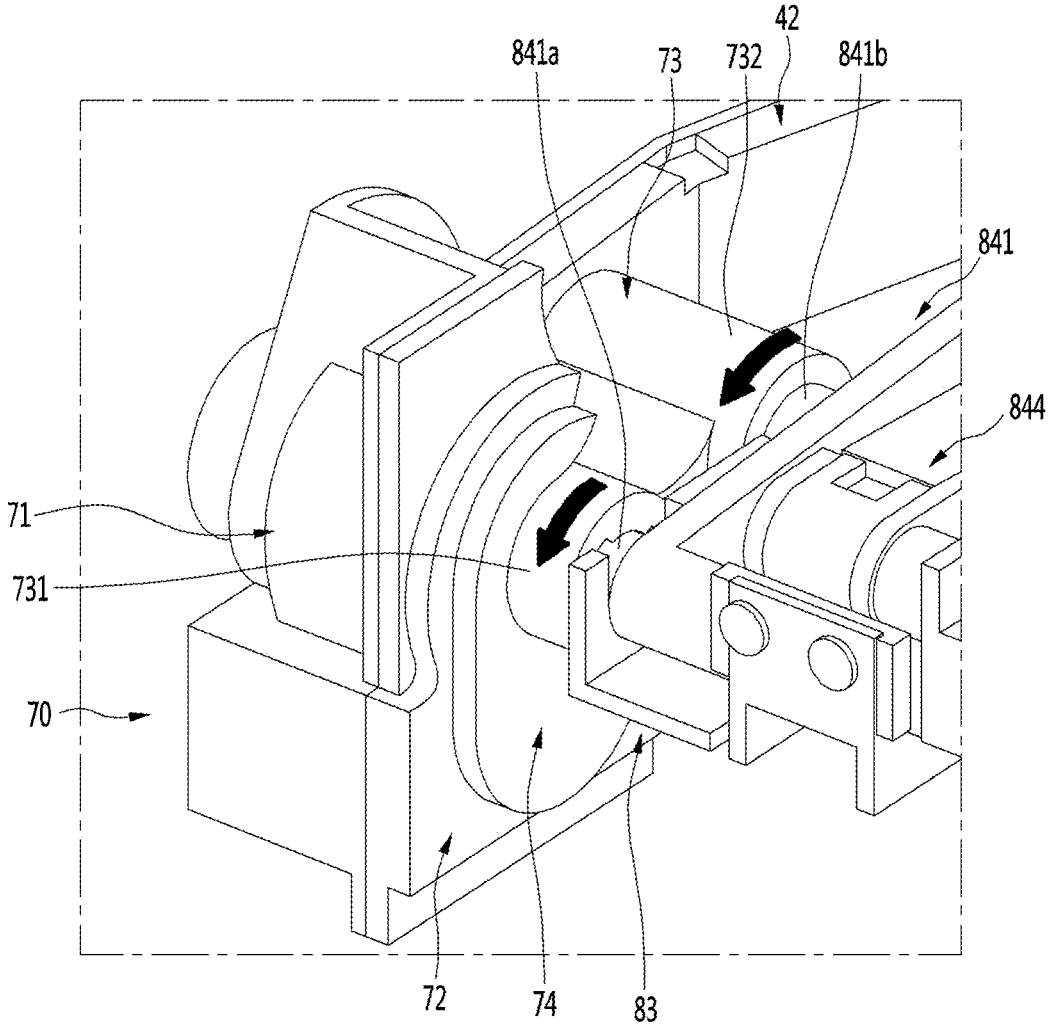
FIG. 26 is a perspective view illustrating a connection state between the connecting assembly and the elevation device.
Figure 27:
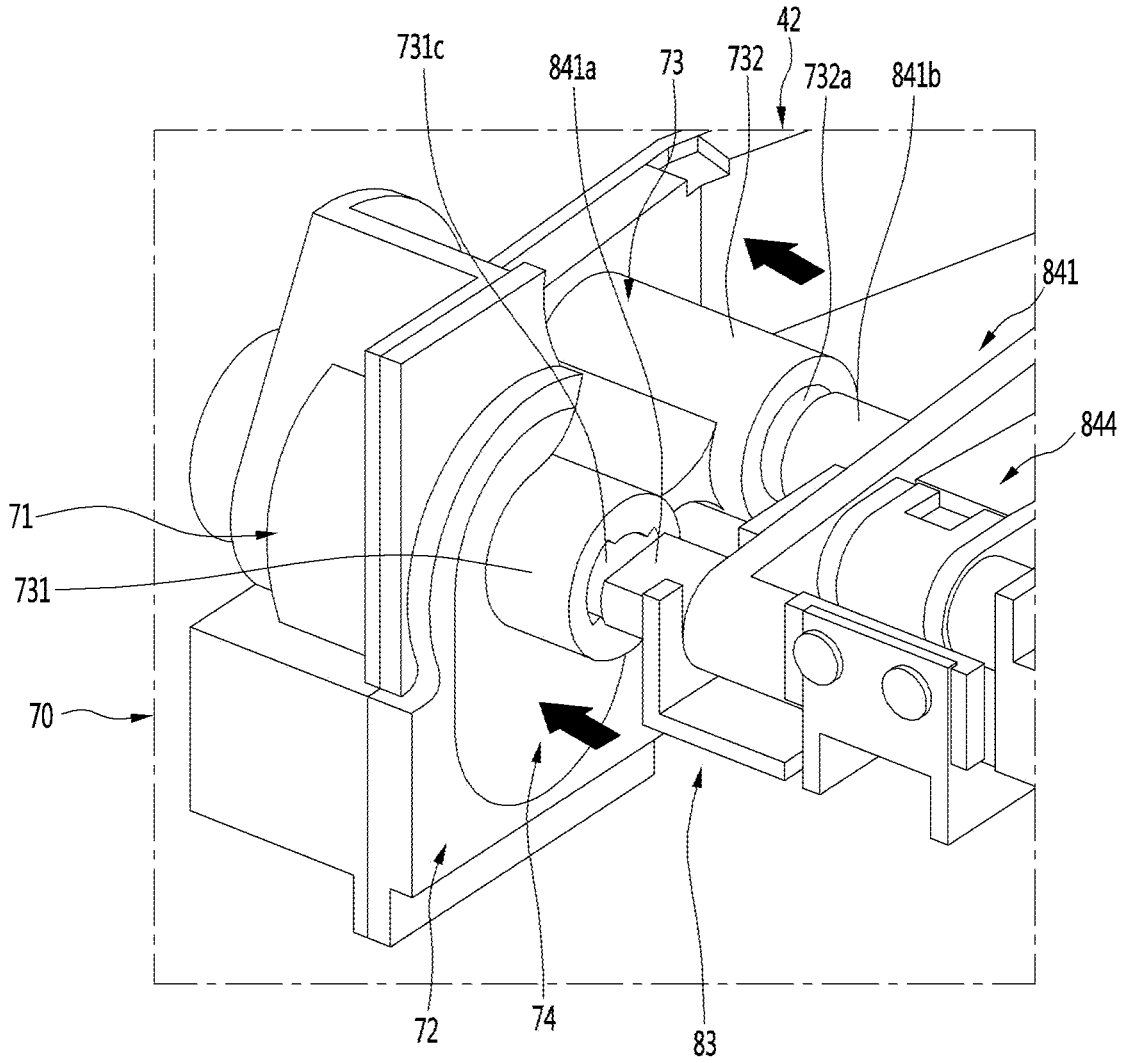
FIG. 27 is a perspective view illustrating a separation state of the connecting assembly and the elevation device.

FIG. 26 is a perspective view illustrating a connection state between the connecting assembly and the elevation device. Also, FIG. 27 is a perspective view illustrating a separation state of the connecting assembly and the elevation device.

As illustrated in the drawings, if the service of the driving device 40 or the elevation device 80 is necessary or if the use of the elevation device 80 is not desired, the driving device 40 and the elevation device 80 may be simply separated from and coupled to each other.

As illustrated in FIG. 26, the door part 31 and the drawer part 32 may be coupled to each other, and power transmission may be possible in the state in which the connecting assembly 70 and the elevation device 80 are connected to each other. Here, the connection member 73 may be connected to the lever 42 and the elevation device 80, and the first connection part 731 may be connected to the fixing shaft 77 and the rotation shaft 841*a* of the elevation device 80. The lever protrusion 425 and the scissors protrusion 841*b* may be inserted into the second connection part 732.

In this state, when the lever 42 rotates by the operation of the driving device 40, the rotation shaft 841*a* of the elevation device 80 may rotate by the first connection part 731, and the scissors assembly 84 of the elevation device 80 may rotate.

Here, since the second connection part 732 is connected to the scissors protrusion 841*b* of the elevation device 80, greater force may be transmitted to the elevation device 80. In detail, the second connection part 732 may be disposed at a position away from the first connection part 731, and thus when the first connection part 731 rotates around the shaft, a moment similar to a leverage may be applied to the second connection part 732. Thus, a moment greater than the moment generated at the first connection part 731 may be applied together with the second connection part 732, and thus the elevation device 80 may rotate with larger force.

Furthermore, since the pair of scissors lift assemblies 84 are disposed on both sides of the scissors lift assembly 84, the power may be transmitted to the scissors lift assembly 84, thereby effectively elevating the elevation device 80 with less force.

The connection member 73 may have a single shaft structure that connects the lever 42 to the rotation shaft 841*a* of the elevation device 80 when the torque by the driving device 40 is sufficient. The scissors lift assembly 84 may also be configured so that the connection member 73 is connected to each of both sides of one of the scissors lift assemblies 84 to elevate the elevation device 80.

The user may push the push member 74 of the connecting assembly 70 to push the connection member 73 as illustrated in FIG. 27 in the state in which the service condition of the driving device or the elevation device 80 of the refrigerator 1 occurs. The coupling between the connection member 73 and the elevation device 80 may be released by allowing the connection member 73 to move forward.

In this state, the door part 31 may be separated from the drawer part 32, and the entire driving part 40 provided in the door part 31 may be completely separated from the drawer part 32 by a single operation.

The driving part 40 may be maintained in the state in which the door part 31 is separated, and the door part 31, which normally operates as necessary, may be replaced to be mounted. Here, the connection member 73 of the door part 31 may be coupled to the rotation shaft 841*a* and the scissors protrusion 841*b* of the elevation device without separate assembly and disassembly.

The door part 31 and the drawer part 32 may be rigidly coupled to each other by the door frame or other structure, and the door part 31 and the drawer part 32 may be additionally separated from or coupled to each other when the door part 31 and the drawer part 32 are separated from or coupled to each other.

Hereinafter, a state in which the drawer door 30 of the refrigerator 1 is inserted and withdrawn and is elevated according to an embodiment will be described in more detail with reference to the accompanying drawings.

Figure 28:
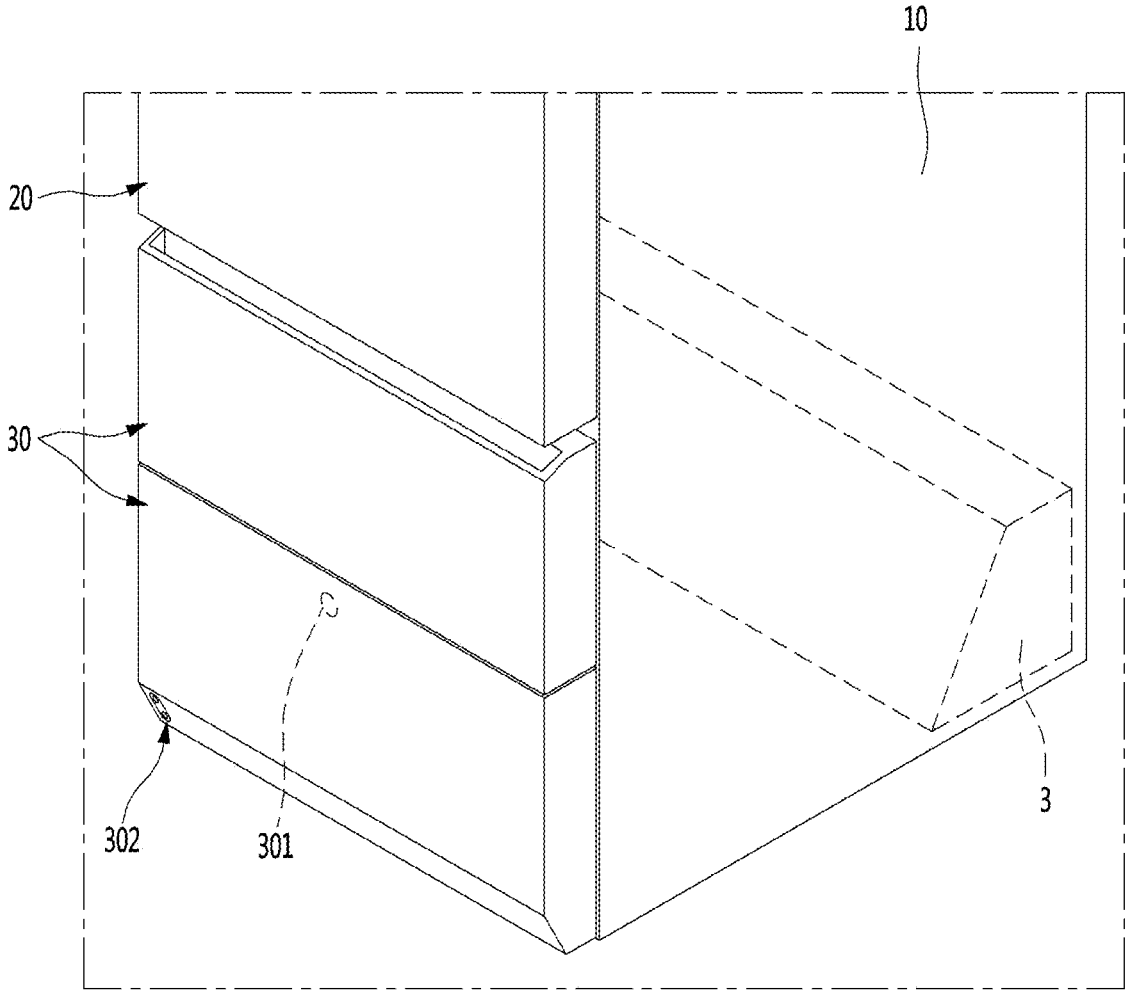
FIG. 28 is a perspective view illustrating a state in which the drawer door is closed.

FIG. 28 is a perspective view illustrating a state in which the drawer door is closed. Also, FIG. 29 is a perspective view illustrating a state of the wiring guider in a state in which the drawer door is closed.

As illustrated in the drawing, in the state in which the food is stored, the refrigerator 1 may be maintained in a state in which all of the rotation door 20 and the drawer door 30 are closed. In this state, the user may withdraw the drawer door 30 to accommodate the food.

Figure 29:
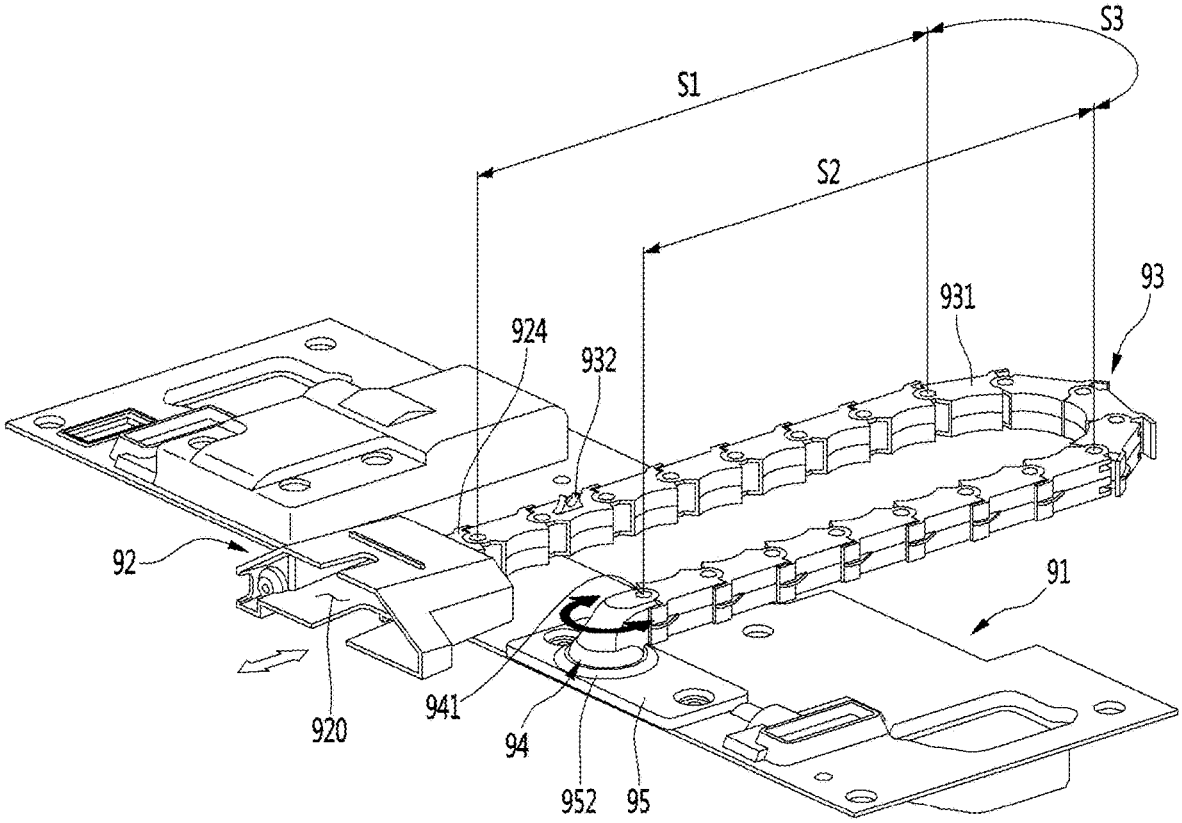
FIG. 29 is a perspective view illustrating a state of the wiring guider in a state in which the drawer door is closed.

When the drawer door 30 is completely closed, the wiring guider 90 may be maintained in the U shape as illustrated in FIG. 29. The guide head 92 may be disposed at a position adjacent to the front end of the cabinet 10 and also be disposed at the rearmost position.

In this state, the wiring 962 may be guided to the door part 31 through the wiring guider 90 and be maintained in the electrically connected state so that the electronic components within the door part 31 in addition to the driving device 40 are driven.

The drawer door 30 may be provided in plurality in a vertical direction and be withdrawn to be opened by the user's manipulation. Here, the user's manipulation may be performed by touching the manipulation part 301 disposed on the front surface of the rotation door 20 or the drawer door 30. Alternatively, an opening command may be inputted on the manipulation device 302 provided on the lower end of the drawer door 30. Also, the manipulation part 301 and the manipulation device 302 may individually manipulate the insertion and withdrawal of the drawer door 30 and the elevation of the elevation member 80. Alternatively, the user may hold a handle of the drawer door 30 to open the drawer door 30.

Hereinafter, although the lowermost drawer door 30 of the drawer doors 30, which are disposed in the vertical direction, is opened and elevated as an example, all of the upper and lower drawer doors 30 may be inserted and withdrawn and elevated in the same manner.

Figure 30:
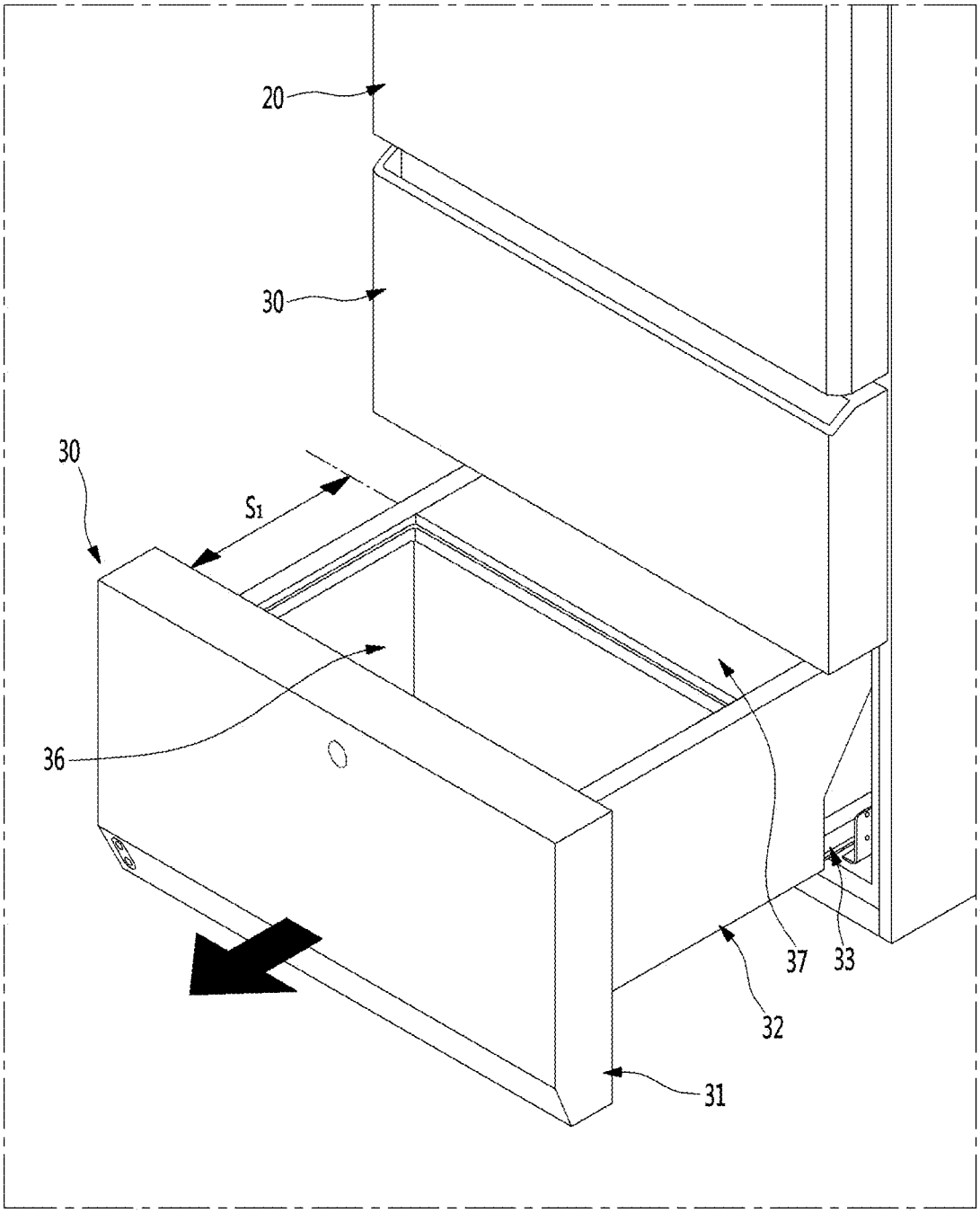
FIG. 30 is a perspective view illustrating a state in which the drawer door is completely withdrawn.
Figure 31:
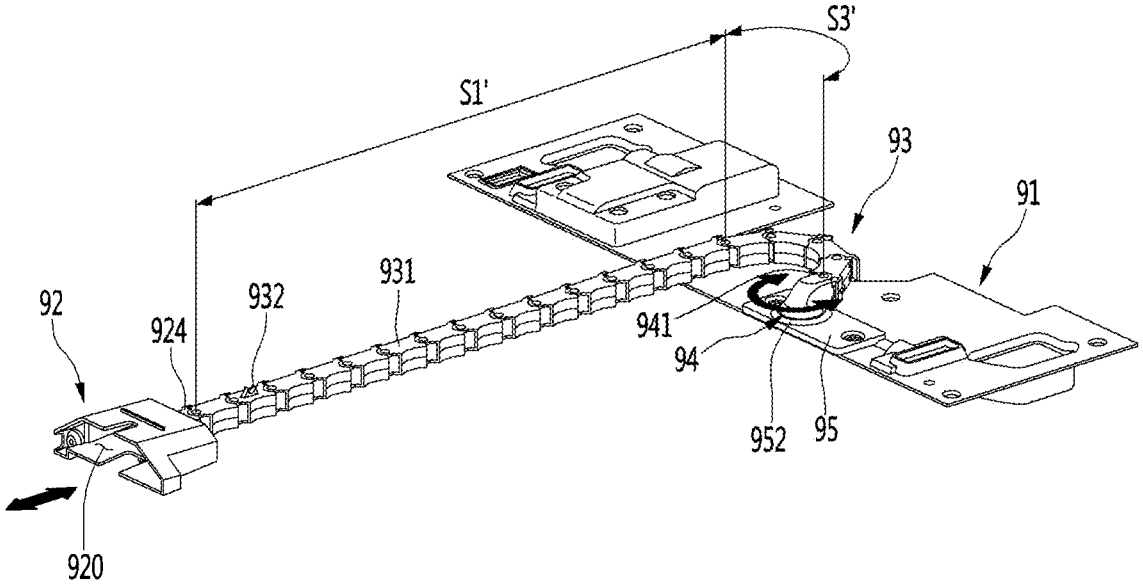
FIG. 31 is a perspective view illustrating a state of the wiring guider in a state in which the drawer door is withdrawn.
Figure 32:
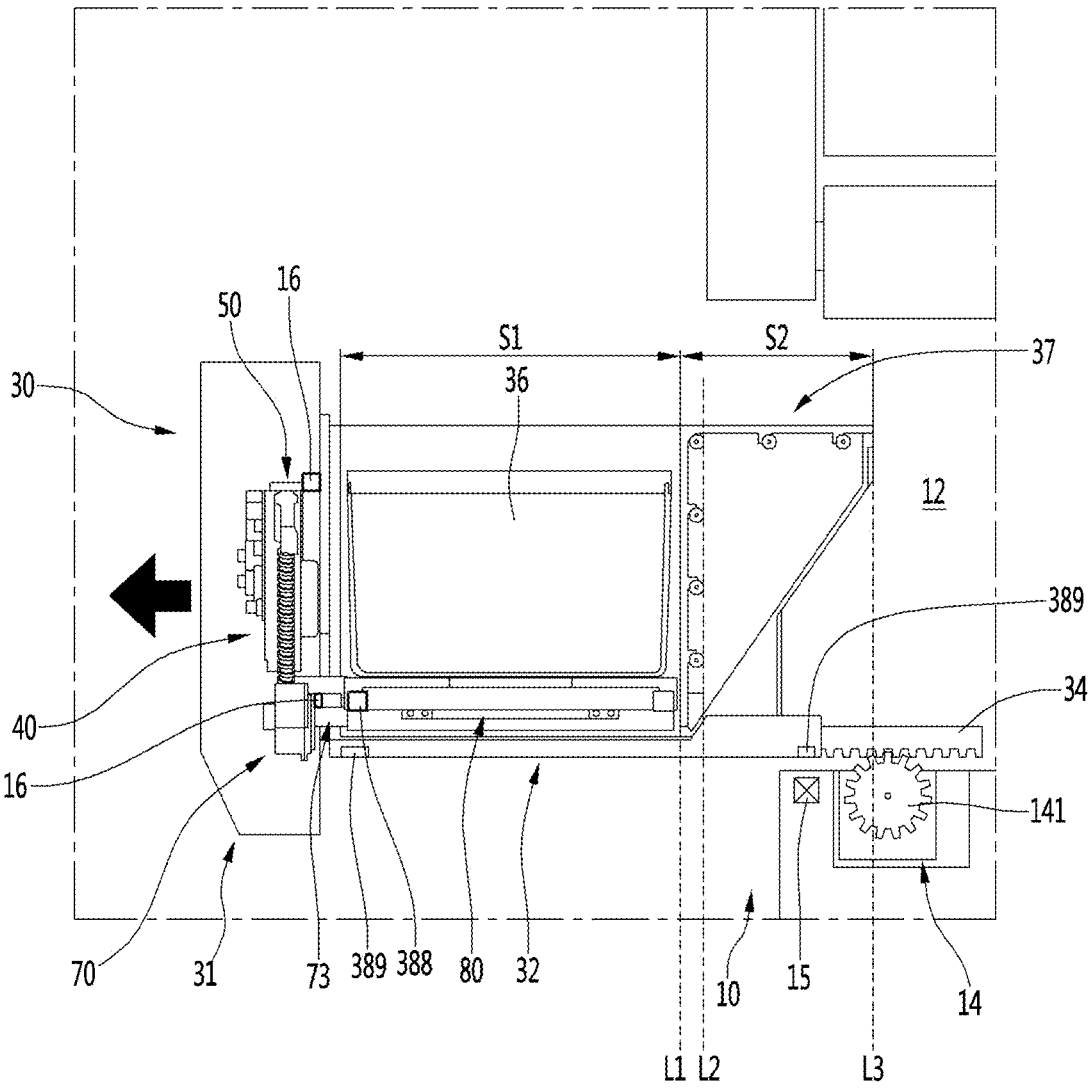
FIG. 32 is a cross-sectional view illustrating a state of the drawer door in a state in which the basket of the drawer door completely descends.

FIG. 30 is a perspective view illustrating a state in which the drawer door is completely opened. Also, FIG. 31 is a perspective view illustrating a state of the wiring guider in the state in which the drawer door is withdrawn. Also, FIG. 32 is a cross-sectional view illustrating a state of the drawer door in a state in which the basket of the drawer door completely descends.

As illustrated in the drawings, the user may manipulate the draw-out operation on the drawer door 30 to withdraw the drawer door 30 forward. The drawer door 30 may be withdrawn while the draw-out rail 33 extends.

The drawer door 30 may be configured to be inserted and withdrawn by the driving of the draw-out motor 14, not by a method of directly pulling the drawer door 30 by the user. The draw-out rack 34 provided on the bottom surface of the drawer door 30 may be coupled to the pinion gear 141 rotating when the draw-out motor 14 provided in the cabinet 10 is driven. Thus, the drawer door 30 may be inserted and withdrawn according to the driving of the draw-out motor 14.

The draw-out distance of the drawer door 30 may correspond to a distance at which the front space S1 within the drawer part 32 is completely exposed to the outside. Thus, in this state, when the elevation device 80 is elevated, the container or the food may not interfere with the doors 20 and 30 or the cabinet 10 disposed thereabove.

Here, the draw-out distance of the drawer door 30 may be determined by a draw-out detection device 15 disposed on the cabinet 10 and/or the drawer door 30. The draw-out detection device 15 may be provided as a detection sensor that detects a magnet 389 to detect a state in which the drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the drawer door 30 is closed and a position of the magnet 389 when the drawer door 30 is completely withdrawn. Thus, the draw-out state of the drawer door 30 may be determined by the draw-out detection device 15.

Also, as necessary, a switch may be provided at each of positions at which the drawer door 30 is completely inserted and withdrawn to detect the draw-out state of the drawer door 30. In addition, the draw-out state of the drawer door 30 may be detected by counting the rotation number of draw-out motor 14 or measuring a distance between the rear surface of the door part 31 and the front end of the cabinet 10.

When the drawer door 30 is withdrawn, the guide head 92 coupled to the rear surface of the door part 31 may also move forward together with the door part 31. When the guide head 92 moves forward, the flexible portions 93 connected to the guide head 92 may also move forward together.

Thus, the plurality of flexible portions 93 may move in the state of being connected to each other. Also, some of the flexible portions 93 may rotate. Thus, the flexible portions 93 may freely rotate according to the movement of the drawer door 30.

Also, when the drawer door 30 is completely withdrawn as illustrated in FIG. 31, much of the flexible portions 93 may move forward and thus may have a "T" shape or "J" shape as illustrated in FIG. 31.

In detail, when compared to the state in which the drawer door is inserted, a linear section S1' connected to the guide head 92 may increase in length on a whole. Also, a bent section S3' and the linear section S2 connected to the rotation connection member 94 may be reduced or actually removed. Also, here, the rotation connection member 94 may rotate in the direction in which the flexible portions 93 move.

Here, the rotation connection member 94 may also rotate according to the states of the flexible portions 93 to prevent the flexible portions 93 from being deformed or damaged by excessive force.

In the state in which the drawer door 30 is completely withdrawn, the elevation motor 64 may be driven to elevate the elevation device 80. The elevation device 80 may be driven in an even situation in which the drawer door 30 is sufficiently withdrawn to secure safe elevation of the food or container 36 seated on the elevation device 80.

That is, in the state in which the drawer door 30 is withdrawn to completely expose the front space S1 to the outside, the elevation device 80 may ascend to prevent the container 36 or the stored food seated on the elevation device 80 from interfering with the doors 20 and 30 or the cabinet 10.

In details of the draw-out state of the drawer door 30, the front space S1 has to be completely withdrawn to the outside of the lower storage chamber 12 in the state in which the drawer door 30 is withdrawn for the elevation.

Particularly, the rear end L1 of the front space S1 has to be more withdrawn than the front end L2 of the cabinet 10 or the upper door 20. Also, the rear end L1 of the front space S1 is disposed at a further front side than the front end L2 of the cabinet 10 or the door 20 so at to prevent the elevation device 80 from interfering when the elevation device 80 is elevated.

Also, when the elevation device 80 is completely withdrawn to be driven, the entire drawer part 32 may not be completely withdrawn but withdrawn up to only a position for avoiding interference when the elevation device 80 is elevated as illustrated in FIG. 32. Here, at least a portion of the rear space S2 of the drawer part 32 may be disposed inside the lower storage chamber 12. That is, the rear end L3 of the drawer part 32 may be disposed at least inside the lower storage chamber 12.

Thus, even when the weight of the stored object is added to the weight of the drawer door 30 itself including the driving device 40 and the elevation device 80, the deflection or damage of the draw-out rail 33 or the drawer door 30 itself may not occur to secure the reliable draw-out operation.

The ascending of the elevation device 80 may start in a state in which the drawer door 30 is completely withdrawn. Also, to secure the user's safety and prevent the food from being damaged, the ascending of the elevation device 80 may start after a set time elapses after the drawer door 30 is completely withdrawn.

After the drawer door 30 is completely withdrawn, the user may manipulate the manipulation part 301 to input the ascending of the elevation device 80. That is, the manipulation part 301 may be manipulated to withdraw the drawer door 30, and the manipulation part 301 may be manipulated again to elevate the elevation device 80.

Also, in the state in which the drawer door 30 is manually inserted and withdrawn, the manipulation part 301 may be manipulated to elevate the elevation device 80.

As illustrated in FIG. 32, the driving device 40 and the elevation device 80 may not operate until the drawer door 30 is completely withdrawn, and the elevation device 80 may be maintained in the lowest state.

Figure 33:
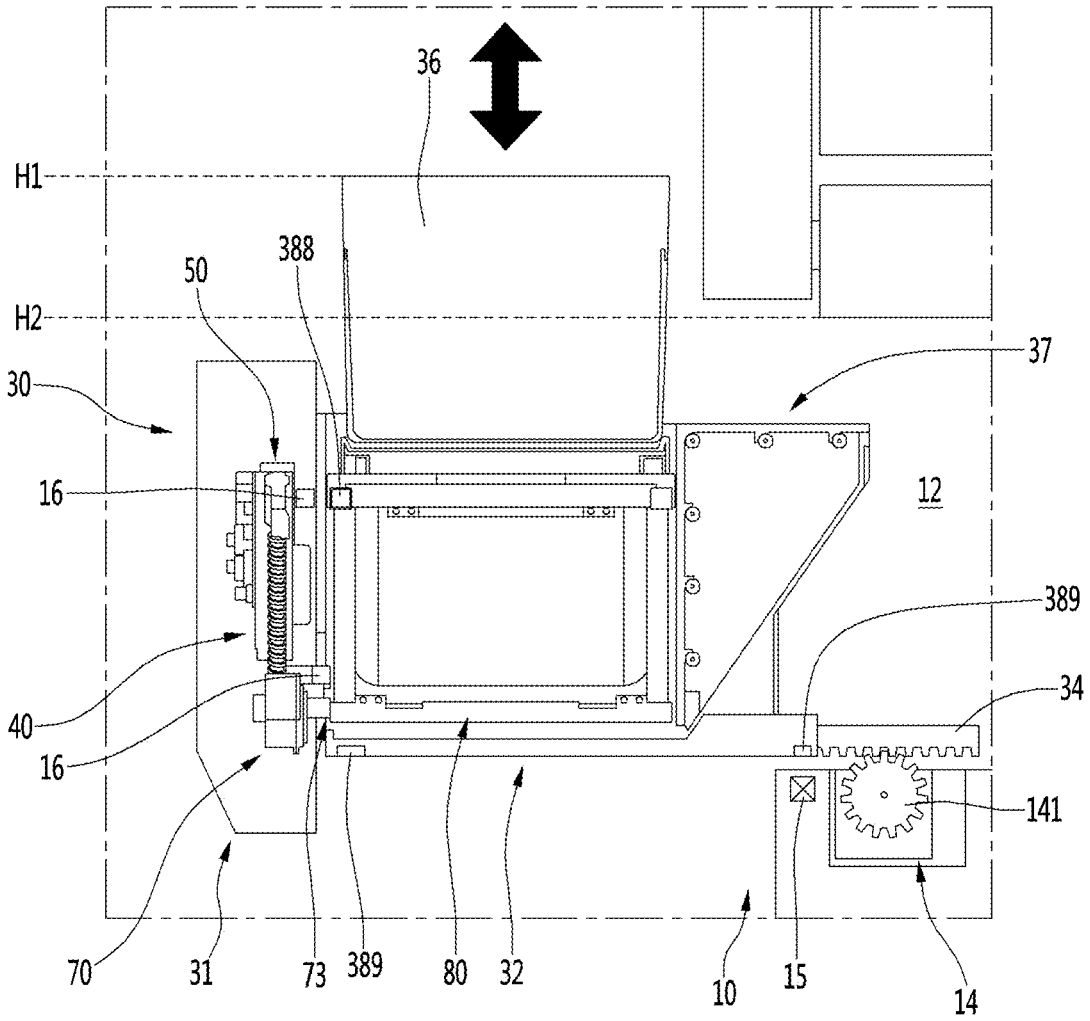
FIG. 33 is a cross-sectional view illustrating a state of the drawer door in a state in which the basket of the drawer door completely ascends.

FIG. 33 is a cross-sectional view illustrating a state of the drawer door in a state in which the basket of the drawer door completely ascends.

As illustrated in FIG. 32, in the state in which the drawer door 30 is withdrawn, when the operation signal of the driving device is inputted, the driving device 40 may operate, and the state as illustrated in FIG. 33 may be obtained by elevating the elevation device 80.

The driving device 40 may be connected to the elevation device 80 by the connecting assembly 70 so that the power is transmitted to the elevation device 80. The power may be transmitted to the elevation device 80 by the connecting assembly 70 together with the operation of the driving device 40, and the elevation device 80 may start to ascend.

Figure 34:
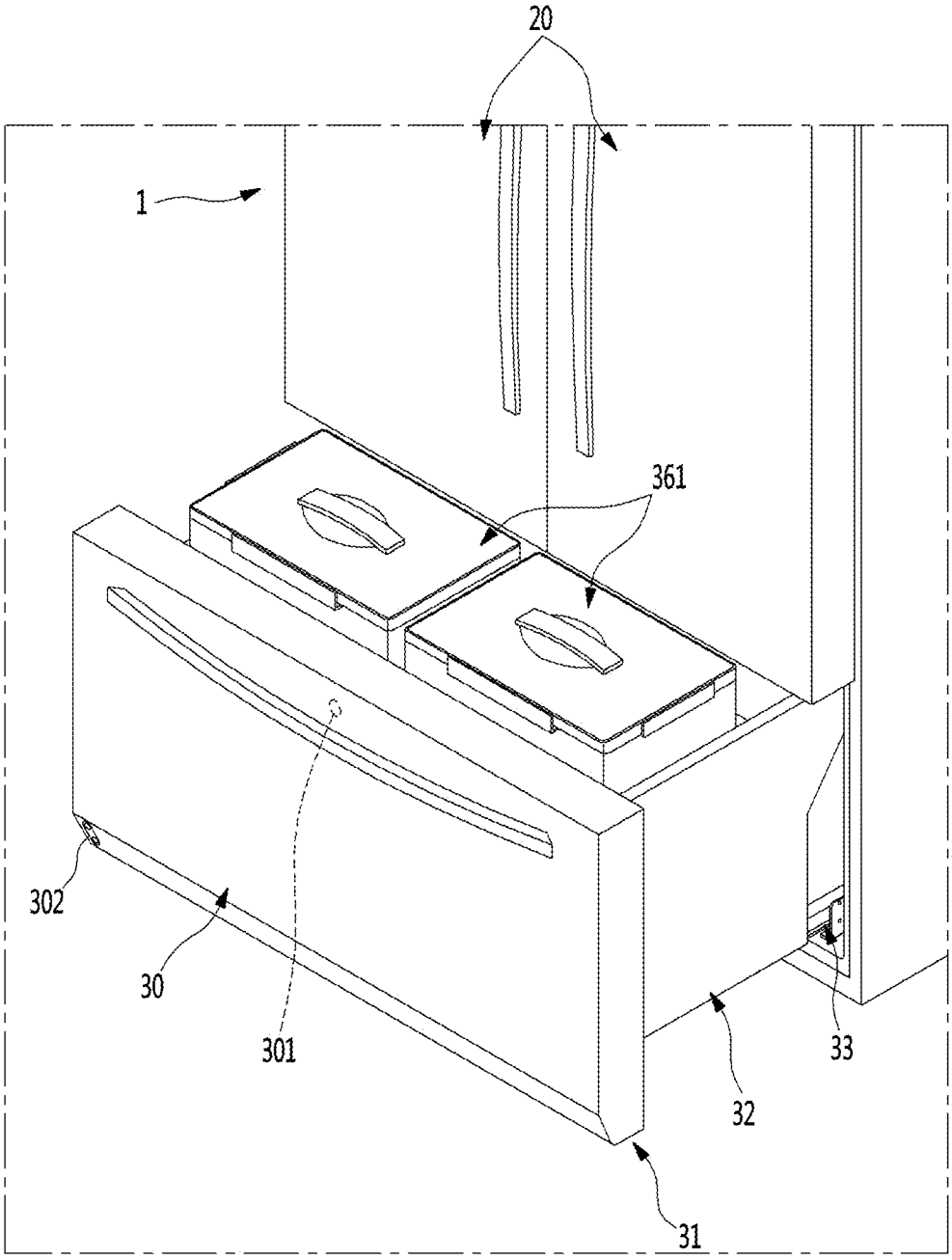
FIG. 34 is a perspective view of a refrigerator according to another embodiment.

The elevation device 80 may continuously ascend and then be stopped when ascend to a sufficient height to facilitate access to the food or container 36 seated on the elevation device 80 as illustrated in FIG. 34. In this state, the user may easily lift the food or container 36 without overtaxing the waist.

When the elevation completion signal of the elevation device 80 is inputted, the driving of the driving motor 64 may be stopped. For this, an elevation detection device 16 capable of detecting the position of the elevation device 80 may be provided. The elevation detection device 16 may be provided on the door part 31 and may be disposed at a position corresponding to the maximum height of the elevation device 80 and at a position corresponding to the lowest height of the elevation device 80.

The elevation detection device 16 may be provided as a detection sensor that detects a magnet 388. The elevation detection device 16 may detect the magnet 388 disposed on the elevation device 80 to determine whether the ascending of the elevation device 80 is completed. Also, the elevation detection device 16 may be provided as a switch structure to turn on the switch when the elevation device 80 maximally ascends. Also, the elevation detection device 16 may be provided on the elevation rail 44 or the screw 52 to detect the maximally ascending position of the elevation member 80.

Also, whether the elevation device 80 maximally ascends may be determined according to a variation in load applied to the elevation motor 64.

The driving of the elevation motor 64 is stopped in the state in which the elevation device 80 maximally ascends. In this state, although the elevation device 80 is disposed inside the drawer part 32, the food or container 36 seated on the elevation device 80 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

In details of the maximally ascending state of the elevation device 80, the elevation device 80 may be elevated by driving the driving device 40 and be disposed at least at a lower position than the upper end of the drawer part 32.

In the driving device 80, when viewed with respect to the container 36 in the state in which the container 36 is seated, the upper end H1 of the container 36 may ascend to a position higher than the upper end H2 of the lower storage chamber 12. Here, the height of the container 36 may reach a height suitable for the user to reach the container 36 without stretching his/her waist.

That is, the driving device 40 may have a structure in which the container 36 ascends from the inside of the drawer part 32. However, when the container 36 is mounted on the elevation device 80, the container 36 may be disposed at an accessible height.

After the user's food storing operation is completed, the user may allow the elevation device 80 to descend by manipulating the manipulation part 301. The descending of the elevation device 80 may be performed by reverse rotation of the elevation motor 64 and may be gradually performed through the reverse procedure with respect to the above-described procedure.

Also, when the descending of the elevation device 80 is completed, i.e., in the state of FIG. 31, the completion of the descending of the elevation device 80 may be performed by the elevation detection device 16. The elevation detection device 16 may be further provided at a position that detects the magnet 388 disposed on the elevation device 80 when the elevation device 80 is disposed at the lowermost descending position. Thus, when the completion of the descending of the elevation device 80 is detected, the driving of the driving motor 40 is stopped.

Also, after the driving of the driving motor 64 is stopped, the drawer door 30 may be inserted. Here, the drawer door 30 may be closed by the user's manipulation or by the driving of the draw-out motor 14. When the drawer door 30 is completely closed, a state of FIG. 29 may become.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

FIG. 34 is a perspective view of a refrigerator according to another embodiment.

As illustrated in the drawing, a refrigerator 1 according to another embodiment may include a cabinet 10 having a storage chamber that is vertically partitioned and a door 2 opening and closing the storage chamber.

The door 2 may include a rotation door 20 which is provided in an upper portion of a front surface of the cabinet 10 to open and close an upper storage chamber and a drawer door 30 disposed in a lower portion of the front surface of the cabinet 10 to open and close a lower storage chamber. The drawer door 30 may be inserted and withdrawn forward and backward in the above embodiment. In the state in which the drawer door 30 is withdrawn, the container and the food inside the drawer part 32 may be vertically elevated by the operation of the driving device 40 and the elevation device 80 inside the drawer door 30.

The elevation device 80 may be provided in the region of the front space of the inside of the drawer part 32. Thus, the elevation device 80 may elevate the food in the region of the front space among the entire region of the drawer part 32.

A manipulation part 301 or a manipulation device 302 may be provided at one side of the door part 31, and the driving part 40 may be installed inside the door part 31. Also, the pulling-out operation of the drawer door 30 and/or the elevation of the elevation device 80 may be carried out by the manipulation of the manipulation part 301 or the manipulation device 302.

The drawer part 32 may be provided with the elevation device 80. The elevation device 80 may be elevated by a connecting assembly that connects the driving device to the elevation device. Since the constituent of the drawer door 30 and constituent of the driving device 40 and the elevation device 80 are the same as those according to the foregoing embodiment, their detailed descriptions will be omitted.

A plurality of containers 361 may be provided in the elevation device 80. The container 361 may be a sealed container such as a kimchi passage, and a plurality of the containers 361 may be seated on the elevation device 80. The container 361 may be elevated together with the elevation device 80 is elevated. Thus, in the state in which the container 361 ascends, at least a portion of the drawer part 32 may protrude, and thus, the user may easily lift the container 361.

The elevation device 80 may interfere with the rotation door 20 in the rotation door 20 is opened even though the drawer door 30 is withdrawn. Thus, the elevation device 80 may ascend in a state in which the rotation door 20 is closed. For this, a door switch for detecting the opening/closing of the rotation door 20 may be further provided.

Also, although not shown, the wiring guider 90 connecting the door part 31 to the cabinet 10 may be disposed below the drawer door 30. The wiring guider 90 may have the same configuration and arrangement as the forgoing embodiment.

Figure 35:
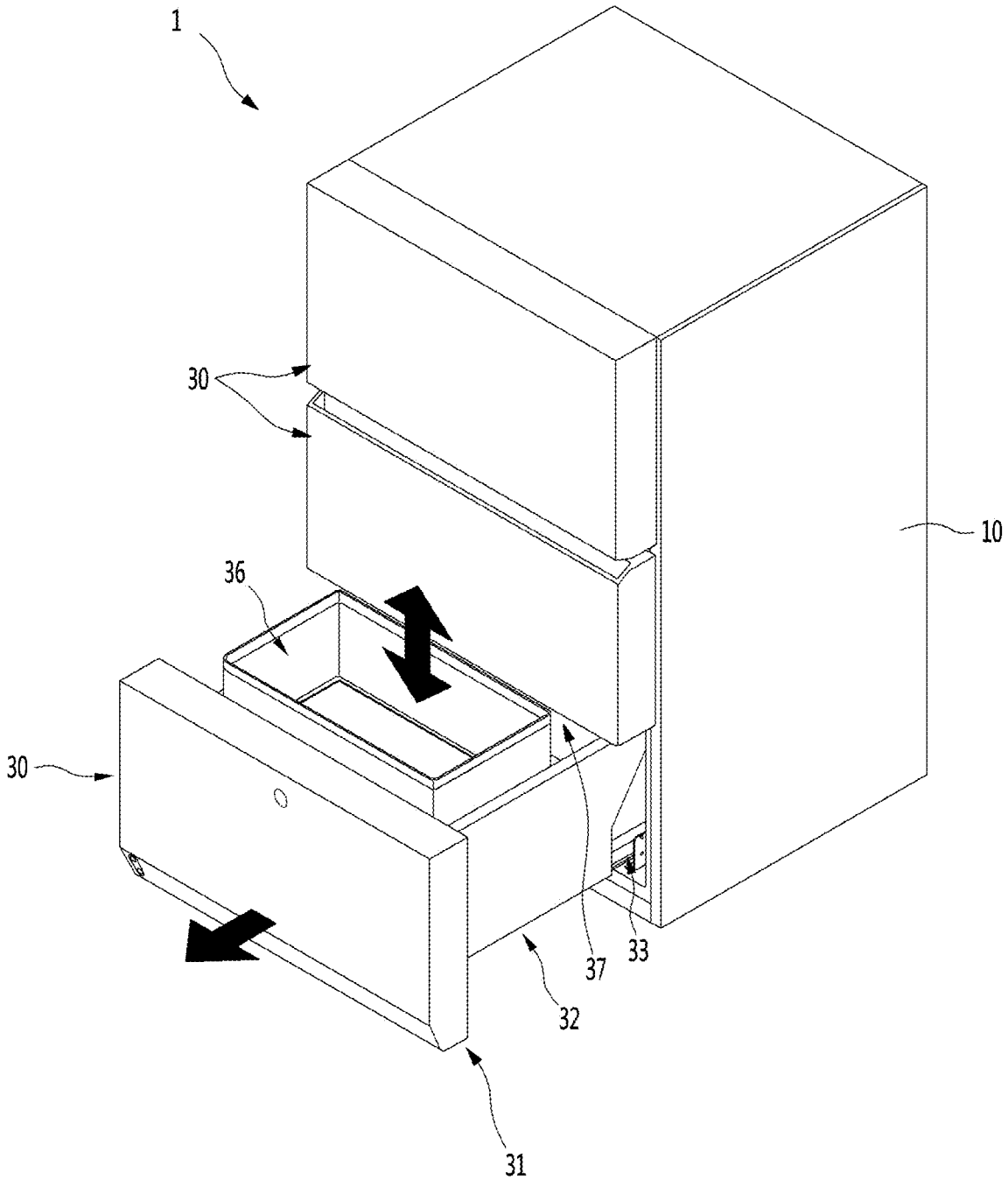
FIG. 35 is a perspective view of a refrigerator according to another embodiment.

FIG. 35 is a perspective view of a refrigerator according to another embodiment.

As illustrated in the drawings, a refrigerator 1 according to another embodiment includes a cabinet 10 defining a storage chamber therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of the drawer doors 30 may be continuously arranged in the vertical direction. Also, the drawer doors 30 may be independently withdrawn by the user's manipulation. The drawer door 30 may be provided with the driving device 40 and the elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

The insertion and withdrawal of the drawer door 30 and the elevation of the elevation device 80 may be individually performed. After the drawer door 30 is withdrawn, the elevation device 80 may ascend. Then, after the elevation device 80 descends, the insertion of the drawer door 30 may be continuously performed.

Also, when the plurality of drawer doors 30 are vertically arranged, the elevation device 80 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the elevation device 80 ascends in the state in which the drawer door 30 that is disposed at the uppermost side is withdrawn in FIG. 35, all of the drawer doors 30 disposed at the upper side may also be elevated by the elevation device 80 that is provided inside.

If a height of each of the drawer doors 30 disposed at the upper side is sufficiently high, only the drawer door 30 disposed at the lowermost position or the elevation device 80 of the of drawer doors 30 disposed relatively downward may be elevated.

Also, although not shown, the wiring guider 90 connecting the door part 31 to the cabinet 10 may be disposed below the drawer door 30. The wiring guider 90 may have the same configuration and arrangement as the forgoing embodiment.

Figure 36:
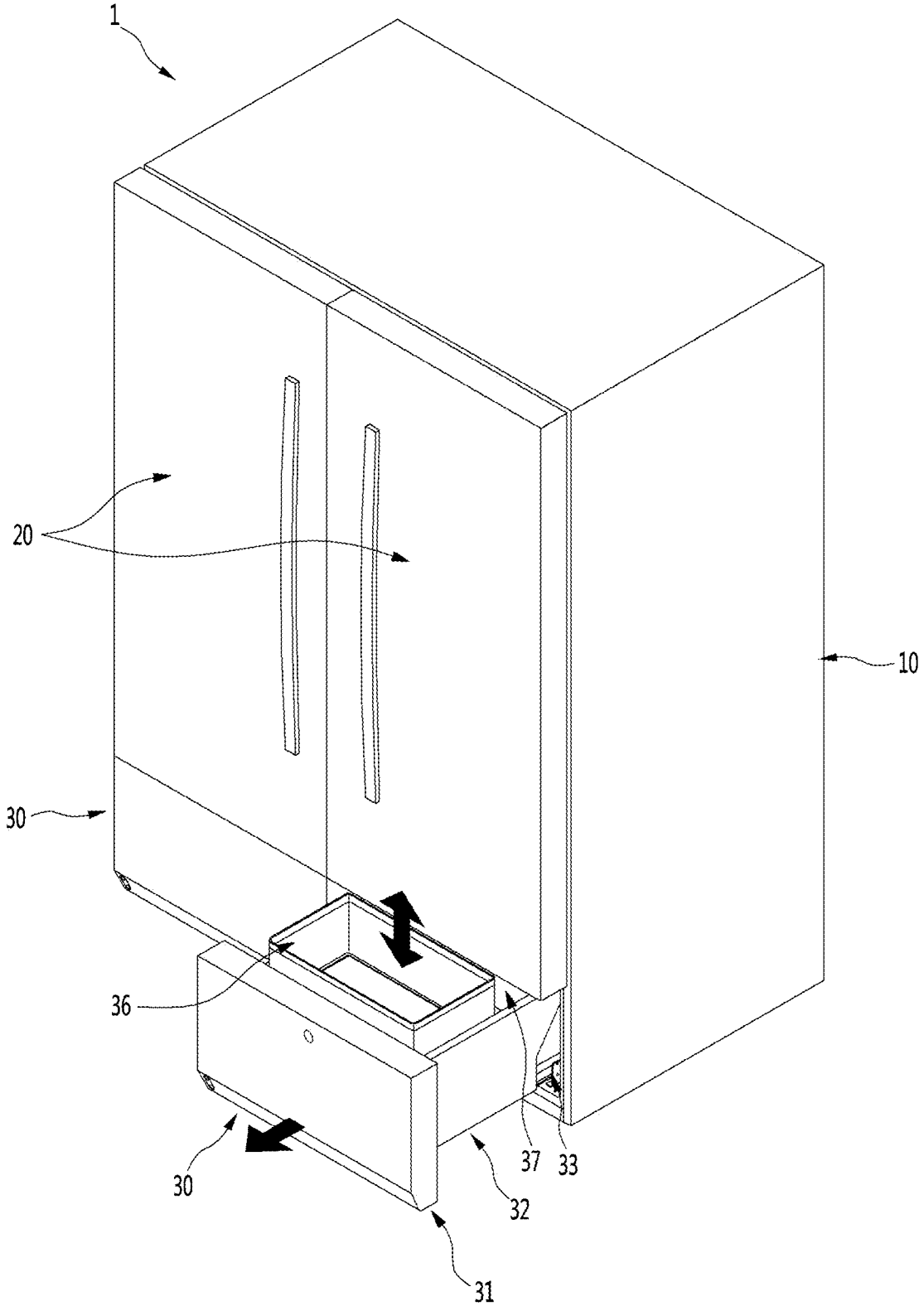
FIG. 36 is a perspective view of a refrigerator according to another embodiment.

FIG. 36 is a perspective view of a refrigerator according to another embodiment.

As illustrated in the drawings, a refrigerator 1 according to another embodiment includes a cabinet 10 defining a storage chamber therein and a door 2 opening and closing an opened front surface of the cabinet 10, which define an outer appearance of the refrigerator 1.

The inside of the cabinet 10 may be divided into an upper space and a lower space. If necessary, the upper and lower storage chambers may be divided again into left and right spaces.

The door 2 may include a rotation door 20 which is provided in an upper portion of the cabinet 10 to open and close the upper storage chamber and a drawer door 2 disposed in a lower portion of the cabinet 10 to open and close the lower storage chamber.

Also, the lower space of the cabinet may be divided into left and right spaces. The drawer door 30 may be provided in a pair so that the pair of drawer doors 30 respectively open and close the lower spaces. A pair of the drawer doors 30 may be arranged on both sides of the right and left sides of the drawer door 30. The drawer door 30 may include the driving device 40 and an elevation device 80.

The driving part 40 may be installed in the door part 31, and the elevation part 80 may be provided inside the drawer part 32. Also, the driving device 40 and the elevation device 80 may be connected to each other by the connecting assembly 70 when the door part 31 and the drawer part 32 are coupled to each other. Also, the elevation device 80 may be disposed in the front space S1 of the total storage chamber of the drawer part 32.

The drawer door 30 may have the same structure as the drawer door according to the foregoing embodiment. Thus, the drawer door 30 may be inserted and withdrawn by user's manipulation. In the drawer door 30 is withdrawn, the elevation device 80 may ascend so that a user more easily accesses a food or container within the drawer door 30.

Also, although not shown, the wiring guider 90 connecting the door part 31 to the cabinet 10 may be disposed below the drawer door 30. The wiring guider 90 may have the same configuration and arrangement as the forgoing embodiment.

The following effects may be expected in the refrigerator according to the proposed embodiments of the present invention.

The refrigerator according to the embodiment, the portion of the storage chamber within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the elevation within the drawer door may ascend up to a convenient position by driving the driving device to prevent the user from being injured and significantly improve the convenience in use.

Also, the driving device constituted by the electric devices for providing the power may be provided inside the door part, and the elevation device for the elevation may be provided inside the drawer part so that the driving device and the elevation device are not exposed to the outside to improve the outer appearance.

Particularly, the driving device constituted by the electric devices may be disposed inside the door part, and it may be possible to prevent the user from accessing the door to prevent the occurrence of the safety accident.

Also, the driving device may be provided in the door to block the noise and reduce noise during the use.

Also, the driving part that occupies a large portion of the entire constituents may be disposed in the door part to minimize the storage capacity loss of the drawer part. Also, the elevation device or the structure that is compactly folded and accommodated in the descending state may be provided to secure the storage capacity in the refrigerator.

Also, the wiring guider that connects the door part including all of the electric components as well as the driving device to the cabinet to guide the wiring may be provided to prevent the wiring from being exposed and also being damaged even in the repeated draw-out operation of the drawer door.

Also, in the wiring guider, the rotation connection member to which the plurality of connecting members are rotatably connected and which is coupled to the side of the cabinet may also be rotatably provided to prevent the wiring from interfering with the wiring guider when the drawer door is inserted and withdrawn. Therefore, the drawer door may be stably inserted and withdrawn, and the wiring may be safely protected.

Also, the wiring guider may be disposed below the drawer part to provide the structure in which the wiring guider is coupled to the rear surface of the door part, thereby preventing the drawer door from being exposed while the drawer door is inserted and withdrawn. Therefore, the refrigerator may have the neat appearance, and also, the safety in use may be secured.

Also, the guide-side connector may be disposed on the front end of the wiring guider, and the door-side connector may be disposed on the rear surface of the door part. As a result, when the wiring guider is mounted on the door part, the guide-side connector and the door-side connector may be connected to each other to more facilitate the assembly and connection operations. In addition, the service of the electric components of the door part may be easy.

Also, the wiring guider may include the rotation connection member that is rotatably coupled to the cabinet. Thus, the wiring guider may be smoothly movable as the drawer part is inserted and withdrawn to prevent the wiring from being short-circuited and damaged.

Also, the rotation connection member may include the connection member stepped part and the connecting portion fixing part and be inserted into the wiring inlet hole defined in the bottom surface of the storage space to facilitate the assembly. In addition, even though the large force is applied to the wiring guider, the firm coupling state may be maintained.

Also, the connecting portion fixing part coupled to the connecting portion coupling part disposed on the bottom surface of the drawer part may be disposed on the plurality of connecting portions constituting the wiring guider. Thus, the long wiring guider may be prevented from drooping to reliably insert and withdraw the drawer door and prevent the wiring from being damaged.

Also, the cover plate constituting the wiring guider may cover the draw-out driving device configured to insert and withdraw the drawer door. Thus, the draw-out driving device and the wiring guider, which require the electrical connection, may be provided in the same space to facilitate the assembly and the service.

In addition, the draw-out driving device may be disposed in the recessed space of the bottom surface of the cabinet to minimize the loss of the storage space.

Also, the mounting structure of the draw-out motor, the pinion, the rack restriction device, and the detection device may be provided through the cover plate and thus be modularized to more improve the assembly operation.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A home appliance comprising:

a cabinet that defines a storage chamber;

a drawer door including a door part configured to open and close the storage chamber, the door part having an electric device installed thereon, and a drawer part connected to a rear of the door part and configured to be inserted into and withdrawn out of the storage chamber;

a wiring guider having one end coupled to a rear surface of the door part and the other end coupled to a bottom surface of the storage chamber; and a wiring extending from the electric device and guided by the wiring guider, wherein the wiring guider comprises:

a guide head coupled to the rear surface of the door part;

a rotation connection member rotatably mounted to the bottom surface of the storage chamber; and a plurality of flexible portions connecting the guide head and the rotation connection member, and wherein connection parts between the plurality of flexible portions are configured to be rotatable in a horizontal direction.

2. The home appliance of claim 1, wherein the flexible portion comprises a front connection part extending forward and defining a connection hole open in a vertical direction.

3. The home appliance of claim 2, wherein the rotation connection member comprises a connection protrusion protruding in the vertical direction and axially coupled to one end of one of the plurality of flexible portions, and wherein the one of the plurality of flexible portions is configured to be rotatable in the horizontal direction about the connection protrusion as an axis.

4. The home appliance of claim 3, wherein the connection protrusion is inserted into the connection hole of the one of the plurality of flexible portions to provide an axis for rotation in the horizontal direction.

5. The home appliance of claim 2, wherein the flexible portion further comprises a rear connection part extending rearward and defining a rear protrusion protruding in the vertical direction.

6. The home appliance of claim 5, wherein the rear protrusion of the rear connection part is inserted into a connection hole of a front connection part of another flexible portion to provide an axis for rotation in the horizontal direction.

7. The home appliance of claim 2, wherein the guide head comprises a head connection part extending from a rear surface thereof and defining a head protrusion protruding in the vertical direction.

8. The home appliance of claim 7, wherein the head connection part is rotatably connected to the front connection part.

9. The home appliance of claim 7, wherein the head connection part is formed to have a same shape as the rear connection part.

10. The home appliance of claim 1, wherein the guide head is defined as the one end of the wiring guider and is moved in a front-rear direction, which is a direction in which the drawer door is inserted into and withdrawn out, and wherein the rotation connection member is defined as the other end of the wiring guider and mounted to be rotatable in the horizontal direction.

11. The home appliance of claim 1, wherein at least some of the plurality of flexible portions include a flexible portion fixing part formed as a groove open upwardly, and wherein the flexible portion fixing part is arranged along a moving direction of the drawer part.

12. The home appliance of claim 11, wherein a bottom surface of the drawer part is formed a flexible portion coupling part formed to correspond to the flexible portion fixing part.

13. The home appliance of claim 12, wherein the flexible portion coupling part includes a connection rod press-fitted into the flexible portion fixing part.

14. The home appliance of claim 1, further comprising:

a cover plate provided on the bottom surface of the storage chamber; and a wiring inlet hole formed to pass through the cover plate and configured to guide entry and exit of the wiring.

15. The home appliance of claim 14, wherein the cover plate covers a draw-out driving device accommodated in an inner area of a lower surface of the cabinet for movement of the drawer door.

16. The home appliance of claim 14, further comprising a mounting plate mounted to a portion of the cover plate and having a mounting opening in which the rotation connection member is rotatably mounted, wherein the rotation connection member forms a stepped portion along a circumference of a lower surface thereof, the stepped portion having a diameter larger than an inner diameter of the mounting opening.

17. A home appliance comprising:

a cabinet that defines a storage chamber;

a drawer door including a door part configured to open and close the storage chamber, the door part having an electric device installed thereon, and a drawer part connected to a rear of the door part and configured to be inserted into and withdrawn out of the storage chamber;

a wiring guider having one end coupled to a rear surface of the door part and the other end coupled to a bottom surface of the storage chamber; and a wiring extending from the electric device and guided by the wiring guider, wherein the wiring guider comprises:

a guide head coupled to the rear surface of the door part;

a rotation connection member rotatably mounted to the bottom surface of the storage chamber; and a flexible portion connecting the guide head and the rotation connection member, and wherein the flexible portion is fixed in a vertical direction by a bottom surface of the drawer part.

18. The home appliance of claim 17, wherein the flexible portion includes a flexible portion fixing part formed as a groove open upwardly, and wherein the bottom surface of the drawer part is formed with a flexible portion coupling part connected to the flexible portion fixing part.

19. The home appliance of claim 18, wherein the flexible portion coupling part has a connection rod formed to correspond to the groove open upwardly.

20. The home appliance of claim 17, wherein the flexible portion comprises:

a front connection part extending forward and defining a connection hole open in the vertical direction; and a rear connection part extending rearward and defining a rear protrusion protruding in the vertical direction, wherein a plurality of the flexible portions are connected to be rotatable in a horizontal direction, and wherein a rear protrusion of one flexible portion is inserted into a connection hole of another flexible portion to provide an axis for rotation in the horizontal direction.

* * * * *